US011493232B2

(12) United States Patent
Sugawara et al.

(10) Patent No.: US 11,493,232 B2
(45) Date of Patent: Nov. 8, 2022

(54) SILENCING SYSTEM

(71) Applicant: FUJIFILM Corporation, Tokyo (JP)

(72) Inventors: Yoshihiro Sugawara, Kanagawa (JP); Shogo Yamazoe, Kanagawa (JP); Shinya Hakuta, Kanagawa (JP); Akihiko Ohtsu, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 560 days.

(21) Appl. No.: 16/718,819

(22) Filed: Dec. 18, 2019

(65) Prior Publication Data

US 2020/0124320 A1 Apr. 23, 2020

Related U.S. Application Data

(63) Continuation of application No. PCT/JP2018/025405, filed on Jul. 4, 2018.

(30) Foreign Application Priority Data

Jul. 5, 2017 (JP) ..... JP2017-131815
Sep. 21, 2017 (JP) ..... JP2017-181085
(Continued)

(51) Int. Cl.
*F24F 13/24* (2006.01)
*G10K 11/162* (2006.01)
*G10K 11/172* (2006.01)

(52) U.S. Cl.
CPC ..... *F24F 13/24* (2013.01); *G10K 11/162* (2013.01); *G10K 11/172* (2013.01); *F24F 2013/245* (2013.01)

(58) Field of Classification Search
CPC .. F24F 13/24; F24F 2013/245; G10K 11/162; G10K 11/172
See application file for complete search history.

(56) References Cited

U.S. PATENT DOCUMENTS 4,842,097 A 6/1989 Woodward et al.
5,783,780 A 7/1998 Watanabe et al.
(Continued)

FOREIGN PATENT DOCUMENTS

JP S557404 U 1/1980
JP H09144986 A 6/1997
(Continued)

OTHER PUBLICATIONS

International Search Report issued in PCT/JP2018/025405; dated Oct. 2, 2018.
(Continued)

*Primary Examiner* — Forrest M Phillips
(74) *Attorney, Agent, or Firm* — Studebaker & Brackett PC

(57) ABSTRACT

An object is to provide a silencing system that can achieve both high ventilation performance and high soundproof performance, can silence a plurality of pieces of resonant sound, and has high general-purpose properties since the silencing system does not need to be designed according to a tubular member. In a silencing system where silencers are disposed on a tubular member, the silencers silence sound having a frequency of first resonance of the tubular member, each silencer includes a cavity portion and an opening portion, the opening portions are connected to a sound field space of the first resonance of the tubular member, a conversion mechanism for converting sound energy into thermal energy is disposed in each cavity portion or at a position where the conversion mechanism covers the opening portion, a ratio $S_1/S_d$ of the area $S_1$ to the area $S_d$ satisfies "$0<S_1/S_d<40\%$" in a case where the area of the opening portion of the silencer is denoted by $S_1$ and the surface area of an inner wall of the cavity portion is denoted by $S_d$, and the depth $L_d$ of the cavity portion in the traveling direction
(Continued)

of an acoustic wave in the silencer satisfies "$0.011\times\lambda<L_d<0.25\times\lambda$," in a case where the wavelength of an acoustic wave at the resonant frequency of the first resonance is denoted by λ.

19 Claims, 53 Drawing Sheets

(30) Foreign Application Priority Data

Jan. 29, 2018 (JP) ..... JP2018-012664
Jan. 29, 2018 (JP) ..... JP2018-012778

(56) References Cited

U.S. PATENT DOCUMENTS

| | | | |
|---|---|---|---|
| 2017/0030610 | A1 | 2/2017 | Schaake et al. |
| 2017/0092255 | A1 | 3/2017 | Yakumaru et al. |

FOREIGN PATENT DOCUMENTS

| | | | |
|---|---|---|---|
| JP | 2000088331 | A | 3/2000 |
| JP | 2001336457 | A | 12/2001 |
| JP | 2005344956 | A | 12/2005 |
| JP | 2007047560 | A | 2/2007 |
| JP | 2007-169959 | A | 7/2007 |
| JP | 4820163 | B2 | 11/2011 |
| JP | 2013164229 | A | 8/2013 |
| JP | 2014-052539 | A | 3/2014 |
| JP | 2016095070 | A | 5/2016 |
| JP | 2017063021 | A | 3/2017 |
| JP | 2017116837 | A | 6/2017 |
| WO | 2016020159 | A1 | 2/2016 |
| WO | 2016040431 | A1 | 3/2016 |
| WO | 2019/009342 | A1 | 1/2019 |

OTHER PUBLICATIONS

International Preliminary Report On Patentability issued in PCT/JP2018/025405; completed Jul. 11, 2019.

An Office Action mailed by the Japanese Patent Office dated Mar. 13, 2018, which corresponds to Japanese Patent Application No. 2018-012664 and is related to U.S. Appl. No. 16/718,819.

An Office Action mailed by the Japanese Patent Office dated Nov. 27, 2018, which corresponds to Japanese Patent Application No. 2018-138238 and is related to U.S. Appl. No. 16/718,819.

The extended European search report issued by the European Patent Office dated Jun. 18, 2020, which corresponds to European Application No. 18828561.3-1001 and is related to U.S. Appl. No. 16/718,819.

Selamet A. et al., "Helmholtz resonator lined with absorbing material", The Journal of the Acoustical Society of America, American Institute of Physics for the Acoustical Society of America, New York, NY, US, vol. 117, No. 2, Feb. 1, 2005, pp. 725-733, XP012072774.

SILENCING SYSTEM

CROSS-REFERENCE TO RELATED APPLICATIONS

This application is a Continuation of PCT International Application No. PCT/JP2018/025405 filed on Jul. 4, 2018, which claims priority under 35 U.S.C. § 119(a) to Japanese Patent Application No. 2017-131815, filed on Jul. 5, 2017, Japanese Patent Application No. 2017-181085, filed on Sep. 21, 2017, Japanese Patent Application No. 2018-012664, filed on Jan. 29, 2018, and, Japanese Patent Application No. 2018-012778, filed on Jan. 29, 2018. Each of the above applications is hereby expressly incorporated by reference, in its entirety, into the present application.

BACKGROUND OF THE INVENTION

1. Field of the Invention

The present invention relates to a silencing system.

2. Description of the Related Art

With regard to tubular members, such as a ventilation port and an air-conditioning duct, which are provided in a wall separating the interior and the exterior and penetrate the interior and the exterior, sound-absorbing materials, such as urethane and polyethylene, are installed in the tubular members to suppress the transmission of noise from the exterior to the interior or to suppress the transmission of noise from the interior to the exterior.

However, since an absorption coefficient for sound having a low frequency of 800 Hz or less is extremely reduced in a case where sound-absorbing materials, such as urethane and polyethylene, are used, a volume needs to be increased to increase the absorption coefficient. However, since the ventilation performance of the ventilation port, the air-conditioning duct, and the like need to be ensured, there is a limit to the size of the sound-absorbing material. For this reason, there is a problem that it is difficult to achieve both high ventilation performance and high soundproof performance.

Here, the resonant sound of the tubular members may be critical as the noise of the tubular members, such as the ventilation port and the air-conditioning duct. Particularly, resonant sound having the lowest frequency is critical. In a case where the frequency of the resonant sound is 800 Hz or less, the amount of the sound-absorbing material is significantly increased to perform soundproofing using the sound-absorbing material. For this reason, it is generally difficult to output sufficient soundproof performance despite the sacrifice of ventilation. As an example of a commercially available product, the opening ratio of a soundproof sleeve (SK-BO75 manufactured by Shinkyowa Co., Ltd.) made of polyethylene, which is a sound-absorbing material type soundproof product to be inserted into a ventilation sleeve for a house, is 36%, so that the amount of ventilation air is significantly reduced. However, 80% or more of resonant sound is transmitted through the soundproof sleeve.

A resonance type silencer, which silences sound having a specific frequency, is used to silence the resonant sound of such a tubular member.

For example, JP4820163B (JP2007-169959A) discloses ventilation hole structure where a ventilation sleeve for ventilation between a first space and a second space is provided so as to penetrate a partition part partitioning the first space and the second space, a resonance type silencing mechanism for silencing sound passing through the ventilation sleeve is provided in the ventilation sleeve, and the resonance type silencing mechanism is formed on the outer peripheral portion of the ventilation sleeve at a position outside the partition part in the direction of an axis of the ventilation sleeve and at a position between the partition part and a decorative plate that is provided so as to be away from the surface of the partition part along the partition part. Further, a side-branch type silencer and a Helmholtz resonator are disclosed as the resonance type silencing mechanism.

Further, JP2016-095070A discloses a silencing tubular body which is used in a state where the silencing tubular body is installed in a sleeve tube of a natural ventilation port. At least one end portion of the silencing tubular body is closed and an opening portion is provided near the other end portion thereof, the length of the silencing tubular body from one end portion to the center of the opening portion is about the half of the total length of a sleeve tube, and a porous material is disposed in the silencing tubular body.

Further, JP2016-095070A discloses that the thickness of the outer wall of a house, a mansion, or the like is in the range of about 200 to 400 mm and sound-insulation performance is lowered in a frequency band of first resonant frequencies (400 to 700 Hz) generated in the sleeve tube provided in the outer wall (see FIG. 15).

SUMMARY OF THE INVENTION

However, according to the inventors' examination, since the resonance type silencer needs to have a length of ¼ of at least the wavelength at a resonant frequency in a case where the resonance type silencer is used to silence sound having the lowest resonant frequency of the tubular member, the size of the silencer is increased. For this reason, there is a problem that it is difficult to achieve both high ventilation performance and high soundproof performance.

Further, the resonance type silencer is to selectively silence sound having a specific frequency (frequency band). In a case where the length, the shape, or the like of the tubular member is changed, the resonant frequency of the tubular member is also changed. For this reason, since the resonance type silencer needs to be designed according to the tubular member, there is a problem that the resonance type silencer has low general-purpose properties.

Furthermore, the resonance of the tubular member occurs at a plurality of frequencies, but the resonance type silencer silences sound having a specific frequency. For this reason, since resonant sound, which is an object to be silenced, is sound having only one frequency and the frequency band of sound to be silenced by the resonance type silencer is narrow, there is a problem that the resonance type silencer cannot silence resonant sound having other frequencies.

Further, it is effective that the resonance type silencer is disposed in an open space. However, in a case where the resonance type silencer is disposed in a resonant body, such as a tubular member, with the equal resonant frequency, the resonance of the tubular member and the resonance of the silencer interact with each other. Accordingly, original resonance transmitted sound caused by the tubular member is separated into two frequencies, so that new resonance transmitted sound is generated. For this reason, there is a problem that an effect as a silencer is less.

An object of the invention is to solve the problems in the related art and to provide a silencing system that can achieve both high ventilation performance and high soundproof performance, can silence a plurality of pieces of resonant sound, and has high general-purpose properties since the silencing system does not need to be designed according to a tubular member.

As a result of keen examination for achieving the object, the inventors have found a solution for the above-mentioned problems and have completed the invention through a silencing system. The silencing system includes one or more silencers that are disposed on a tubular member provided to penetrate a wall separating two spaces. The silencers silence sound having a frequency that includes a frequency of first resonance occurring in the tubular member, each silencer includes a cavity portion and an opening portion that allows the cavity portion and the outside to communicate with each other, at least one of the opening portions of the silencers is connected to a sound field space of the first resonance of the tubular member of the silencing system, and a conversion mechanism for converting sound energy into thermal energy is disposed in at least a part of the cavity portion of each silencer or at a position where the conversion mechanism covers at least a part of the opening portion of each silencer. In a case where an area of the opening portion of the silencer is denoted by $S_1$ and a surface area of an inner wall of the cavity portion is denoted by $S_d$, a ratio $S_1/S_d$ of the area $S_1$ to the area $S_d$ satisfies "$0<S_1/S_d<40\%$". In a case where a wavelength of an acoustic wave at a resonant frequency of the first resonance is denoted by $\lambda$, a depth $L_d$ of the cavity portion in a traveling direction of an acoustic wave in the silencer satisfies "$0.011\times\lambda<L_d<0.25\times\lambda$".

That is, the inventors have found that the object can be achieved by the following configuration.

[1] A silencing system comprising:

one or more silencers that are disposed on a tubular member provided to penetrate a wall separating two spaces, in which the silencers silence sound having a frequency that includes a frequency of first resonance occurring in the tubular member, the silencer includes a cavity portion and an opening portion that allows the cavity portion and the outside to communicate with each other, at least one of the opening portions of the silencers is connected to a sound field space of the first resonance of the tubular member in the silencing system, a conversion mechanism for converting sound energy into thermal energy is disposed in at least a part of the cavity portion of the silencer or at a position where the conversion mechanism covers at least a part of the opening portion of the silencer, a depth $L_d$ of the cavity portion in a traveling direction of an acoustic wave in the silencer is larger than a width $L_o$ of the opening portion in an axial direction of the tubular member, in a case where a wavelength of an acoustic wave at a resonant frequency of the first resonance is denoted by $\lambda$, the depth $L_d$ of the cavity portion in the traveling direction of an acoustic wave in the silencer satisfies "$0.011\times\lambda<L_d<0.25\times\lambda$", and the silencer does not resonate with sound having the frequency of the first resonance occurring in the tubular member, and silences the sound having the frequency of the first resonance by the conversion mechanism without silencing the sound with resonance of the silencer alone.

[2] A silencing system comprising:

one or more silencers that are disposed on a tubular member provided to penetrate a wall separating two spaces, in which the silencer silences sound having a frequency that includes a frequency of first resonance occurring in the tubular member, the silencer includes a cavity portion and an opening portion that allows the cavity portion and the outside to communicate with each other, at least one of the opening portions of the silencers is connected to a sound field space of the first resonance of the tubular member in the silencing system, a conversion mechanism for converting sound energy into thermal energy is disposed in at least a part of the cavity portion of the silencer or at a position where the conversion mechanism covers at least a part of the opening portion of the silencer, in a case where an area of the opening portion of the silencer is denoted by $S_1$ and a surface area of an inner wall of the cavity portion is denoted by $S_d$, a ratio $S_1/S_d$ of the area $S_1$ to the area Sa satisfies "$0<S_1/S_d<40\%$", in a case where a wavelength of an acoustic wave at a resonant frequency of the first resonance is denoted by $\lambda$, a depth $L_d$ of the cavity portion in a traveling direction of an acoustic wave in the silencer satisfies "$0.011\times\lambda<L_d<0.25\times\lambda$", and the silencer does not resonate with sound having the frequency of the first resonance occurring in the tubular member, and silences the sound having the frequency of the first resonance by the conversion mechanism without silencing the sound with resonance of the silencer alone.

[3] The silencing system according to [1] or [2], in which "$1.15\times F_0<F_1$" is satisfied in a case where the frequency of the first resonance occurring in the tubular member is denoted by $F_0$ and the resonant frequency of the silencer is denoted by $F_1$.

[4] The silencing system according to any one of [1] to [3], in which a width $L_w$ of the cavity portion in a direction orthogonal to a depth direction of the cavity portion in a cross section parallel to the axial direction of the tubular member satisfies "$0.001\times\lambda<L_w<0.061\times\lambda$".

[5] The silencing system according to any one of [1] to [4], in which the conversion mechanism is a sound-absorbing material, and flow resistance $\sigma_1$ of the sound-absorbing material satisfies "$(1.25-\log(0.1\times L_d))/0.24<\log(\sigma_1)<5.6$".

[6] The silencing system according to [5], in which the flow resistance al of the sound-absorbing material satisfies "$(1.32-\log(0.1\times L_d))/0.24<\log(\sigma_1)<5.2$".

[7] The silencing system according to [5], in which the flow resistance $\sigma_1$ of the sound-absorbing material satisfies "$(1.39-\log(0.1\times L_d))/0.24<\log(\sigma_1)<4.7$".

[8] The silencing system according to any one of [1] to [7], in which, in a cross section parallel to the axial direction of the tubular member, the silencer includes the cavity portion that extends in the axial direction of the tubular member and the opening portion that is positioned on one surface of the cavity portion parallel to the axial direction of the tubular member at one end portion of the cavity portion in the axial direction of the tubular member, and a length of the cavity portion in the axial direction of the tubular member is the depth $L_d$ of the cavity portion.

[9] The silencing system according to [8], in which an area $S_1$ of the opening portion on a circumferential surface, which has an axis on a central axis of the tubular member, is smaller than an area $S_0$ of the cavity portion.

[10] The silencing system according to any one of [1] to [9], in which two or more silencers are provided, and the opening portions of the respective silencers are disposed so as to be rotationally symmetric with respect to a central axis of the tubular member.

[11] The silencing system according to any one of [1] to [10], in which at least some of the silencers are disposed on an outer periphery of the tubular member.

[12] The silencing system according to [11], in which, in a cross section perpendicular to the axial direction of the tubular member, an effective outer diameter Do of the tubular member and an effective outer diameter $D_1$ of the silencer satisfy "$D_1<D_0+2\times(0.045>\lambda\times+5$ mm)".

[13] The silencing system according to [11] or [12], in which the opening portions of the silencers are connected to peripheral surface-opening portions formed on a peripheral surface of the tubular member.

[14] The silencing system according to any one of [1] to [13], in which the silencers are disposed in the tubular member.

[15] The silencing system according to any one of [1] to [14], in which a plurality of the silencers are provided, and the opening portions of the plurality of silencers are disposed on at least two or more positions in the axial direction of the tubular member.

[16] The silencing system according to [15], in which the depths $L_d$ of the cavity portions of the silencers are different at the respective positions of the opening portions.

[17] The silencing system according to [15] or [16], in which sound-absorbing materials having different acoustic characteristics are disposed in the cavity portions of the silencers at the respective positions of the opening portions.

[18] The silencing system according to any one of [1] to [17], further comprising:

a decorative plate that is provided in parallel to the wall, in which a total thickness of the wall and the decorative plate including a space between the wall and the decorative plate is in a range of 175 mm to 400 mm.

[19] The silencing system according to any one of [1] to [18], in which each silencer is disposed between the wall and a decorative plate, which is disposed so as to be away from the wall, in the axial direction of the tubular member so that a part of the silencer is inserted into a through-hole formed in the decorative plate, and the silencing system further comprises a boundary cover that covers a boundary between the decorative plate and the silencer as seen in the axial direction of the tubular member.

[20] The silencing system according to any one of [1] to [19], in which the silencer is disposed at one end portion of the tubular member in the axial direction of the tubular member, and the silencing system further comprises a soundproof member that is disposed in the tubular member.

[21] The silencing system according to any one of [1] to [20], in which the silencer is disposed at one end portion of the tubular member in the axial direction of the tubular member, and the silencing system further comprises a soundproof member that is disposed at the other end portion of the tubular member.

[22] The silencing system according to any one of [1] to [21], in which a width $L_w$ of the cavity portion of the silencer satisfies "5.5 mm$\leq L_w \leq$300 mm".

[23] The silencing system according to any one of [1] to [22], in which the depth $L_d$ of the cavity portion of the silencer satisfies "25.3 mrriLa_175 mm".

[24] The silencing system according to any one of [1] to [23], in which the conversion mechanism is a sound-absorbing material, and a plurality of the sound-absorbing materials are disposed in the cavity portion.

According to the invention, it is possible to provide a silencing system that can achieve both high ventilation performance and high soundproof performance, can silence a plurality of pieces of resonant sound, and has high general-purpose properties since the silencing system does not need to be designed according to a tubular member.

DESCRIPTION OF THE PREFERRED EMBODIMENTS

The invention will be described in detail below.

The descriptions of components to be made below will be based on a representative embodiment of the invention, but the invention is not limited to the embodiment.

Further, in this specification, a numerical range described using "to" means a range that includes numerical values written in the front and rear of "to" as a lower limit and an upper limit.

Furthermore, in this specification, "orthogonal" and "parallel" include the range of an error to be allowed in a technical field to which the invention pertains. For example, "orthogonal" and "parallel" mean that an angle is in a range including an error smaller than ±10° from exact orthogonal or exact parallel, and an error from exact orthogonal or exact parallel is preferably 5° or less and more preferably 3° or less.

In this specification, "the same" and "equal" include the range of an error to be generally allowed in a technical field. Further, in this specification, "the entire", "all", "the entire surface", or the like includes the range of an error to be generally allowed in a technical field, and include the case of 99% or more, 95% or more, or 90% or more in addition to the case of 100%.

[Silencing System]

The configuration of a silencing system according to an embodiment of the invention will be described with reference to the drawings.

The silencing system according to the embodiment of the invention is a silencing system in which a silencer not resonating with sound having the frequency of first resonance of a tubular member is disposed in the tubular member or near the tubular member to silence sound having the frequency of first resonance occurring in the tubular member.

Figure 1:
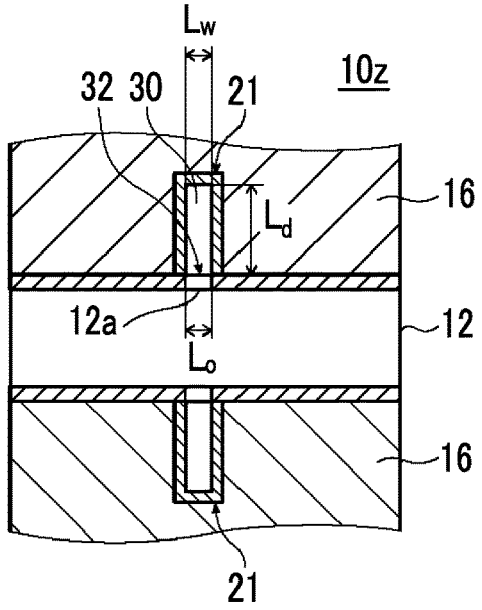
FIG. 1 is a cross-sectional view conceptually showing an example of a silencing system according to an embodiment of the invention.

FIG. 1 is a schematic cross-sectional view showing an example of a silencing system according to a preferred embodiment of the invention.

As shown in FIG. 1, a silencing system 10*z* has configuration where silencers 21 are disposed on the outer peripheral surface of a cylindrical tubular member 12 provided to penetrate a wall 16 separating two spaces.

The tubular member 12 is, for example, a ventilation port and a ventilation sleeve, such as an air-conditioning duct.

The silencers 21 are to silence sound having frequencies that include the frequency of first resonance occurring in the tubular member.

Each silencer 21 has the shape of a substantially rectangular parallelepiped extending in the radial direction of the tubular member 12, and includes a cavity portion 30 that is formed therein so as to have the shape of a substantially rectangular parallelepiped. An opening portion 32, which allows the cavity portion 30 and the outside to communicate with each other, is formed on the end face of each cavity portion 30 facing the tubular member 12.

The opening portions 32 of the silencers 21 are connected to peripheral surface-opening portions 12*a* formed on the peripheral surface of the tubular member 12. Since the opening portions 32 are connected to the peripheral surface-opening portions 12*a*, the opening portions 32 are connected to a sound field space of first resonance occurring in the tubular member 12 of the silencing system 10*z*.

The tubular member 12 may be a general duct used for various devices without being limited to a ventilation port, an air-conditioning duct, and the like.

Further, in a case where the depth of the cavity portion 30 in the traveling direction of acoustic waves in the cavity portion 30 of the silencer 21 is denoted by La and the width of the opening portion 32 of the silencer 21 in the axial direction of the tubular member 12 (hereinafter, simply referred to as the axial direction) is denoted by $L_o$, the depth $L_d$ of the cavity portion 30 is larger than the width $L_o$ of the opening portion 32 as shown in FIG. 1.

Here, the traveling direction of acoustic waves in the cavity portion 30 can be obtained from a simulation. Since the cavity portion 30 extends in the radial direction in the example shown in FIG. 1, the traveling direction of acoustic waves in the cavity portion 30 is the radial direction (a vertical direction in FIG. 1). Accordingly, the depth $L_d$ of the cavity portion 30 is a length from the opening portion 32 to the upper end of the cavity portion 30 in the radial direction. In a case where the depth of the cavity portion 30 varies depending on a position, the depth $L_d$ of the cavity portion 30 is the average value of depths obtained at the respective positions.

Further, in a case where the width of the opening portion 32 varies depending on a position, the width $L_o$ of the opening portion 32 is the average value of widths obtained at the respective positions.

Furthermore, in a case where the wavelength of the acoustic wave at the resonant frequency of first resonance occurring in the tubular member 12 of the silencing system is denoted by λ, the depth $L_d$ of the cavity portion 30 of the silencer 21 satisfies "$0.011\times\lambda<L_d<0.259\lambda$". That is, the depth $L_d$ of the cavity portion 30 is smaller than λ/4 and the silencer 21 does not silence sound by resonance.

In a case where a resonance type silencer is used to silence sound having the lowest resonant frequency of the tubular member, the silencer needs to have a length of ¼ of at least the wavelength λ at a resonant frequency as described above. Accordingly, the size of the silencer is increased. For this reason, there is a problem that it is difficult to achieve both high ventilation performance and high soundproof performance.

Further, the resonance type silencer is to selectively silence sound having a specific frequency (frequency band). For this purpose, the resonance type silencer needs to be designed according to the resonant frequency of the tubular member. For this reason, there is a problem that the resonance type silencer has low general-purpose properties.

Furthermore, the resonance of the tubular member occurs at a plurality of frequencies, but the resonance type silencer silences sound having a specific frequency. For this reason, since resonant sound, which is an object to be silenced, is sound having only one frequency and the frequency band of sound to be silenced by the resonance type silencer is narrow, there is a problem that the resonance type silencer cannot silence resonant sound having other frequencies.

Further, it is effective that the resonance type silencer is disposed in an open space. However, in a case where the resonance type silencer is disposed in a resonant body, such as a tubular member, with the equal resonant frequency, the resonance of the tubular member and the resonance of the silencer interact with each other. Accordingly, original resonance transmitted sound caused by the tubular member is separated into two frequencies, so that new resonance transmitted sound is generated. For this reason, there is a problem that an effect as a silencer is less.

In contrast, in the embodiment of the invention, each silencer 21, which includes the cavity portion 30 and the opening portion 32 and of which the depth $L_d$ of the cavity portion 30 in the traveling direction of acoustic waves in the silencer is larger than the width $L_o$ of the opening portion in the axial direction of the tubular member and the depth $L_d$ of the cavity portion satisfies "$0.011\times\lambda<L_d<0.25\times\lambda$" in a case where the wavelength of the acoustic wave at the resonant frequency of the first resonance of the tubular member 12 is denoted by λ, is disposed so as to be connected to the sound field space of the first resonance of the tubular member 12.

The silencer 21 silences sound by converting sound energy into thermal energy with the viscosity of fluid near the wall surface of the silencer 21 and the unevenness (surface roughness) of a wall surface, a sound-absorbing material 24 to be described later that is disposed in the silencer 21, or the like. The viscosity of fluid near the wall surface and the unevenness (surface roughness) of the wall surface, or the sound-absorbing material 24 disposed in the silencer 21 is a conversion mechanism of the invention.

Here, since the width $L_o$ of the opening portion 32 of the silencer 21 is smaller than the depth $L_d$ of the cavity portion 30, the moving speeds of gas (air) molecules are increased while sound pressure is maintained in a case where the acoustic waves in the tubular member 12 flow into the silencer 21. The efficiency of the conversion of sound energy into thermal energy, which is performed by the conversion mechanism, depends on sound pressure and the moving speeds of gas molecules. For this reason, since the moving speeds of gas molecules are increased while sound pressure is maintained, the efficiency of the conversion of sound energy into thermal energy performed by the conversion mechanism is increased.

Since the resonance of the silencer is not used in the principle of this silencing, high soundproof performance can be achieved even though the depth $L_d$ of the cavity portion 30 is smaller than ¼ of the wavelength λ at the resonant frequency of the first resonance of the tubular member 12. Accordingly, high soundproof performance can be obtained while the ventilation performance of the tubular member 12 is maintained through a reduction in the size of the silencer 21.

Further, since the resonance of the silencer is not used in the principle of the silencing performed by the silencer 21, the dependence of acoustic waves on a wavelength is low, soundproof performance can be achieved even though the length, the shape, and the like of the tubular member 12 vary, and general-purpose properties are high since the silencer does not need to be designed according to the tubular member 12.

Furthermore, since the resonance of the silencer is not used in the principle of the silencing performed by the silencer 21, it is possible not only to silence sound having a specific frequency, which is determined depending on the structure of the silencer, but also to silence a plurality of pieces of resonant sound in a wide frequency band.

Moreover, since the resonance of the silencer is not used in the principle of the silencing performed by the silencer 21, a sufficient silencing effect is obtained without the occurrence of an interaction between the resonance of the tubular member and the resonance of the silencer and the separation of original resonance transmitted sound, which is caused by the tubular member, into two frequencies.

Here, a case where a resonance type silencer is disposed in the tubular member 12 will be described using a simulation.

An acoustic module of finite element method-calculation software COMSOL ver5.3 (manufactured by COMSOL Inc.) is used in the simulation.

Figure 110:
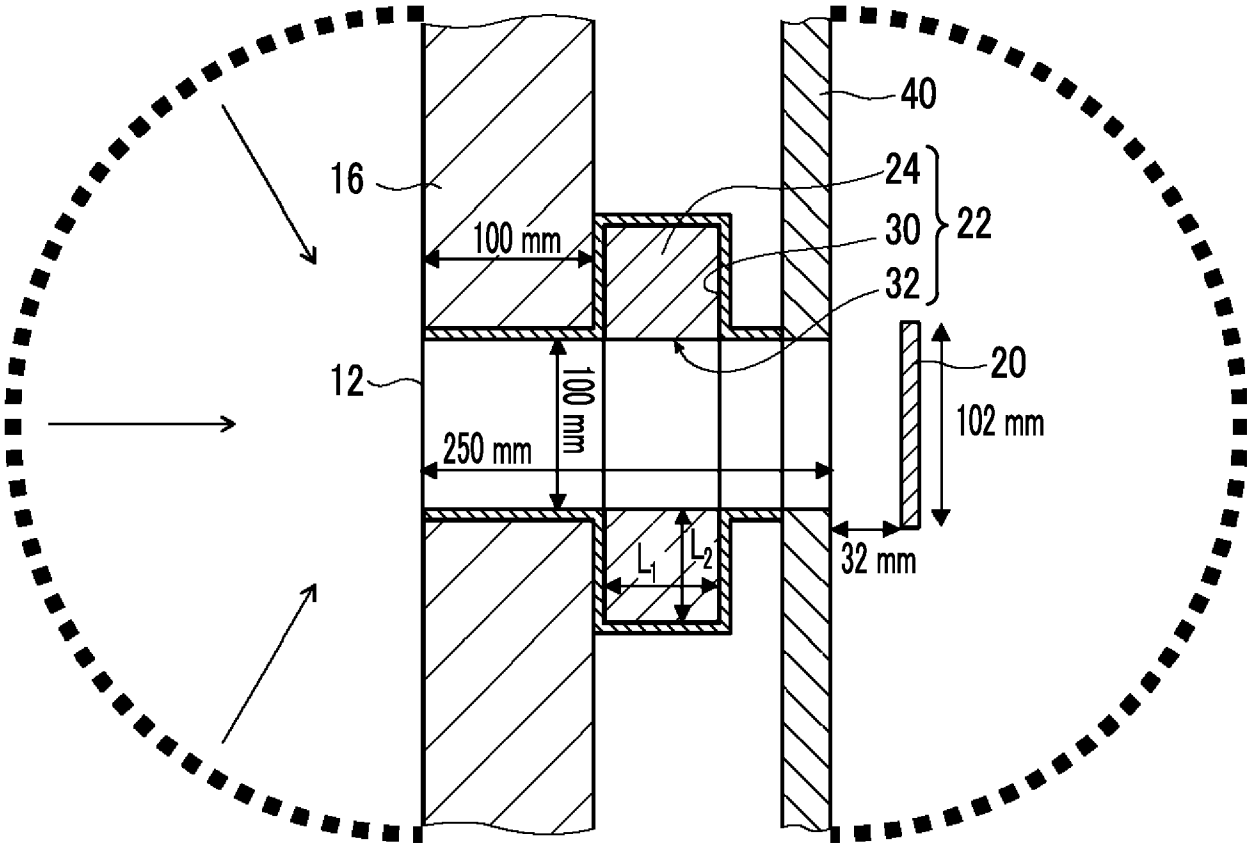
FIG. 110 is a diagram illustrating a method for a simulation.

As shown in FIG. 110, in the simulation, the diameter of a ventilation sleeve (tubular member) is set to 100 mm, the thickness of a wall is set to 100 mm, the thickness of a decorative plate is set to 10 mm, and a distance between the wall and the decorative plate is set to 140 mm. That is, the total thickness of the wall and the decorative plate is set to 250 mm.

As shown in FIG. 110, this simulation model is used to make acoustic waves be incident from the hemispherical surface of one space, which is partitioned by the wall, and to obtain the amplitude of an acoustic wave, which reaches the hemispherical surface of the other space, per unit volume. The hemispherical surface is a hemispherical surface that has a center at the center position of the open surface of the ventilation sleeve and has a radius of 500 mm. The amplitude of the acoustic wave, which is made to be incident, per unit volume is set to 1.

Further, the simulation model is modeled so that a lid of a register (a diameter of 102 mm) is disposed at a position away from the end face of the ventilation sleeve, which faces an acoustic wave-detection surface, by 32 mm.

First, a calculation is made for a case where a silencer is not disposed (hereinafter, referred to as the case of a straight tube), as a reference.

Figure 111:
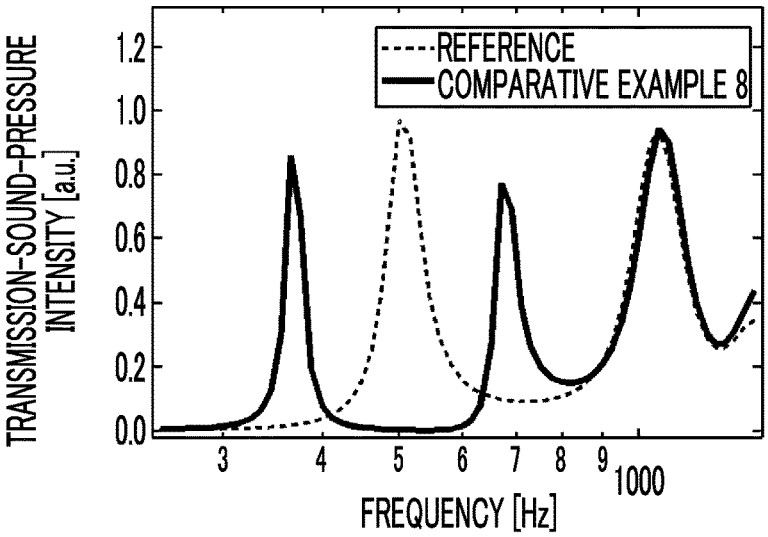
FIG. 111 is a graph showing a relationship between a frequency and transmission-sound-pressure intensity.

The results of the simulation are shown in FIG. 111 as a graph of a relationship between a frequency and transmission-sound-pressure intensity.

It is found from FIG. 111 that the frequency of first resonance of the ventilation sleeve 12 in a case where a silencer is not disposed (in the case of a straight tube) is about 515 Hz.

Next, an air column resonance type silencer of which the resonant frequency is about 515 Hz will be designed.

Figure 112:
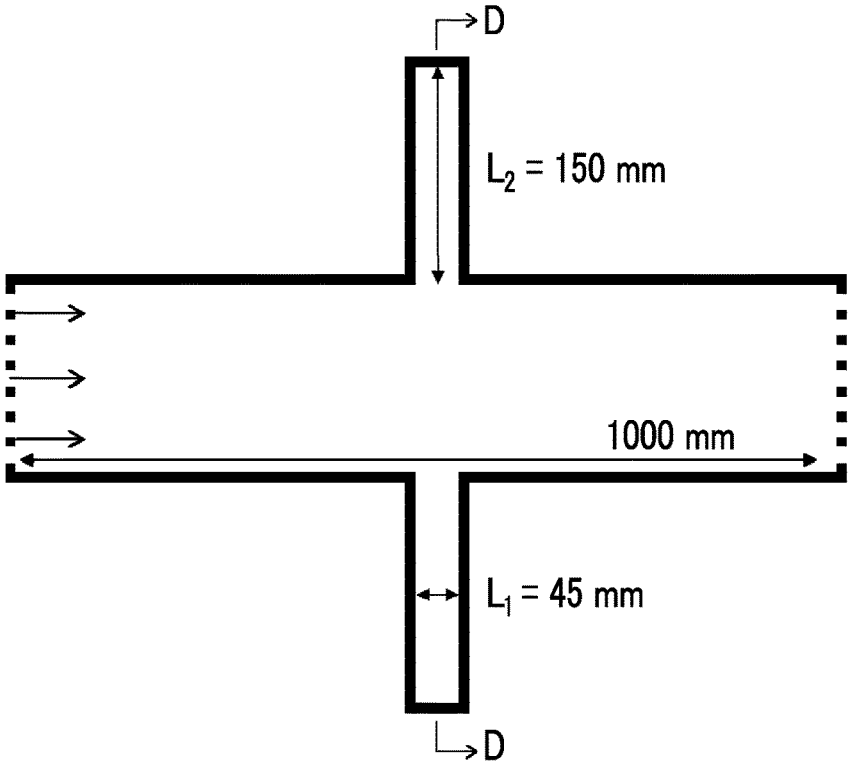
FIG. 112 is a conceptual diagram illustrating a method of evaluating a calculation model of Comparative Example.
Figure 113:
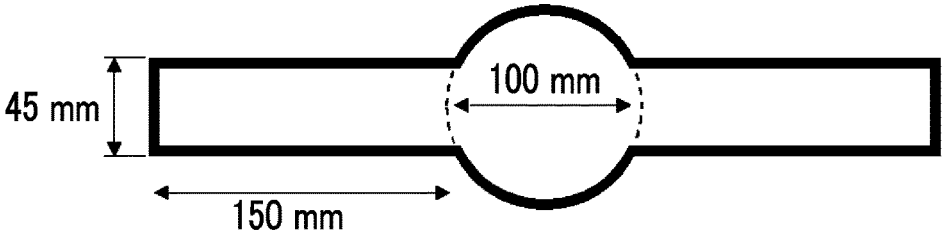
FIG. 113 is a cross-sectional view taken along line D-D of FIG. 112.

A model where air column resonance type silencers are connected to the outer peripheral portion of an acoustic tube having a length of 1000 mm and a diameter of 100 mm as shown in FIGS. 112 and 113 is made, and the basic acoustic characteristics of the air column resonance type silencer are evaluated. Plane waves are made to be incident on the acoustic tube from one end face of the acoustic tube, and the amplitude of the acoustic wave, which reaches the other end face of the acoustic tube, per unit volume is obtained. The amplitude of the acoustic wave, which is made to be incident, per unit volume is set to 1. The square of a value, which is obtained in a case where the integrated value of a sound pressure amplitude on the detection surface is divided by the integrated value of a sound pressure amplitude on the incident surface, is defined as transmission-sound-pressure intensity.

One surface of the air column resonance type silencer in a longitudinal direction is opened and is connected to the acoustic tube. Further, the position of the air column resonance type silencer in the axial direction of the acoustic tube is set substantially at the middle position of the acoustic tube.

Figure 114:
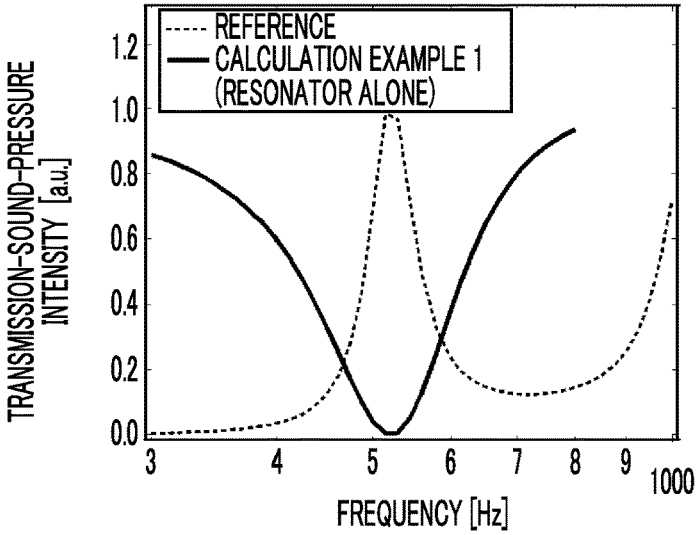
FIG. 114 is a graph showing a relationship between a frequency and transmission-sound-pressure intensity.

The air column resonance type silencer is formed in the shape of a rectangular parallelepiped of which the size of the cross section is 45 mm×45 mm, and a relationship between a frequency and transmission-sound-pressure intensity is calculated to obtain a resonant frequency while the length of the air column resonance type silencer is changed to various values. As a result, it is found that the resonant frequency of the air column resonance type silencer is about 515 Hz at a length of 150 mm as shown in FIG. 114 as Calculation Example 1.

Figure 115:
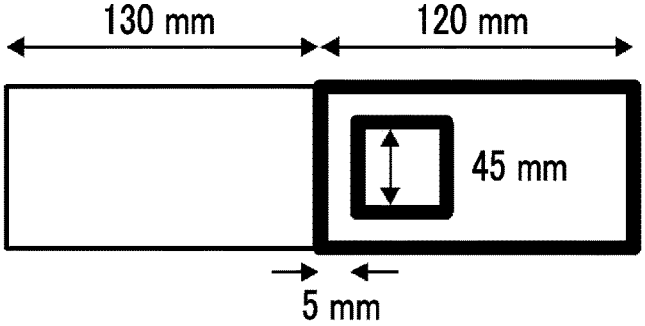
FIG. 115 is a schematic side view illustrating configuration of Comparative Example.

Next, a model where a silencer including an air column resonance type silencer is modeled and is connected to a ventilation sleeve as shown in FIG. 115 is made, and acoustic waves are made to be incident from the hemispherical surface of one space, which is partitioned by a wall, and the amplitude of the acoustic wave, which reaches the hemispherical surface of the other space, per unit volume is obtained in the same way as described above. The cross-sectional view of FIG. 115 taken at the position of the air column resonance type silencer is the same as FIG. 113.

As shown in FIGS. 113 and 115, the model of the air column resonance type silencer is adapted so that a tubular silencer is disposed at end portion of a ventilation sleeve, includes two air column resonance tubes formed in the shape of a prismatic column of 45 mm×45 mm, having a length (depth) of 150 mm, and provided on side surfaces thereof, and has a diameter (100 mm) equal to the diameter of the ventilation sleeve. The length of the ventilation sleeve in an axial direction is set to 130 mm, and the length of a tubular portion of the silencer in the axial direction is set to 120 mm. The position of the air column resonance tube in the axial direction is set to a position away from the end face of the silencer, which faces the ventilation sleeve side, by 5 mm.

The results of the simulation are shown in FIG. 111 as a graph of a relationship between a frequency and transmission-sound-pressure intensity (Comparative Example 8). Further, the results of an experiment are shown in FIG. 116 as a graph of a relationship between a frequency and transmission-sound-pressure intensity.

In the experiment, a silencer having the above-mentioned shape and dimensions is produced using an acrylic plate having a thickness of 5 mm and a relationship between a frequency and transmission-sound-pressure intensity is measured using a simple and small soundproof room to be described later by the same method as that of Example.

Figure 116:
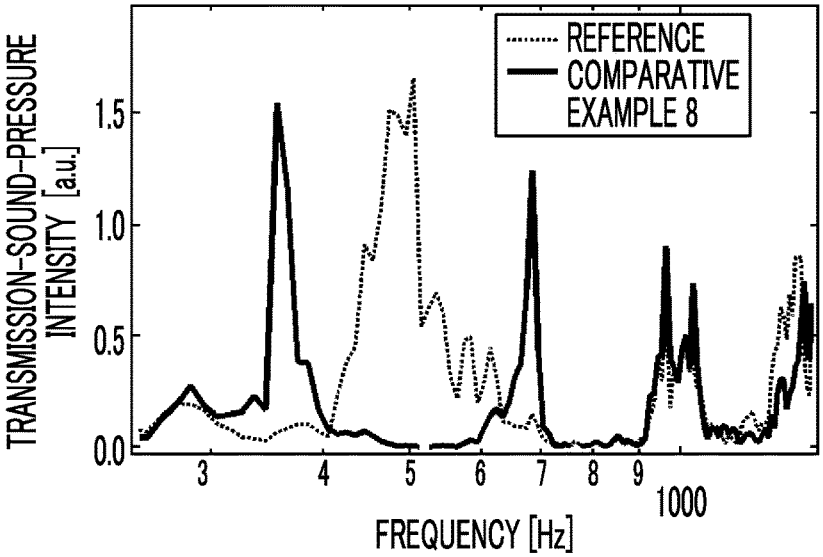
FIG. 116 is a graph showing a relationship between a frequency and transmission-sound-pressure intensity.

As shown in FIGS. 111 and 116 as Comparative Example 8, it is found that peaks of transmission-sound-pressure intensity are generated on both sides of the first resonant frequency of the ventilation sleeve, which is obtained in a case where the resonance type silencer is not disposed, in a case where the resonance type silencer is disposed at the ventilation sleeve. That is, peaks are generated at two frequencies, that is, a frequency lower than and a frequency higher than the first resonant frequency that is obtained in a case where the resonance type silencer is not disposed. This is caused by a phenomenon where two modes of a bonding mode and an anti-bonding mode are separated due to a strong interaction in a case where the resonance type silencer is disposed in the sound field space of the ventilation sleeve where resonance is to occur.

As a result, sound having the first resonant frequency of the ventilation sleeve can be silenced, but two peaks exist newly.

Since other new peaks of transmission-sound-pressure intensity are generated in a case where a resonance type silencer is used as a silencer for the ventilation sleeve as described above, sound cannot be sufficiently silenced.

The silencer 21 and the cavity portion 30 formed in the silencer 21 are formed in the shape of a substantially rectangular parallelepiped in the example shown in FIG. 1, but may be formed in various shapes, such as a cylindrical shape, without being limited thereto. Further, the shape of the opening portion 32 can also be formed in various shapes, such as a rectangular shape, a polygonal shape, a circular shape, and an elliptical shape, without being limited thereto.

Furthermore, in a case where the frequency of first resonance occurring in the tubular member 12 is denoted by $F_0$ and the resonant frequency of the silencer 21 is denoted by $F_1$, it is preferable that "$1.15 \times F_0 < F_1$" is satisfied. In a case where a relationship between the frequency $F_0$ of first resonance, which occurs in the tubular member 12, and the resonant frequency $F_1$ of the silencer 21 satisfies the above-mentioned range, the transmission-sound-pressure intensity at first resonance occurring in the tubular member 12 at the resonant frequency $F_1$ of the silencer 21 becomes 25% or less of the peak value. Accordingly, an interaction between first resonance occurring in the tubular member 12 and the resonance of the silencer is reduced.

In terms of being capable of further reducing an interaction by further reducing the transmission-sound-pressure intensity at first resonance occurring in the tubular member 12 at the resonant frequency $F_1$ of the silencer 21, the frequency $F_0$ of first resonance occurring in the tubular member 12 and the resonant frequency $F_1$ of the silencer 21 preferably satisfy "$1.17 \times F_0 < F_1$", more preferably satisfy "$1.22 \times F_0 < F_1$", and still more preferably satisfy "$1.34 \times F_0 < F_1$". In cases where the above-mentioned conditions are satisfied, the transmission-sound-pressure intensity at first resonance occurring in the tubular member 12 at the resonant frequency $F_1$ of the silencer 21 becomes 20% or less, 15% or less, and 10% or less of the peak value.

Figure 2:
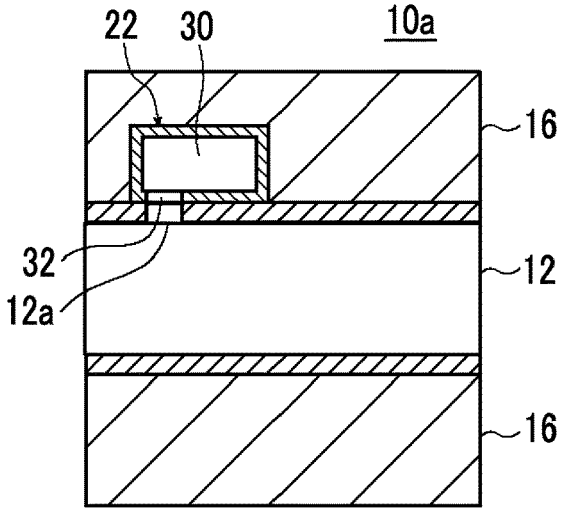
FIG. 2 is a cross-sectional view conceptually showing another example of the silencing system according to the embodiment of the invention.

Further, the cavity portion 30 of the silencer 21 extends in the radial direction and the traveling direction of acoustic waves in the cavity portion 30 is the radial direction in the example shown in FIG. 1, but the cavity portion 30 and the traveling direction are not limited thereto. For example, as shown in FIG. 2, a cavity portion 30 may extend in the axial direction and the traveling direction of acoustic waves in the cavity portion 30 may be the radial direction is the axial direction. In the following description, the silencer 21 shown in FIG. 1 will be referred to as a vertical cylinder type silencer.

Figure 3:
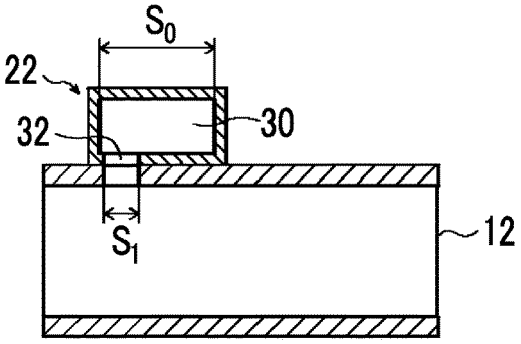
FIG. 3 is a diagram illustrating the area of an opening portion of a silencer and the area of a cavity portion of the silencer.
Figure 4:
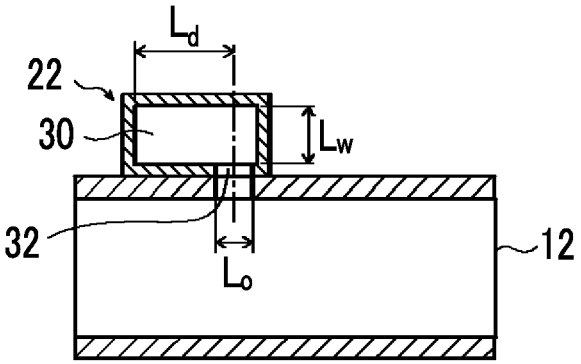
FIG. 4 is a diagram illustrating the depth and the width of the cavity portion of the silencer.

FIG. 2 is a schematic cross-sectional view showing an example of the silencing system according to the preferred embodiment of the invention. Furthermore, FIG. 3 is a diagram illustrating the area $S_0$ of a cavity portion of a silencer of the silencing system and the area $S_1$ of an opening portion of the silencer. FIG. 4 is a diagram illustrating the depth $L_d$ and the width $L_w$ of the cavity portion of the silencer. A wall 16 is not shown in FIGS. 3 and 4. The wall 16 may not be shown even in subsequent drawings.

As shown in FIG. 2, a silencing system 10*a* has configuration where a silencer 22 is disposed on the outer peripheral surface of a cylindrical tubular member 12 provided to penetrate a wall 16 separating two spaces.

The tubular member 12 is, for example, a ventilation port and a ventilation sleeve, such as an air-conditioning duct.

The silencer 22 has the shape of a substantially rectangular parallelepiped, which extends in an axial direction in a cross section parallel to the axial direction and is curved along the outer peripheral surface of the tubular member 12, and includes a cavity portion 30 that is formed therein so as to have the shape of a substantially rectangular parallelepiped extending in the axial direction. Further, the silencer 22 includes an opening portion 32 that is positioned on the surface of the silencer 22 facing the tubular member 12 at one end portion of the silencer 22 in the axial direction and allows the cavity portion 30 and the outside to communicate with each other. That is, the silencer 22 includes an L-shaped space. The opening portion 32 is connected to a peripheral surface-opening portion 12*a* formed on the peripheral surface of the tubular member 12. Since the opening portion 32 is connected to the peripheral surface-opening portion 12*a*, the opening portion 32 is connected to a sound field space of first resonance occurring in the tubular member 12 of the silencing system 10*a*.

Here, since the cavity portion 30 extends in the axial direction in the example shown in FIG. 2, the traveling direction of acoustic waves in the cavity portion 30 is the axial direction (a horizontal direction in FIG. 2). Accordingly, as shown in FIG. 4, the depth $L_d$ of the cavity portion 30 is a length from the center position of the opening portion 32 to the farther end face of the cavity portion 30 in the axial direction.

As with the silencer 21 shown in FIG. 1, the silencer 22 silences sound by converting sound energy into thermal energy with the viscosity of fluid near the wall surface of the silencer 22 and the unevenness (surface roughness) of a wall surface, a sound-absorbing material 24 to be described later that is disposed in the silencer 22, or the like (conversion mechanism).

Even though the silencer 22 is formed in a shape including an L-shaped space as described above, the moving speeds of gas (air) molecules can be increased while sound pressure is maintained in a case where the acoustic waves in the tubular member 12 flow into the silencer 22 as in the case of the configuration of FIG. 1. Since the moving speeds of gas molecules are increased while sound pressure is maintained, the efficiency of the conversion of sound energy into thermal energy performed by the conversion mechanism is increased. For this reason, high soundproof performance can be achieved even though the depth $L_d$ of the cavity portion 30 is smaller than ¼ of the wavelength λ at the resonant frequency of the first resonance of the tubular member 12. Accordingly, high soundproof performance can be obtained while the ventilation performance of the tubular member 12 is maintained through a reduction in the size of the silencer 22. In the following description, the silencer 22 shown in FIG. 2 will be referred to as an L-shaped silencer.

Further, since the silencer 22 is formed in the shape including an L-shaped space, the effective outer diameter of the silencer 22, that is, the outer diameter of the silencing system can be further reduced. Accordingly, higher ventilation performance can be obtained while high soundproof performance is maintained. The effective outer diameter will be described in detail later.

Here, the sound field space of the first resonance of the tubular member 12 of the silencing system 10*a* will be described with reference to FIG. 5.

Figure 5:
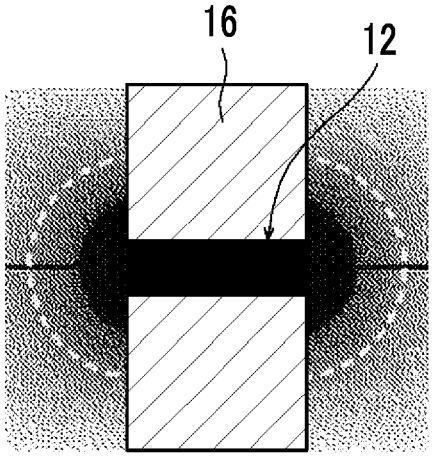
FIG. 5 is a diagram illustrating the sound field space of a tubular member.

FIG. 5 is a diagram showing the distribution of sound pressure in a first resonant mode of the tubular member 12 provided to penetrate the wall 16 separating two spaces that is obtained from a simulation. As found from FIG. 5, the sound field space of the first resonance of the tubular member 12 is a space in the tubular member 12 and within an open-end correction distance. As well known, the antinodes of the standing wave of the sound field protrude outside the tubular member 12 by an open-end correction distance. An open-end correction distance in the case of the cylindrical tubular member 12 is given as about 1.2×tube diameter.

The silencer 22 only has to be disposed at a position where the opening portion 32 is connected to the sound field space of the first resonance of the tubular member 12. Accordingly, the opening portion 32 of the silencer 22 may be disposed outside the open end face of the tubular member 12 as in a silencing system 10*b* shown in FIG. 6. Alternatively, the silencer 22 may be disposed in the tubular member 12 as in a silencing system 10*c* shown in FIG. 7.

Figure 6:
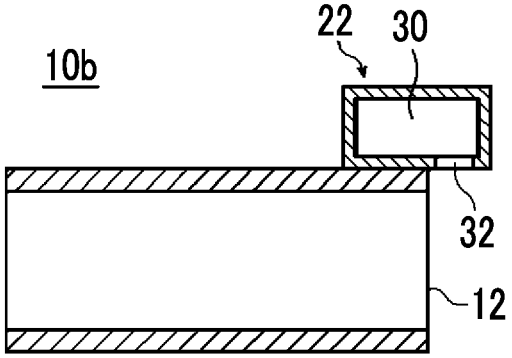
FIG. 6 is a cross-sectional view conceptually showing another example of the silencing system according to the embodiment of the invention.
Figure 7:
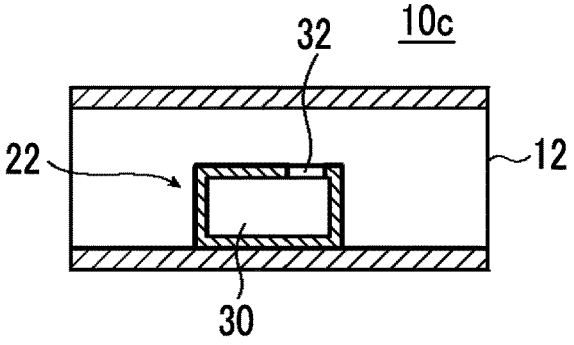
FIG. 7 is a cross-sectional view conceptually showing another example of the silencing system according to the embodiment of the invention.

In the silencing system 10*b* shown in FIG. 6 and the silencing system 10*c* shown in FIG. 7, the silencer 22 is disposed so that the opening portion 32 faces the central axis side of the tubular member 12. The central axis of the tubular member 12 is an axis passing through the centroid of the cross section of the tubular member 12.

Here, the position of the opening portion 32 of the silencer 22 in the axial direction is not limited. A frequency band where sound is more preferably silenced can be controlled depending on the position of the opening portion 32.

For example, in a case where the opening portion 32 of the silencer 22 is disposed at a position where the sound pressure of the acoustic waves having the first resonant frequency is high, that is, in the middle of the tubular member in the axial direction to silence acoustic waves having the first resonant frequency of the tubular member 12, the sound pressure and the moving speeds of the gas molecules can be increased. Accordingly, higher soundproof performance can be achieved.

This will be described in more detail in Example.

Here, in a case where the area of the cavity portion 30 of the silencer 22 is denoted by $S_0$ and the area of the opening portion 32 is denoted by $S_1$, it is preferable that the area $S_1$ of the opening portion 32 is smaller than the area $S_0$ of the cavity portion 30 as shown in FIG. 3. In a case where the area $S_1$ of the opening portion 32 is smaller than the area $S_0$ of the cavity portion 30, the moving speeds of gas (air) molecules can be increased while sound pressure is maintained in a case where the acoustic waves in the tubular member 12 flow into the silencer 22. Accordingly, the efficiency of the conversion of sound energy into thermal energy performed by the conversion mechanism can be increased.

Here, each of the area $S_0$ of the cavity portion 30 and the area $S_1$ of the opening portion 32 is an area on a circumferential surface that passes through the cavity portion 30 or the opening portion 32 and has an axis on the central axis of the tubular member 12.

In a case where the area of the cavity portion 30 varies depending on a position in the radial direction of the tubular member 12, the area $S_0$ of the cavity portion 30 is the average value of areas obtained at the respective positions.

Further, the area $S_1$ of the opening portion 32 is an area that allows the opening to be minimal.

It is preferable that the area $S_1$ of the opening portion 32 is smaller in terms of increasing the moving speeds of gas molecules. However, since it is difficult for acoustic waves to flow into the cavity portion 30 in a case where the area $S_1$ of the opening portion 32 is too small, soundproof performance is lowered. From the above-mentioned standpoint, the area $S_1$ of the opening portion 32 and the area $S_0$ of the cavity portion 30 preferably satisfy "$0.1\%<S_1/S_0<40\%$", more preferably satisfy "$0.3\%<S_1/S_0<35\%$", and still more preferably satisfy "$0.5\%<S_1/S_0<30\%$".

Further, in terms of soundproof performance and ventilation performance, the depth La of the cavity portion 30 of the silencer 22 satisfies "$0.011\times\lambda\leq L_d<0.25\times\lambda$", preferably satisfies "$0.016\times\lambda<L_d<0.25\times\lambda$,", and more preferably satisfies "$0.021\times\lambda<L_d<0.25\times\lambda$".

Furthermore, the width $L_w$ (see FIG. 4) of the cavity portion 30 in a direction orthogonal to the depth direction of the cavity portion 30 in a cross section parallel to the axial direction preferably satisfies "$0.001\times\lambda\times L_w<0.061\times\lambda$", more preferably satisfies "$0.001\times\lambda<L_w<0.051\times\lambda$", and still more preferably satisfies "$0.001\times\lambda<L_w<0.041\times\lambda$". In FIG. 1, the width of the cavity portion 30 is a length in a horizontal direction and coincides with the width $L_w$ of the opening portion 32.

Figure 8:
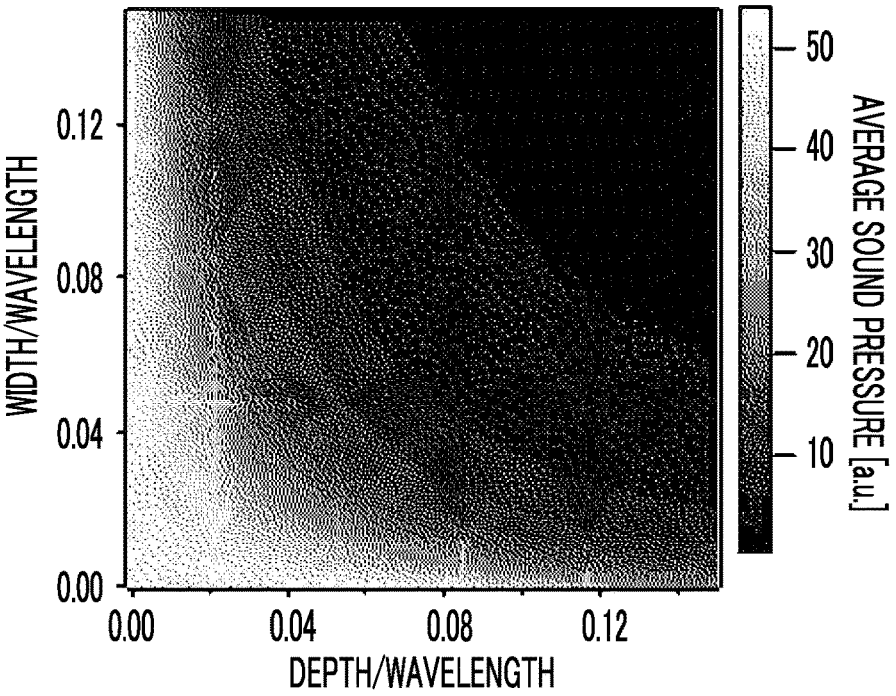
FIG. 8 is a graph showing a relationship among the depth and the width of the cavity portion and average sound pressure.
Figure 9:
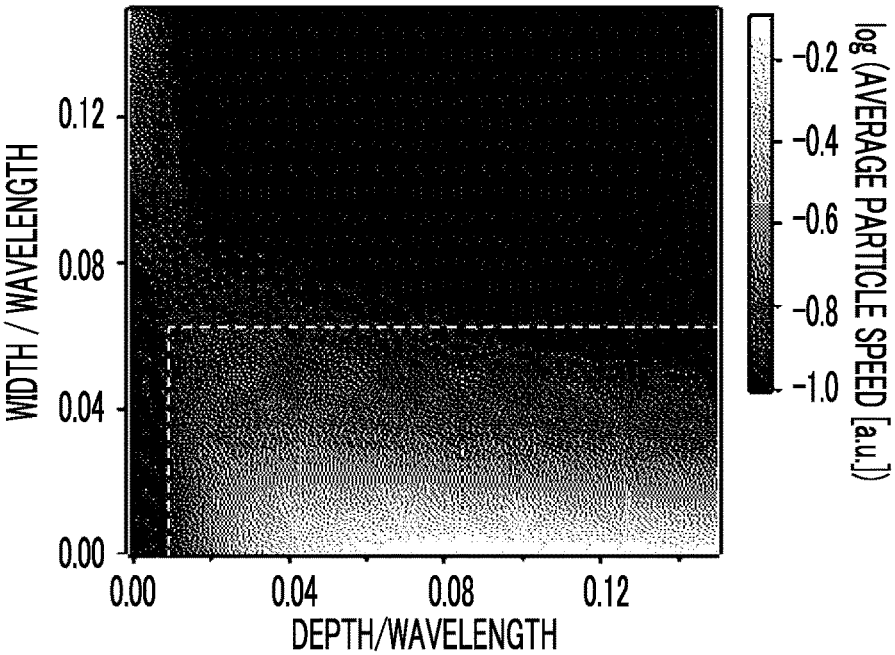
FIG. 9 is a graph showing a relationship among the depth and the width of the cavity portion and average particle speed.
Figure 10:
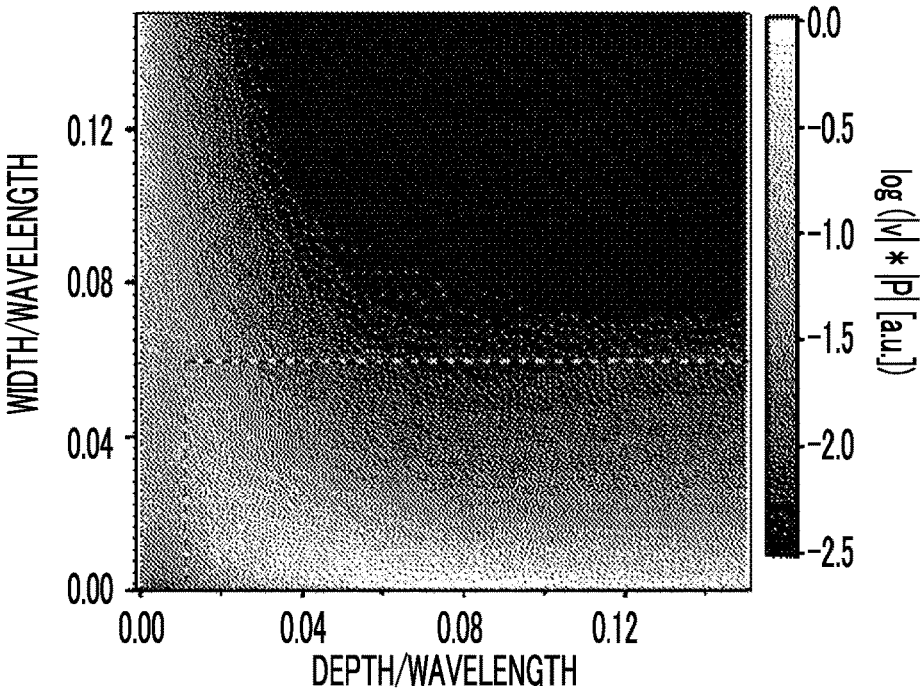
FIG. 10 is a graph showing a relationship among the depth and the width of the cavity portion and v×P.

This will be described with reference to FIGS. 8 to 10 and FIG. 11. FIGS. 8 to 10 show the results of a simulation in a case where the vertical cylinder type silencer shown in FIG. 1 is used, and FIG. 11 shows the results of a simulation in a case where the L-shaped silencer shown in FIG. 2 is used.

Figure 11:
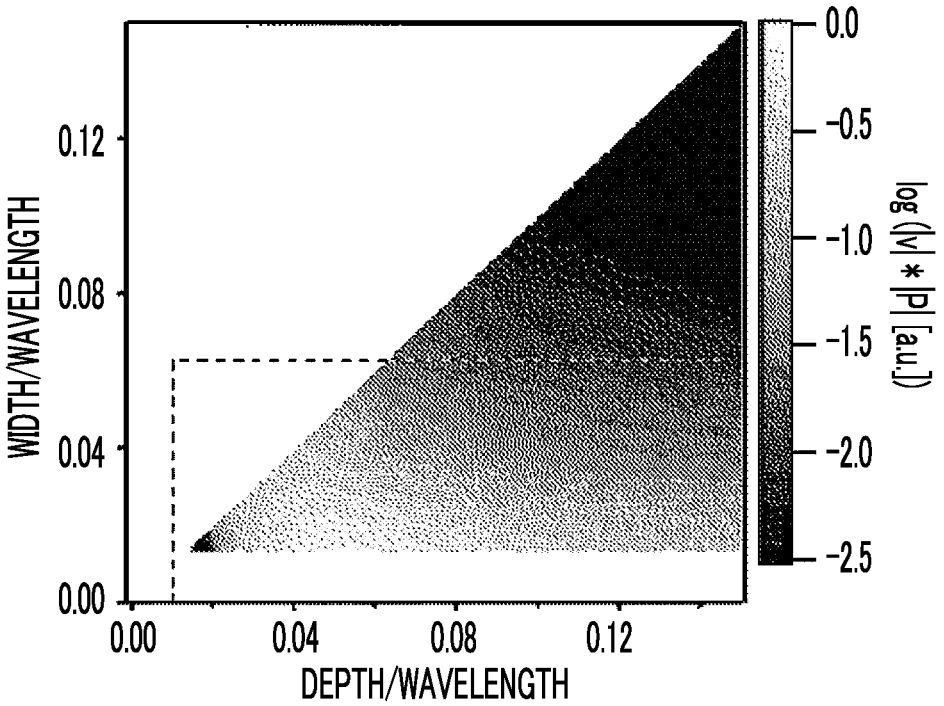
FIG. 11 is a graph showing a relationship among the depth and the width of the cavity portion and v×P.

FIG. 8 is a graph showing a relationship among (the depth $L_d$ of the cavity portion 30/the wavelength λ of an acoustic wave as an object to be silenced), (the width $L_w$ of the cavity portion 30/the wavelength λ of an acoustic wave as an object to be silenced), and average sound pressure P in the cavity portion 30. FIG. 9 is a graph showing a relationship among (the depth $L_d$ of the cavity portion 30/the wavelength λ of an acoustic wave as an object to be silenced), (the width $L_w$ of the cavity portion 30/the wavelength λ of an acoustic wave as an object to be silenced), and the average particle speed v of gas molecules in the cavity portion 30. FIG. 10 is a graph showing a relationship among (the depth $L_d$ of the cavity portion 30/the wavelength λ of an acoustic wave as an object to be silenced), (the width $L_w$ of the cavity portion 30/the wavelength λ of an acoustic wave as an object to be silenced), and the logarithmic value of the product (|v|×|P|) of average sound pressure P and the average particle speed v of gas molecules. (|v|×|P|) is a value proportional to absorption per volume of the cavity portion 30.

log shown in FIGS. 9 to 11 is common logarithm.

The particle speed v and the sound pressure P are obtained using an acoustic module of finite element method-calculation software COMSOL ver5.3 (manufactured by COMSOL Inc.) while the depth $L_d$ of the cavity portion 30 and the width $L_w$ of the cavity portion 30 are changed to various values. In the simulation, the length of the tubular member is set to 300 mm, the diameter of the tubular member is set to 100 mm, and the cavity portion 30 of the silencer 22 is installed in an annular shape on the outer periphery of the tubular member 12. The opening portion 32 is disposed in the shape of a slit in the peripheral direction of the tubular member. The width of the opening portion 32 is equal to the width of the cavity portion 30. The opening portion 32 is disposed in the middle of the tubular member 12 in the axial direction. The lowest resonant frequency of the tubular member 12 is 460 Hz. The frequency of an acoustic wave as an object to be silenced is set to 460 Hz. Further, a sound-absorbing material 24 having a flow resistance of 13000 [Pa·s/m$^2$] is disposed over the entire region in the cavity portion 30.

Figure 12:
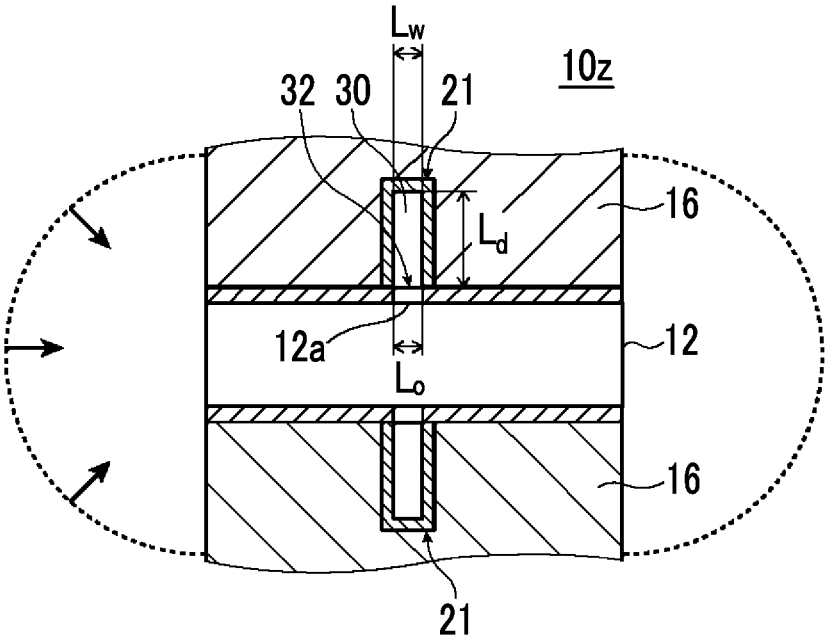
FIG. 12 is a diagram illustrating a method for a simulation.

As shown in FIG. 12, acoustic waves are made to be incident from the hemispherical surface of one space, which is partitioned by a wall, and the amplitude of the acoustic wave, which reaches the hemispherical surface of the other space, per unit volume is obtained. The hemispherical surface is a hemispherical surface that has a center at the center position of the open surface of the tubular member and has a radius of 500 mm. The amplitude of the acoustic wave, which is made to be incident, per unit volume is set to 1.

As shown in FIGS. 8 to 10, it is found that the depth $L_d$ of the cavity portion 30 and the width $L_w$ of the cavity portion 30 have preferred ranges. It is found from FIG. 8 that sound pressure is increased as the width $L_w$ and the depth $L_d$ of the cavity portion 30 are reduced. It is found from FIG. 9 that particle speed is increased in a certain range of the depth $L_d$ as the width $L_w$ of the cavity portion 30 is reduced. It is found from FIG. 10 that the value of (|v|×|P|) proportional to absorption is increased in certain ranges of the width $L_w$ and the depth La of the cavity portion 30.

Likewise, FIG. 11 is a graph showing a relationship among (the depth $L_d$ of the cavity portion 30/the wavelength λ of an acoustic wave as an object to be silenced), (the width $L_w$ of the cavity portion 30/the wavelength λ of an acoustic wave as an object to be silenced), and the logarithmic value of the product (|v|×|P|) of average sound pressure P and the average particle speed v of gas molecules in a case where the L-shaped silencer shown in FIG. 2 is used.

In the simulation, the length of the tubular member is set to 300 mm, the diameter of the tubular member is set to 100 mm, and the cavity portion 30 of the silencer 22 is installed in an annular shape on the outer periphery of the tubular member 12 so that the axial direction of the tubular member 12 is the depth direction of the cavity portion 30. The opening portion 32 is disposed in the shape of a slit in the peripheral direction of the tubular member. The width of the opening portion 32 is set to 10 mm. The opening portion 32 is disposed in the middle of the tubular member 12 in the axial direction. Further, a sound-absorbing material 24 having a flow resistance of 13000 [Pa·s/m$^2$] is disposed in the cavity portion 30.

It is found from FIG. 11 that the value of "|v|×|P|" proportional to absorption is increased in certain ranges of the width $L_w$ and the depth $L_d$ of the cavity portion 30 even in the case of the L-shaped silencer. Further, the preferred ranges are the same as those of the vertical cylinder type silencer.

Further, in a case where a ratio $S_1/S_d$ of the area $S_1$ of the opening portion 32 to the surface area $S_d$ of the inner wall of the cavity portion 30 of the silencer 22 is set to satisfy "$0<S_1/S_d<40\%$" in the silencing system according to the embodiment of the invention, a ratio of the area of a surface on which acoustic waves are to be incident to the surface area of the conversion mechanism, such as the sound-absorbing material 24, is reduced. Accordingly, the moving speeds of gas molecules corresponding to acoustic waves flowing into the conversion mechanism, such as the sound-absorbing material 24, are increased while high sound pressure P is maintained. As a result, soundproof performance can be raised.

It is preferable that the area $S_1$ (a ratio $S_1/S_d$) of the opening portion 32 is smaller in terms of increasing the moving speeds of gas molecules. However, since it is difficult for acoustic waves to flow into the cavity portion 30 in a case where the area $S_1$ of the opening portion 32 is too small, soundproof performance is lowered. From the above-mentioned standpoint, a ratio of the area $S_1$ of the opening portion 32 to the surface area Sa of the inner wall of the cavity portion 30 preferably satisfies "$0.1\%<S_1/S_d<40\%$", more preferably satisfies "$0.3\%<S_1/S_d<35\%$", and still more preferably satisfies "$0.5\%<S_1/S_d<30\%$".

The surface area Sa of the inner wall of the cavity portion 30 is measured with a resolution of 1 mm. That is, in a case where the inner wall of the cavity portion 30 has fine structures, such as unevenness smaller than 1 mm, the surface area $S_d$ may be obtained through the averaging of the fine structures.

With regard to this, a simulation is performed using the L-shaped silencer shown in FIG. 2 as in the case of FIG. 11.

In the simulation, the length of the tubular member is set to 300 mm, the diameter of the tubular member is set to 100 mm, and the cavity portion 30 of the silencer 22 is installed in an annular shape on the outer periphery of the tubular member 12 so that the axial direction of the tubular member 12 is the depth direction of the cavity portion 30. The opening portion 32 is disposed in the shape of a slit in the peripheral direction of the tubular member. The depth $L_d$ of the cavity portion 30 is set to 80 mm, and the width $L_w$ of the cavity portion 30 is set to 10 mm. The opening portion 32 is disposed in the middle of the tubular member 12 in the axial direction. Further, a sound-absorbing material 24 having a flow resistance of 13000 [Pa·s/m$^2$] is disposed in the cavity portion 30.

Figure 13:
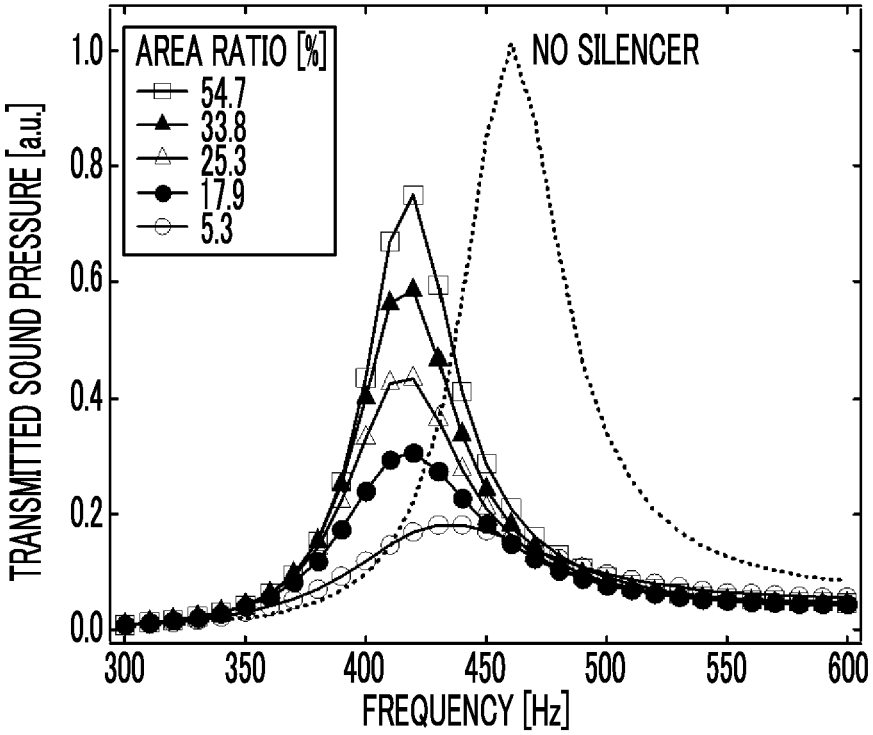
FIG. 13 is a graph showing a relationship between a frequency and transmitted sound pressure.

While the width $L_o$ of the opening portion is changed in the range of 10 mm (1 cm) to 70 mm (7 cm) to change the area ratio $S_1/S_d$ in the range of 5.3% to 54.7%, transmitted sound pressure is calculated. In FIG. 13, an area ratio of 5.3% corresponds to 1 cm, an area ratio of 17.9% corresponds to 3 cm, an area ratio of 25.3% corresponds to 4 cm, an area ratio of 33.8% corresponds to 5 cm, and an area ratio of 54.7% corresponds to 7 cm. With regard to transmitted sound pressure, the peak of transmitted sound pressure, which is obtained in a case where the silencer is not installed, (transmitted sound pressure at the first resonant frequency) is standardized as 1. Since the first resonant frequency in a tubular member on which a silencer is not installed is 460 Hz, transmitted sound pressure at 460 Hz is peak sound pressure.

Figure 14:
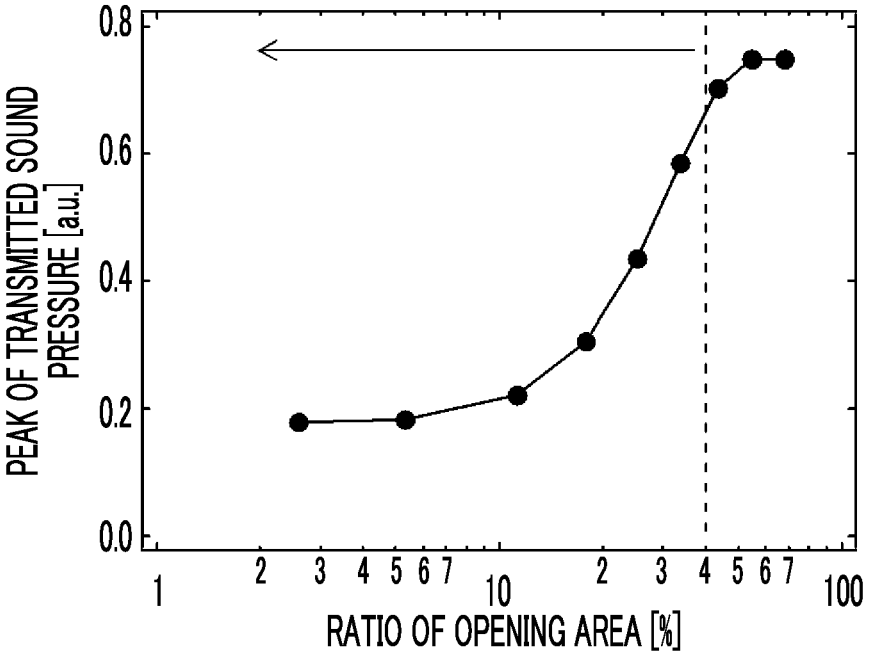
FIG. 14 is a graph showing a relationship between a ratio of an opening area and a peak of transmitted sound pressure.

Results are shown in FIGS. 13 and 14.

FIG. 13 is a graph showing a relationship between a frequency and transmitted sound pressure, and FIG. 14 is a graph showing a relationship between a ratio of the opening area and a peak of transmitted sound pressure.

As found from FIGS. 13 and 14, it is found that transmitted sound pressure at a resonant frequency is lower as the area ratio $S_1/S_d$ of the opening portion is smaller even though the volume of the sound-absorbing material is constant. The reason for why a resonant frequency obtained in a case where the silencer is installed is shifted to a low frequency side from a resonant frequency obtained in a case where there is no silencer is that a volume where acoustic waves can be present is increased.

The conversion mechanism, which converts sound energy into thermal energy, is the viscosity of fluid near the wall surface of the silencer and the unevenness (surface roughness) of the wall surface of the silencer, the sound-absorbing material disposed in the silencer, or the like as described above and it is preferable that the sound-absorbing material is used.

Figure 15:
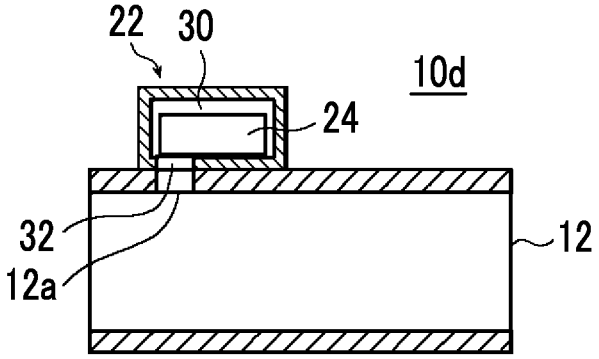
FIG. 15 is a cross-sectional view conceptually showing another example of the silencing system according to the embodiment of the invention.
Figure 16:
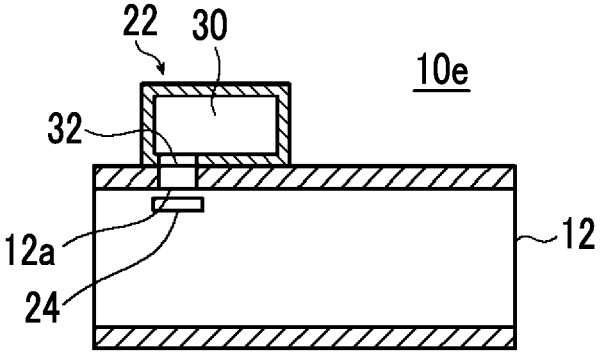
FIG. 16 is a cross-sectional view conceptually showing another example of the silencing system according to the embodiment of the invention.

As in a silencing system 10*d* shown in FIG. 15, a sound-absorbing material 24 only has to be disposed on at least a part of the inside of the cavity portion 30 of the silencer 22. Alternatively, as in a silencing system 10*e* shown in FIG. 16, a sound-absorbing material 24 may be disposed so as to cover at least a part of the opening portion 32 of the silencer 22.

The flow resistance $\sigma_1$ [Pa·s/m$^2$] per unit thickness of the sound-absorbing material 24 preferably satisfies "$(1.25-\log(0.1\times L_d))/0.24<\log(\sigma_1)<5.6$", more preferably satisfies "$(1.32-\log(0.1\times L_d))/0.24<\log(\sigma_1)<5.2$", and more preferably satisfies "$(1.39-\log(0.1\times L_d))/0.24<\log(\sigma_1)<4.7$". In the expressions, the unit of $L_d$ is [mm] and log is common logarithm. The normal incidence sound absorption coefficient of a sound-absorbing material having a thickness of 1 cm is measured and fitting is performed with Mikimodel (J. Acoust. Soc. Jpn., 11(1) pp. 19-24 (1990)) to evaluate the flow resistance of the sound-absorbing material. Alternatively, the flow resistance of the sound-absorbing material may be evaluated according to "ISO 9053".

Further, in a case where a ratio (opening width/cylinder length) of the width of the opening portion to the length of the cavity portion 30 in the depth direction of the cavity portion 30 (hereinafter, referred to as a cylinder length) is denoted by $K_{rate}$ (%), the flow resistance $\sigma_1$ [Pa·s/m$^2$] per unit length of the sound-absorbing material 24 preferably satisfies "$(K_{rate}+165)/62.5<\log\sigma_1<(K_{rate}+319.6)/76.9$" in the case of "$0<K_{rate}\leq 50\%$" and preferably satisfies "$3.45<\log\sigma_1<(K_{rate}+484)/111.1$" in the case of "$50\%<K_{rate}$". Furthermore, the flow resistance $\sigma_1$ [Pa·s/m$^2$] per unit length of the sound-absorbing material 24 more preferably satisfies "$(K_{rate}+175)/62.5<\log\sigma_1<(K_{rate}+315.3)/76.9$" in the case of "$0<K_{rate}50\%$" and more preferably satisfies "$3.6<\log\sigma_1<(K_{rate}+478)/111.1$" in the case of "$50\%<K_{rate}$". Moreover, the flow resistance $\sigma_1$ [Pa·s/m$^2$] per unit length of the sound-absorbing material 24 still more preferably satisfies "$(K_{rate}+182)/62.5<\log\sigma_1<(K_{rate}+311.3)/76.9$" in the case of "$0<K_{rate}\leq 50\%$" and still more preferably satisfies "$3.72<\log\sigma_1<(K_{rate}+472)/111.1$" in the case of "$50\%<K_{rate}$". In the expressions, log is common logarithm.

The results of a simulation performed about a relationship between a ratio $K_{rate}$ of an opening width to a cylinder length and the flow resistance $\sigma_1$ [Pa·s/m$^2$] per unit length of the sound-absorbing material 24 will be described.

Figure 107:
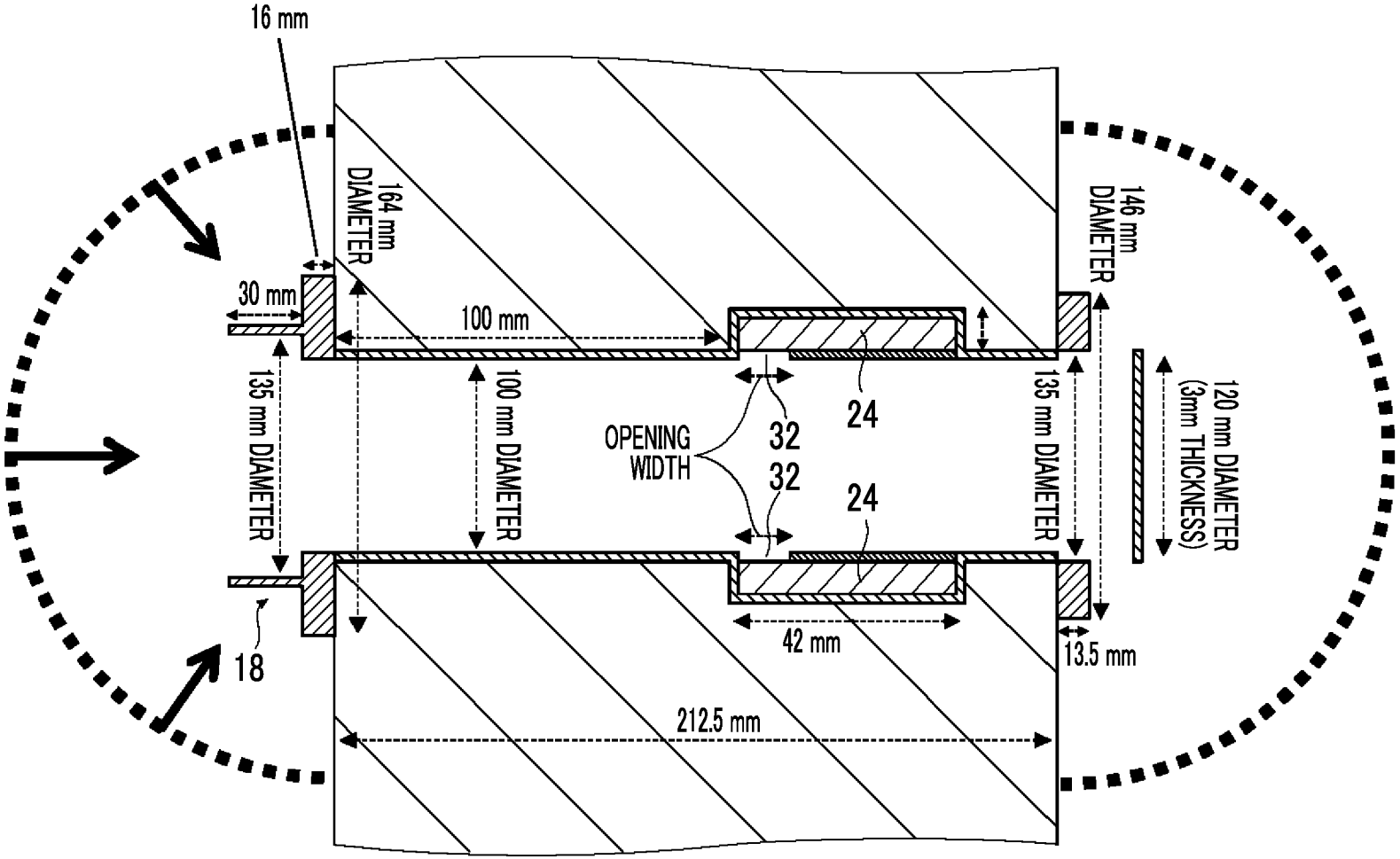
FIG. 107 is a cross-sectional view schematically showing a model of a silencing system used in a simulation.

FIG. 107 is a cross-sectional view schematically showing a model of a silencing system used in the simulation.

As shown in FIG. 107, the thickness of a wall 16 is set to 212.5 mm and the diameter of a tubular member 12 is set to 100 mm. A silencer 22 is disposed at a position away from the incident side (the left side in FIG. 107) of the wall by 100 mm. The silencer 22 is disposed in a tubular shape on the outer periphery of the tubular member 12 so that the axial direction of the tubular member 12 is the depth direction of a cavity portion. The length of the cavity portion 30 of the silencer 22 (cylinder length) is set to 42 mm. The width of the cavity portion 30 is set to 37 mm. The opening portion 32 is disposed in the shape of a slit in the peripheral direction of the tubular member 12. The opening portion 32 is formed on the incident side (the left side in FIG. 107) of the cavity portion in the axial direction. A sound-absorbing material 24 is disposed on the entire region of the cavity portion 30 of the silencer 22.

Further, a louver (cover member) is disposed at an opening portion of the tubular member 12 on which acoustic waves are to be incident, and a register (air volume-adjusting member) is disposed at an opening portion of the tubular member 12 from which acoustic waves are to be emitted.

The louver and the register are modeled using a commercially available louver and a commercial register as references.

Furthermore, a simulation is performed about acoustic waves transmitted through the tubular member while the flow resistance $\sigma_1$ of the sound-absorbing material 24 and the width of the opening portion are changed to various values. A transmission loss is calculated through the simulation from the sound pressure of acoustic waves that are transmitted through the tubular member and are propagated from one space (the left side in FIG. 107) to the other space (the right side in FIG. 107).

Figure 108:
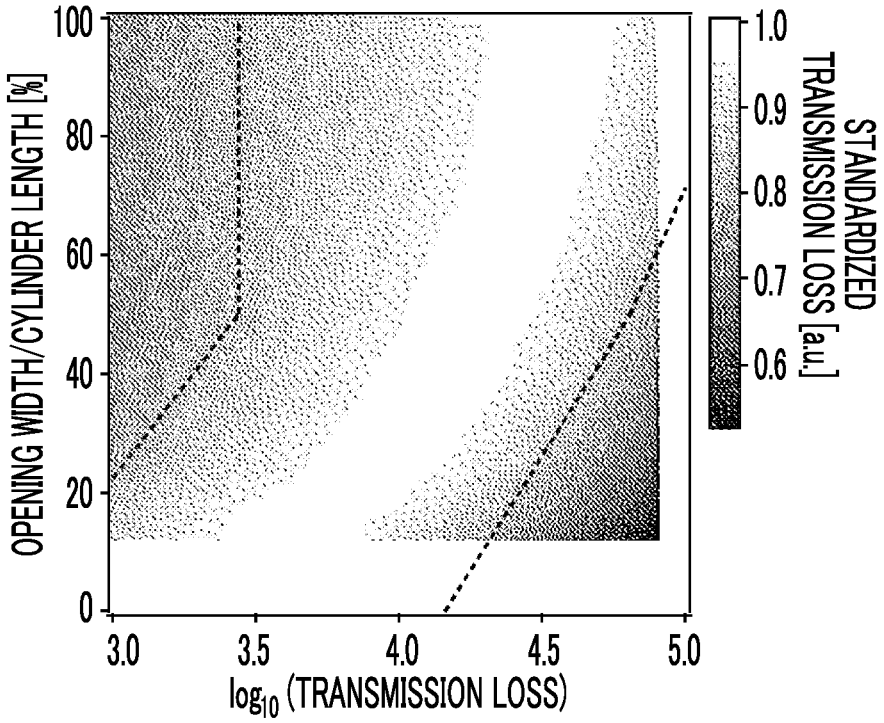
FIG. 108 is a graph showing a relationship among flow resistance, opening width/cylinder length, and a transmission loss.

Results are shown in FIG. 108. FIG. 108 is a graph showing a relationship among flow resistance, opening width/cylinder length, and a standardized transmission loss. The standardized transmission loss is a value that is obtained in a case where a value where a transmission loss is maximum is standardized as 1.

It is found from FIG. 108 that flow resistance has an optimum range depending on opening width/cylinder length. A region inside dotted lines in FIG. 108 is a region where a standardized transmission loss is equal to or larger than about 0.8. In a case where this region is expressed by an expression, this region corresponds to "$(K_{rate}+165)/62.5<\log\sigma_1<(K_{rate}+319.6)/76.9$" in the case of "$0<K_{rate}\leq 50\%$" and corresponds to "$3.45<\log\sigma_1<(K_{rate}+484)/111.1$" in the case of "$50\%<K_{rate}$".

The sound-absorbing material 24 is not particularly limited, and a sound-absorbing material publicly known in the related art can be appropriately used. For example, foamed materials, such as urethane foam, flexible urethane foam, wood, a ceramic particle-sintered material, and phenolic foam, and a material containing fine air; fiber, such as glass wool, rock wool, microfiber (Thinsulate manufactured by 3M Company, and the like), a floor mat, carpet, melt-blown nonwoven fabric, metal nonwoven fabric, polyester nonwoven fabric, metal wool, felt, an insulation board, and glass nonwoven fabric, and nonwoven fabric materials; a wood wool cement board; nanofiber materials, such as silica nanofiber; a gypsum board; and various publicly known sound-absorbing materials can be used.

The thickness of the sound-absorbing material 24 is not limited as long as the sound-absorbing material 24 can be disposed in the cavity portion 30 or near the opening portion.

In terms of sound absorption performance and the like, the thickness of the sound-absorbing material 24 is preferably in the range of 0.01 mm to 500 mm and more preferably in the range of 0.1 mm to 100 mm.

Further, in a case where the sound-absorbing material is to be disposed in the cavity portion of the silencer, it is preferable that the shape of the sound-absorbing material is formed according to the shape of the cavity portion. Since the cavity portion is easily and uniformly filled with the sound-absorbing material in a case where the shape of the sound-absorbing material is formed according to the shape of the cavity portion, cost can be reduced and maintenance can be easily performed.

Figure 17:
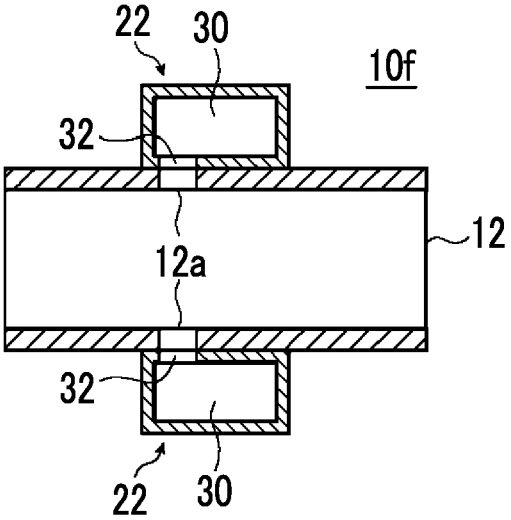
FIG. 17 is a cross-sectional view conceptually showing another example of the silencing system according to the embodiment of the invention.
Figure 18:
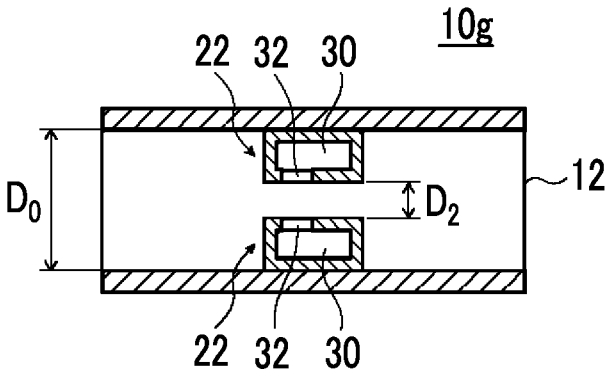
FIG. 18 is a cross-sectional view conceptually showing another example of the silencing system according to the embodiment of the invention.

Furthermore, the silencing system includes one silencer 22 in the example shown in FIG. 2, but is not limited thereto. The silencing system may include two or more silencers 22. For example, as in a silencing system 10*f* shown in FIG. 17, two silencers 22 may be disposed on the outer peripheral surface of a tubular member 12 and may be connected to peripheral surface-opening portions 12*a* formed on the peripheral surface of the tubular member 12. Alternatively, as in a silencing system 10*g* shown in FIG. 18, two silencers 22 may be disposed in a tubular member 12.

In a case where the silencing system includes two or more silencers 22, it is preferable that the two or more silencers 22 are disposed so as to be rotationally symmetric with respect to the central axis of the tubular member 12.

Figure 19:
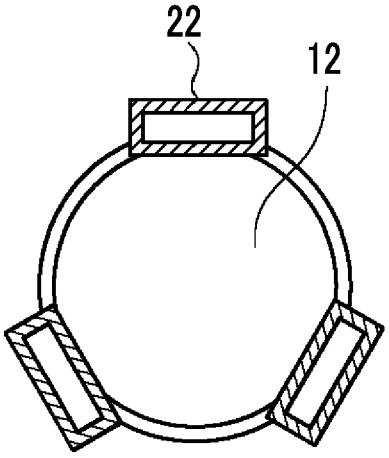
FIG. 19 is a cross-sectional view conceptually showing another example of the silencing system according to the embodiment of the invention.
Figure 20:
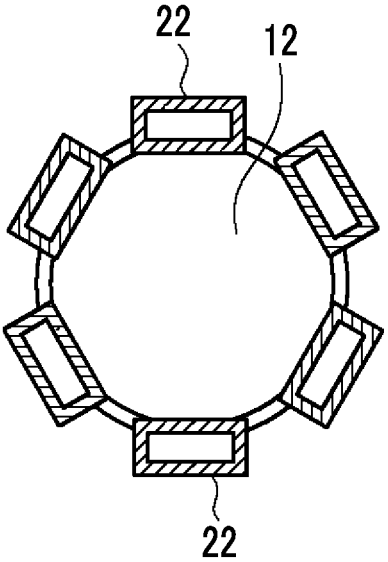
FIG. 20 is a cross-sectional view conceptually showing another example of the silencing system according to the embodiment of the invention.

For example, as shown in FIG. 19, a silencing system may include three silencers 22 and the three silencers 22 may be disposed on the outer peripheral surface of the tubular member 12 at regular intervals in the peripheral direction so as to be rotationally symmetric. Alternatively, as shown in FIG. 20, a silencing system may include six silencers 22 and the six silencers 22 may be disposed on the outer peripheral surface of the tubular member 12 at regular intervals so as to be rotationally symmetric. The number of silencers 22 is not limited, and for example, two silencers 22 may be disposed so as to be rotationally symmetric and four silencers 22 may be disposed so as to be rotationally symmetric.

Even in a case where silencers 22 are to be disposed in the tubular member 12, it is preferable that two or more silencers 22 are disposed so as to be rotationally symmetric.

Figure 21:
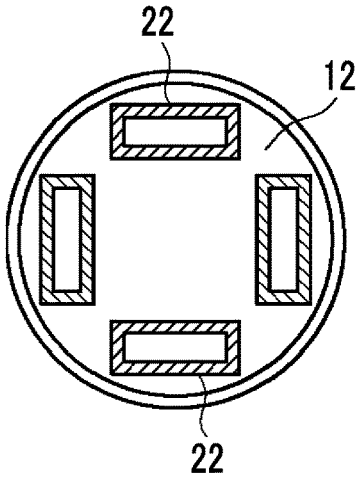
FIG. 21 is a cross-sectional view conceptually showing another example of the silencing system according to the embodiment of the invention.

For example, as shown in FIG. 21, four silencers 22 may be disposed in the tubular member 12 (on the peripheral surface) at regular intervals in the peripheral direction so as to be rotationally symmetric.

Figure 22:
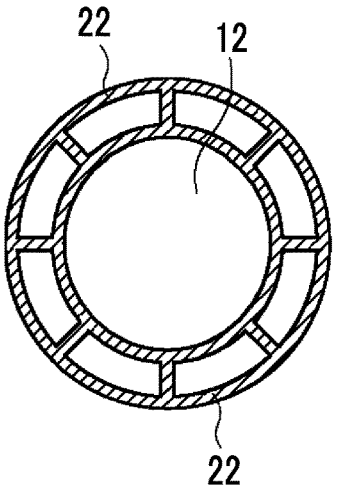
FIG. 22 is a cross-sectional view conceptually showing another example of the silencing system according to the embodiment of the invention.

Further, in a case where a plurality of silencers 22 are to be arranged on the outer peripheral surface of the tubular member 12 in the peripheral direction of the tubular member 12, the plurality of silencers 22 may be connected to each other. For example, as in an example shown in FIG. 22, eight silencers 22 may be connected to each other in the peripheral direction.

Figure 23:
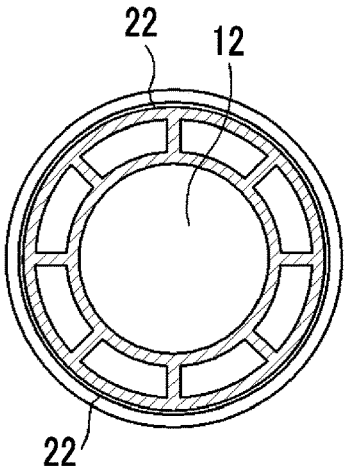
FIG. 23 is a cross-sectional view conceptually showing another example of the silencing system according to the embodiment of the invention.

Even in a case where silencers 22 are to be disposed in the tubular member 12 and the plurality of silencers 22 are to be arranged on the inner peripheral surface of the tubular member 12 in the peripheral direction, the plurality of silencers 22 may be connected to each other. For example, as in an example shown in FIG. 23, eight silencers 22 may be connected to each other in the peripheral direction.

Figure 24:
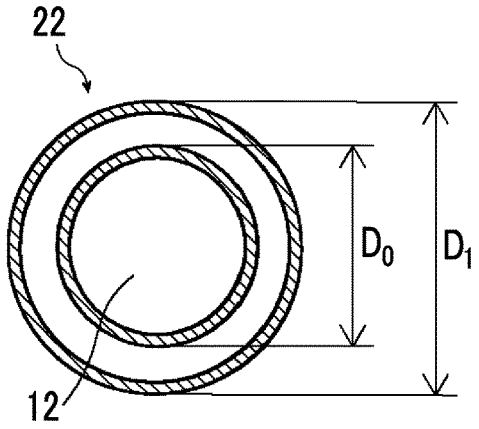
FIG. 24 is a cross-sectional view conceptually showing another example of the silencing system according to the embodiment of the invention.

Furthermore, the silencer 22 has a shape of a substantially rectangular along the outer peripheral surface of the tubular member 12 in the example shown in FIG. 1, but is not limited thereto. The silencer 22 only has to have various three-dimensional shapes including a cavity portion. Alternatively, as shown in FIG. 24, the silencer 22 may have an annular shape along the entire outer peripheral surface of the tubular member 12 in the peripheral direction. In this case, the opening portion 32 is formed in the shape of a slit extending in the peripheral direction of the inner peripheral surface of the tubular member 12.

Figure 25:
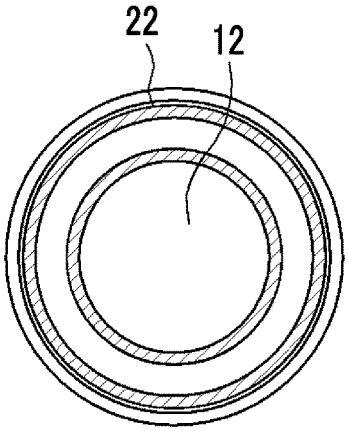
FIG. 25 is a cross-sectional view conceptually showing another example of the silencing system according to the embodiment of the invention.

Even in a case where the silencer 22 is to be disposed in the tubular member 12, the silencer 22 may have an annular shape along the entire outer peripheral surface of the tubular member 12 in the peripheral direction as shown in FIG. 25.

Further, in a case where the silencer 22 is to be disposed on the outer peripheral surface of the tubular member 12, the outer diameter (effective outer diameter) of the silencer 22 obtained in a case where it is assumed that the silencer 22 covers the entire outer peripheral surface of the tubular member 12 in the peripheral direction is denoted by $D_1$, and the outer diameter (effective outer diameter) of the tubular member 12 is denoted by $D_0$ (see FIG. 24), it is preferable that "$D_1<D_0+2\times(0.045\times2+5\text{ mm})$" is satisfied. The units of $D_1$, $D_0$, and 2 of the expression are mm.

Accordingly, high soundproof performance can be achieved while an increase in the size of the silencing system is suppressed.

The effective outer diameter is a circle equivalent diameter. In a case where the cross section of an element does not have a circular shape, the diameter of a circle having an area equal to the cross-sectional area of the element is defined as the effective outer diameter.

Furthermore, in a case where the silencer 22 is to be disposed on the inner peripheral surface of the tubular member 12, the inner diameter of the silencer 22 obtained in a case where it is assumed that the silencer 22 covers the entire inner peripheral surface of the tubular member 12 in the peripheral direction is denoted by $D_2$, and the inner diameter of the tubular member 12 is denoted by $D_0$ (see FIG. 18), it is preferable that "$0.75\times D_0<D_2$" is satisfied.

Accordingly, high soundproof performance can be achieved while ventilation performance is ensured through the suppression of an increase in the size of the silencing system.

Further, the silencing system has configuration where the plurality of silencers 22 are arranged in the peripheral direction of the tubular member 12 in the examples shown in FIGS. 17 to 23, but is not limited thereto. The plurality of silencers 22 may be arranged in the axial direction of the tubular member 12. In other words, the opening portions 32 of the plurality of silencers 22 may be disposed on at least two or more positions in the axial direction of the tubular member 12.

Figure 26:
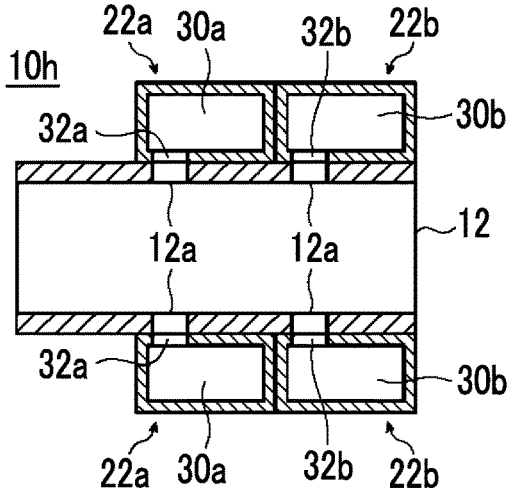
FIG. 26 is a cross-sectional view conceptually showing another example of the silencing system according to the embodiment of the invention.

For example, a silencing system 10*h* shown in FIG. 26 includes silencers 22*a* that are connected to peripheral surface-opening portions 12*a* of a tubular member 12 at the substantially middle portion of the tubular member 12 in an axial direction and silencers 22*b* that are connected to peripheral surface-opening portions 12*a* near one end portion of the tubular member 12.

Further, two silencers are disposed in the peripheral direction so as to be rotationally symmetric in the example shown in FIG. 26. In this way, two or more silencers may be disposed in each of the peripheral direction and the axial direction.

The silencing system has configuration where the two silencers are disposed in the axial direction in the example shown in FIG. 26, but is not limited thereto. Three or more silencers may be disposed in the axial direction.

Furthermore, in a case where a plurality of silencers are to be disposed in the axial direction, it is preferable that silencers of which cavity portions have different depths La at the respective positions of opening portions are disposed.

Figure 27:
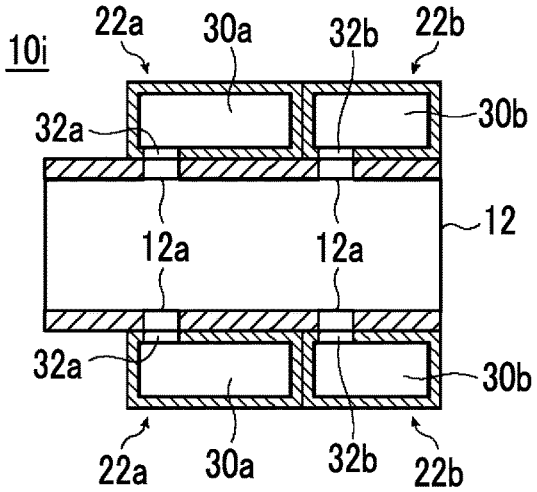
FIG. 27 is a cross-sectional view conceptually showing another example of the silencing system according to the embodiment of the invention.

For example, a silencing system 10*i* shown in FIG. 27 includes silencers 22*a* that are connected to peripheral surface-opening portions 12*a* of a tubular member 12 at the substantially middle portion of the tubular member 12 in an axial direction and silencers 22*b* that are connected to peripheral surface-opening portions 12*a* near one end portion of the tubular member 12. The depth $L_d$ of a cavity portion 30*a* of each silencer 22*a* positioned at the middle portion and the depth $L_d$ of a cavity portion 30*b* of each silencer 22*b* positioned near one end portion are different from each other.

Further, in a case where a plurality of silencers are to be disposed in the axial direction, it is preferable that sound-absorbing materials having different acoustic characteristics are disposed in cavity portions at the respective positions of opening portions.

Figure 28:
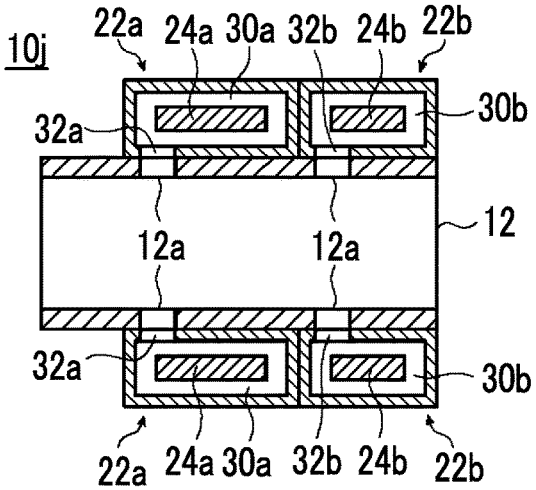
FIG. 28 is a cross-sectional view conceptually showing another example of the silencing system according to the embodiment of the invention.

For example, a silencing system 10*j* shown in FIG. 28 includes silencers 22*a* that are connected to peripheral surface-opening portions 12*a* of a tubular member 12 at the substantially middle portion of the tubular member 12 in an axial direction and silencers 22*b* that are connected to peripheral surface-opening portions 12*a* near one end portion of the tubular member 12. A sound-absorbing material 24*a* is disposed in a cavity portion 30*a* of each silencer 22*a* positioned at the middle portion, and a sound-absorbing material 24*b* is disposed in a cavity portion 30*b* of each silencer 22*b* positioned near one end portion. The sound absorption characteristics of the sound-absorbing material 24*a* and the sound absorption characteristics of the sound-absorbing material 24*b* are different from each other.

Although a detailed description will be made later, a wavelength of which sound can be suitably silenced is changed depending on a position where the silencer (opening portion) is disposed in the axial direction in the silencing system according to the embodiment of the invention. Accordingly, since sound in different wavelength ranges can be silenced in a case where a plurality of silencers are disposed in the axial direction, sound can be silenced in a wider band. Further, in a case where the depth $L_d$ of the cavity portion and the sound absorption characteristics of the sound-absorbing material are adjusted according to a wavelength where sound can be suitably silenced at each of the positions of the opening portions in the axial direction, sound can be more suitably silenced.

Furthermore, the cavity portion 30 of each silencer 21 has a depth $L_d$ from the opening portion in the radial direction in the example shown in FIG. 1 and the cavity portion 30 of the silencer 22 has a depth $L_d$ from the opening portion 32 in the axial direction in the example shown in FIG. 2, but the cavity portion 30 is not limited thereto. The cavity portion 30 may have a depth in the peripheral direction from the opening portion 32.

Figure 29:
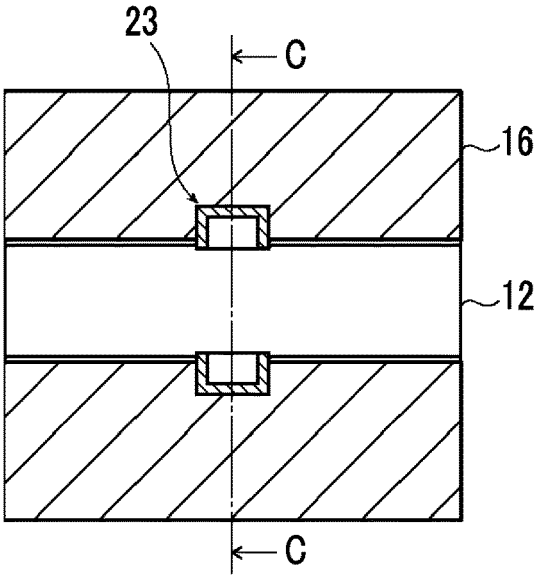
FIG. 29 is a cross-sectional view conceptually showing another example of the silencing system according to the embodiment of the invention.
Figure 30:
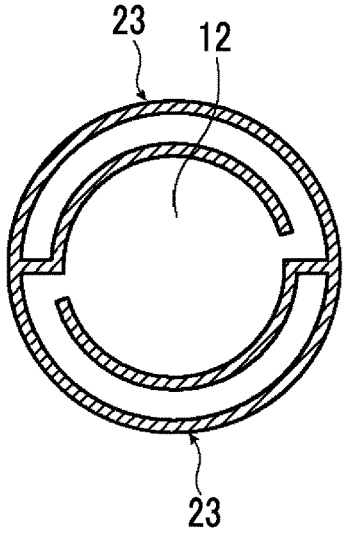
FIG. 30 is a cross-sectional view taken along line C-C of FIG. 29.

FIG. 29 is a cross-sectional view schematically showing another example of the silencing system according to the embodiment of the invention, and FIG. 30 is a cross-sectional view taken along line C-C of FIG. 29.

In a silencing system shown in FIGS. 29 and 30, two silencers 23 are disposed along the outer peripheral surface of a tubular member 12. A cavity portion 30 of each silencer 23 extends from an opening portion 32 in the peripheral direction of the tubular member 12. That is, each silencer 23 has a depth from the opening portion 32 in the peripheral direction.

According to this configuration, the length of the silencer in the axial direction can be shortened.

Figure 31:
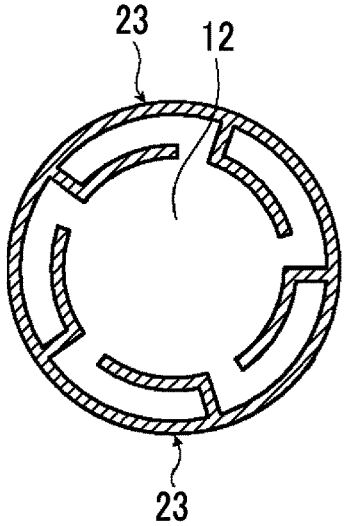
FIG. 31 is a cross-sectional view conceptually showing another example of the silencing system according to the embodiment of the invention.

The silencing system includes the two silencers 23 in the example shown in FIG. 30, but is not limited thereto. The silencing system may include three or more silencers 23. For example, the silencing system may include five silencers 23 as in an example shown in FIG. 31.

Figure 32:
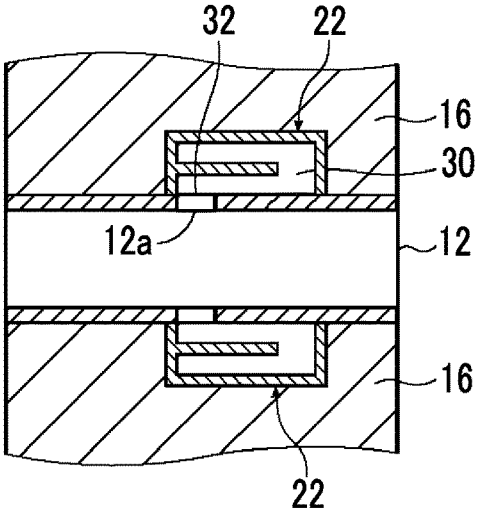
FIG. 32 is a cross-sectional view conceptually showing another example of the silencing system according to the embodiment of the invention.

Further, the depth of the cavity portion 30 of the silencer 22 extends in one direction in the example shown in FIG. 2, but is not limited thereto. For example, the shape of a cavity portion 30 may be a substantially C shape where a depth direction is folded as shown in FIG. 32. After acoustic waves entering the cavity portion 30 shown in FIG. 32 travel from an opening portion 32 to the right side in FIG. 32, the acoustic waves are then folded and travel to the left side in FIG. 32. Since the depth $L_d$ of the cavity portion 30 is a length in the traveling direction of acoustic waves, the depth $L_d$ of the cavity portion 30 shown in FIG. 32 is a length corresponding to a folded shape.

Here, the silencing system according to the embodiment of the invention may have configuration where a part of a silencing device including a silencer and an insertion part is inserted into and disposed on a tubular member (ventilation sleeve).

Figure 33:
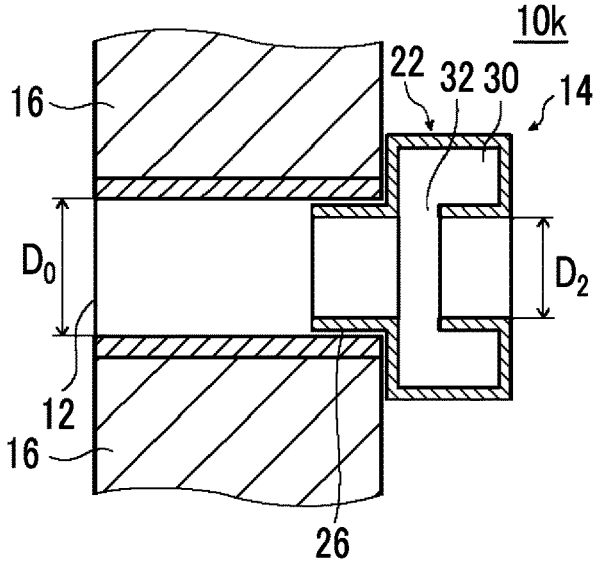
FIG. 33 is a cross-sectional view conceptually showing another example of the silencing system according to the embodiment of the invention.

FIG. 33 is a schematic cross-sectional view showing another example of the silencing system according to the embodiment of the invention.

A silencing system 10*k* shown in FIG. 33 has configuration where a silencing device 14 silencing sound passing through a tubular member 12 is installed on one end face side of the tubular member 12.

The silencing device 14 includes an insertion part 26 and a silencer 22. The insertion part 26 is a cylindrical member of which both ends are open, and the silencer 22 is connected to one end of the insertion part 26. Further, since the outer diameter of the insertion part 26 is smaller than the inner diameter of the tubular member 12, the insertion part 26 can be inserted into the tubular member 12.

The silencer 22 has the same configuration as the above-mentioned L-shaped silencer 22 except that the silencer 22 is disposed on the end face of the insertion part 26. Further, the silencer 22 is disposed along the peripheral surface of the insertion part 26 so as not to close the inner diameter of the insertion part 26. Furthermore, the silencer 22 is disposed so that an opening portion 32 of the silencer 22 faces the central axis of the insertion part 26 (the central axis of the tubular member 12). The central axis of the insertion part 26 is an axis passing through the centroid of the cross section of the insertion part 26.

The end face of the insertion part 26 where the silencer 22 is not disposed is inserted into the tubular member 12, so that the silencing device 14 is installed. Since the effective outer diameter of the silencer 22 is larger than the inner diameter of the tubular member 12, the insertion part 26 is inserted into the tubular member 12 up to a position where the silencer 22 is in contact with the end face of the tubular member 12. Accordingly, the silencer 22 is disposed near the open end face of the tubular member 12. That is, the opening portion 32 of the silencer 22 is disposed in a space within the open-end correction distance of the tubular member 12. Accordingly, the opening portion 32 of the silencer 22 is connected to the sound field space of the first resonance of the tubular member 12.

Since the silencing device including the silencer and the insertion part is adapted to be inserted into and installed on the tubular member in this way, the silencing device can be easily installed on an existing ventilation port, an existing air-conditioning duct, and the like without large-scale work or the like. Accordingly, the replacement of the silencer can be easily performed in a case where the silencer deteriorates or is damaged. Further, since the diameter of a through-hole of a concrete wall does not need to be changed in a case where the silencing device is to be used for a ventilation sleeve of a house or the like, the silencing device is easily mounted. Furthermore, the silencing device is easily additionally installed at the time of renovation.

Further, the wall of a house, such as a mansion, includes, for example, a concrete wall, a gypsum board, a heat insulating material, a decorative plate, wallpaper, and the like, and a ventilation sleeve is provided so as to penetrate these. In a case where the silencing device 14 shown in FIG. 33 is to be installed on the ventilation sleeve of this wall, it is preferable that the wall 16 of the invention corresponds to the concrete wall and the silencer 22 of the silencing device 14 is installed on the outside of the concrete wall and installed between the concrete wall and the decorative plate (see FIG. 70).

In the example shown in FIG. 33, the silencing system 10*k* has configuration where the insertion part 26 of the silencing device 14 is inserted into the tubular member 12, so that the silencing device 14 is disposed on the opening portion of the tubular member 12. However, the silencing system 10*k* is not limited thereto.

Figure 67:
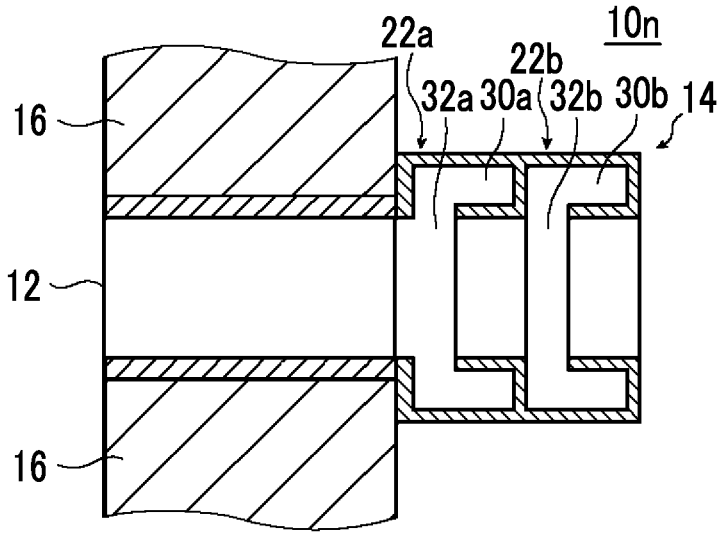
FIG. 67 is a cross-sectional view conceptually showing another example of the silencing system according to the embodiment of the invention.

For example, as in a silencing system 10*n* shown in FIG. 67, a silencing device 14 may be adapted to be attached to the wall 16 by an adhesive or the like without including an insertion part.

Figure 68:
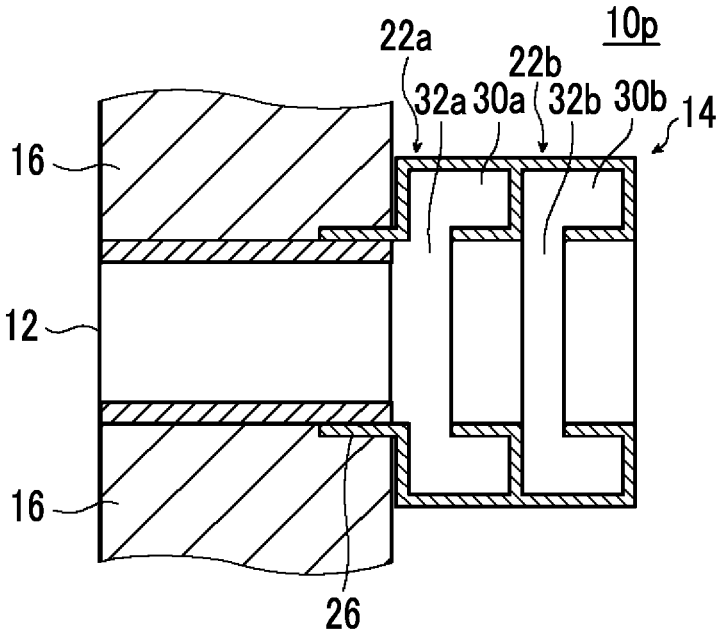
FIG. 68 is a cross-sectional view conceptually showing another example of the silencing system according to the embodiment of the invention.

Alternatively, as in a silencing system 10*p* shown in FIG. 68, the inner diameter of an insertion part 26 of a silencing device 14 may be set to a diameter substantially equal to the outer diameter of a tubular member 12 disposed in the wall 16 and the tubular member 12 may be inserted into the insertion part 26 of the silencing device 14 so that the silencing device 14 is installed. The insertion part 26 is disposed between the tubular member 12 and the wall 16.

Figure 69:
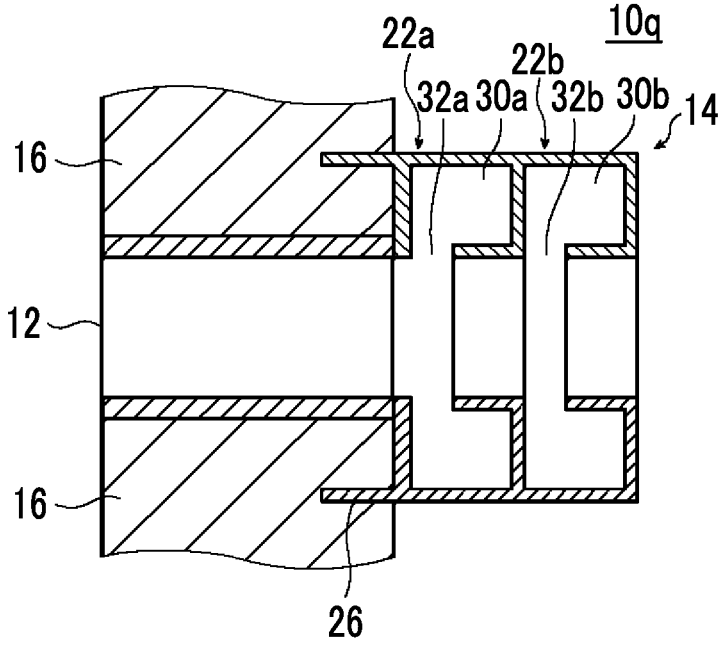
FIG. 69 is a cross-sectional view conceptually showing another example of the silencing system according to the embodiment of the invention.

Alternatively, as in a silencing system 10*q* shown in FIG. 69, the inner diameter of an insertion part 26 of a silencing device 14 may be set to be larger than the outer diameter of a tubular member 12 and the insertion part 26 may be disposed in the wall 16.

According to the configuration shown in FIGS. 67 to 69, a reduction in an opening ratio caused by the insertion of the insertion part 26 into the tubular member 12 can be suppressed. Accordingly, the ventilation performance of the tubular member 12 can be improved.

In a case where the insertion part 26 is disposed in the wall 16 as shown in FIGS. 68 and 69, a groove in which the insertion part 26 is to be disposed may be formed in the wall 16 according to the size and shape of the insertion part 26. Alternatively, in a case where the wall 16 is to be produced, concrete may be poured to produce the wall 16 in a state where the silencing device 14 (and the tubular member 12) is installed in advance.

The silencing device 14 includes the L-shaped silencer 22 in the example shown in FIG. 33, but is not limited thereto. The silencing device 14 may include the vertical cylinder type silencer 21 or may include the silencer 23 having a depth in the peripheral direction.

Even in the silencing device 14 of the silencing system 10*k* shown in FIG. 33, it is preferable that a sound-absorbing material 24 is disposed in the cavity portion 30 or near the opening portion 32.

Further, it is preferable that the silencing device 14 includes a plurality of silencers 22.

In a case where the silencing device 14 includes a plurality of silencers 22, the silencers 22 may be disposed at regular intervals in the peripheral direction so as to be rotationally symmetric.

Figure 34:
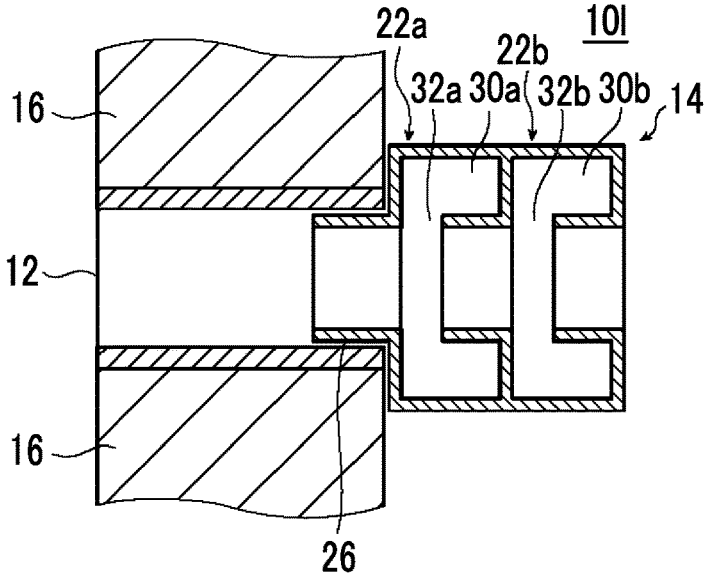
FIG. 34 is a cross-sectional view conceptually showing another example of the silencing system according to the embodiment of the invention.

Alternatively, as in a silencing system 10*l* shown in FIG. 34, a silencing device 14 may include a plurality of silencer 22 in the axial direction and opening portions 32 of the plurality of silencers 22 may be disposed on at least two or more positions in the axial direction.

Furthermore, in a case where a plurality of silencers are to be disposed in the axial direction, it is preferable that silencers having different depths La of the cavity portions at the respective positions of the opening portions are disposed.

Figure 35:
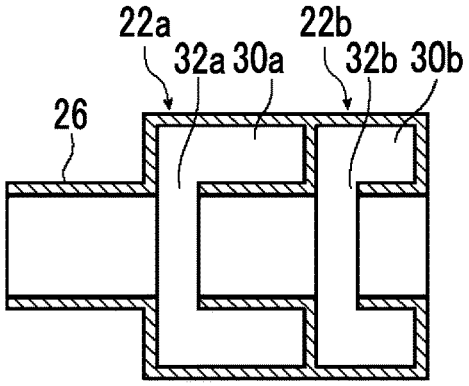
FIG. 35 is a cross-sectional view conceptually showing another example of a silencing device.

For example, a silencing device shown in FIG. 35 includes a silencer 22*a* and a silencer 22*b* in this order from an insertion part 26 in an axial direction. The depth $L_d$ of a cavity portion 30*a* of the silencer 22*a* and the depth $L_d$ of a cavity portion 30*b* of the silencer 22*b* are different from each other.

Further, in a case where a plurality of silencers are to be disposed in the axial direction, it is preferable that sound-absorbing materials having different acoustic characteristics are disposed in the cavity portions at the respective positions of opening portions.

Figure 36:
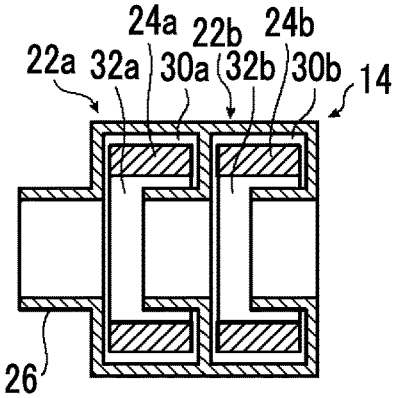
FIG. 36 is a cross-sectional view conceptually showing another example of the silencing device.

For example, a silencing device shown in FIG. 36 includes a silencer 22*a* and a silencer 22*b* in this order from an insertion part 26 in an axial direction. A sound-absorbing material 24*a* is disposed in a cavity portion 30*a* of the silencer 22*a*, and a sound-absorbing material 24*b* is disposed in a cavity portion 30*b* of the silencer 22*b*. The sound absorption characteristics of the sound-absorbing material 24*a* and the sound absorption characteristics of the sound-absorbing material 24*b* are different from each other.

Furthermore, in a case where a sound-absorbing material is to be disposed in a cavity portion of a silencer, a plurality of sound-absorbing materials may be disposed in one cavity portion.

Figure 104:
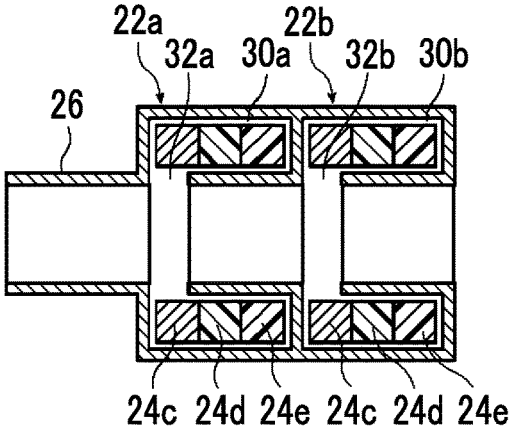
FIG. 104 is a cross-sectional view conceptually showing another example of the silencing device.

A silencing device shown in FIG. 104 includes a silencer 22*a* and a silencer 22*b* in this order from an insertion part 26 in an axial direction. Three sound-absorbing materials 24*c*, 24*d*, and 24*e* are disposed in each of a cavity portion 30*a* and a cavity portion 30*b* of the silencer 22*a*. In each cavity portion, the sound-absorbing materials 24*c* to 24*e* are laminated in the depth direction of the cavity portion.

Since the plurality of sound-absorbing materials are disposed in the cavity portion, the cavity portion is easily filled with the sound-absorbing materials from the opening portion at the time of manufacture and the sound-absorbing materials are easily replaced at the time of maintenance.

Further, it is more preferable that a sound-absorbing material molded according to the shape of the cavity portion is divided into a plurality of pieces.

The plurality of sound-absorbing materials 24*c* to 24*e* disposed in the same cavity portion may be the same kind of sound-absorbing material, or at least one of the sound-absorbing materials may be a different kind of sound-absorbing material, that is, may be a sound-absorbing material having different sound absorption performance (flow resistance, a material, structure, or the like).

In a case where a plurality of different kinds of sound-absorbing materials are disposed in the cavity portion, silencing performed by the silencer is easily controlled to sound absorption performance suitable for the shape of the silencer (cavity portion), sound as an object to be silenced, or the like.

Figure 37:
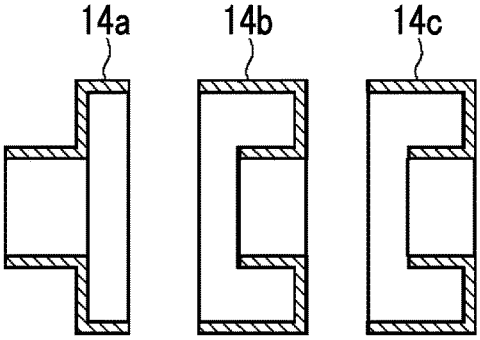
FIG. 37 is a cross-sectional view conceptually showing another example of the silencing device.
Figure 38:
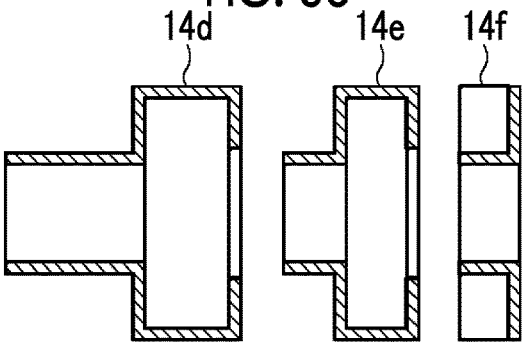
FIG. 38 is a cross-sectional view conceptually showing another example of the silencing device.

For example, a silencing device may be adapted so that silencers can be separated as shown in FIGS. 37 and 38. In a case where the silencers can be separated, silencers of which the shapes, the number, and the like are changed are easily produced. Furthermore, the installation of the sound-absorbing material in the cavity portion and the replacement of the sound-absorbing material are easily performed.

For example, a distance between a concrete wall and a decorative plate varies, and varies depending on a position even in the same mansion or varies depending on a construction company. In a case where a silencing device is designed and produced on each occasion depending on a distance between the concrete wall and the decorative plate, it takes cost. Further, in a case where a silencing device is designed thin to be capable of being applied to all distances, soundproof performance is lowered. Accordingly, since a plurality of separated silencers can be appropriately combined and installed depending on a distance between the concrete wall and the decorative plate in a case where a silencing device is to be installed between the concrete wall and the decorative plate, soundproof performance can be maximized at low cost.

Figure 39:
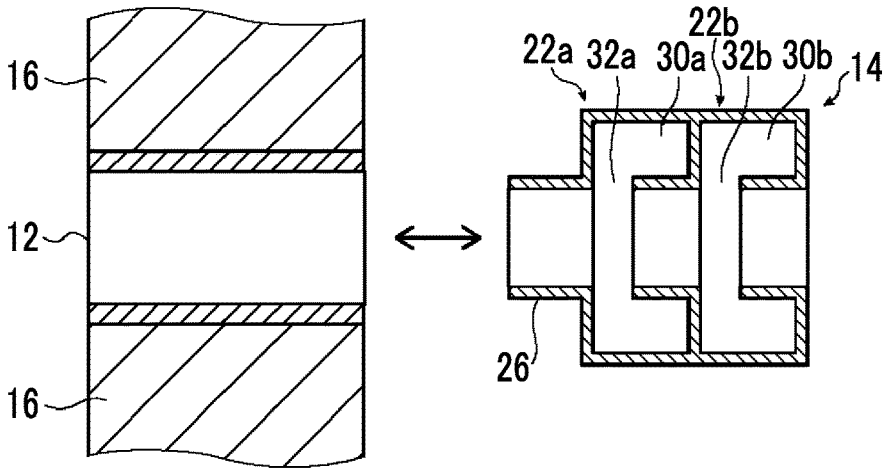
FIG. 39 is a cross-sectional view conceptually showing another example of the silencing system according to the embodiment of the invention.

Furthermore, it is preferable that a silencing device 14 is attachably and detachably installed on the tubular member 12 as shown in FIG. 39. Accordingly, the replacement, reform, and the like of the silencing device 14 can be easily performed.

Further, the silencing device 14 may be installed on any of the interior-side end face and the exterior-side end face of the tubular member 12, and it is preferable that the silencing device 14 is installed on the interior-side end face.

Furthermore, the silencing system may include at least one of a cover member that is installed on one end face of the tubular member or an air volume-adjusting member that is installed on the other end portion thereof. The cover member is a louver or the like that is publicly known in the related art and is installed on a ventilation port, an air-conditioning duct, and the like. Further, the air volume-adjusting member is a register, which is publicly known in the related art, or the like.

Furthermore, the cover member and the air volume-adjusting member may be installed on the end face of the tubular member where the silencing device is installed, or may be installed on the end face of the tubular member where the silencing device is not installed.

Figure 40:
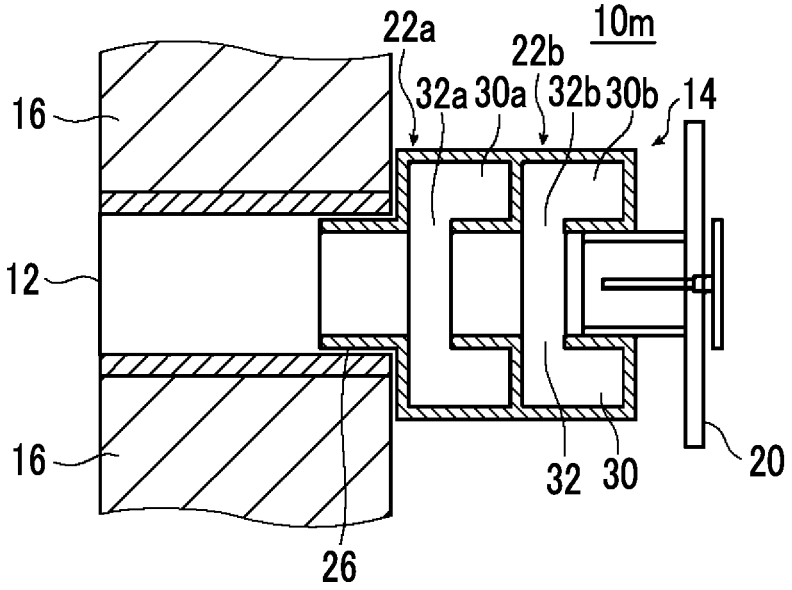
FIG. 40 is a cross-sectional view conceptually showing another example of the silencing system according to the embodiment of the invention.

For example, in a case where an air volume-adjusting member 20 is to be installed on the silencing device 14 as shown in FIG. 40, it is preferable that the air volume-adjusting member 20 is installed so as to cover the entire silencing device 14 as seen in the axial direction. The same applies to a case where the cover member is installed on the silencing device 14.

Figure 70:
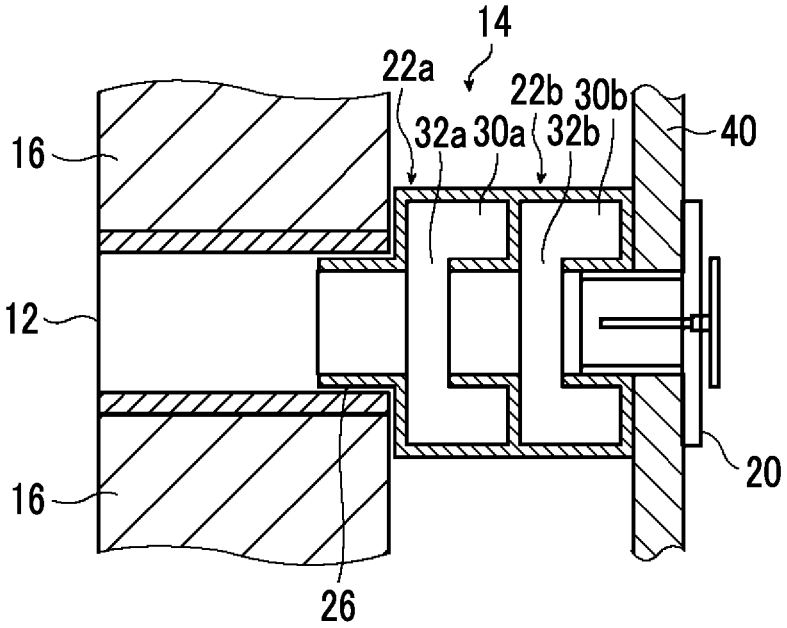
FIG. 70 is a cross-sectional view conceptually showing another example of the silencing system according to the embodiment of the invention.
Figure 71:
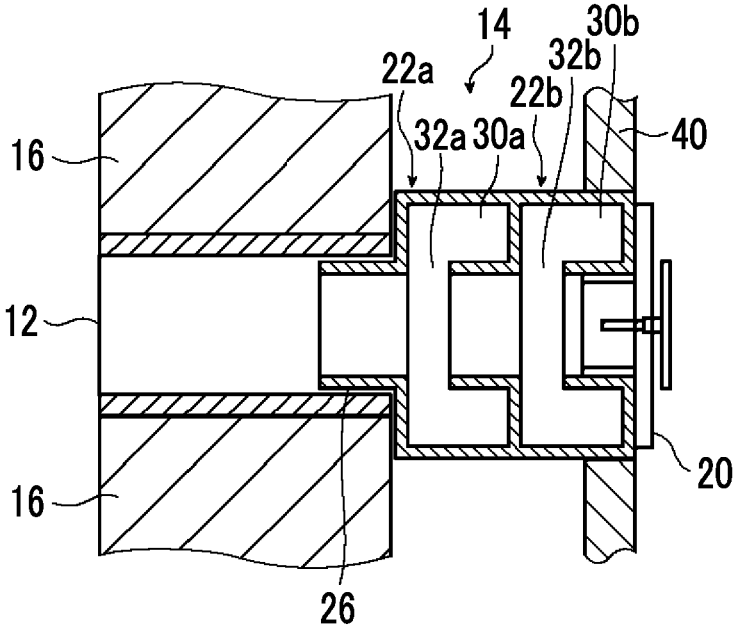
FIG. 71 is a cross-sectional view conceptually showing another example of the silencing system according to the embodiment of the invention.

Here, in a general house, such as a mansion, a concrete wall and a decorative plate are installed so as to be away from each other and a heat insulating material and the like are disposed between the concrete wall and the decorative plate. It is preferable that the silencing device 14 is installed in a space between the concrete wall and the decorative plate. In this case, as shown in FIG. 70, the silencing device 14 may be adapted so that an end face of the silencing device 14 facing the decorative plate 40 is disposed on the wall 16 side of the decorative plate 40. Alternatively, as shown in FIG. 71, the silencing device 14 may be adapted so that an end face of the silencing device 14 facing the decorative plate 40 is disposed so as to be flush with the surface of the decorative plate 40 opposite to the wall 16. That is, the diameter of a through-hole formed in the decorative plate 40 may be set to be substantially equal to the outer diameter of the silencing device 14 and the silencing device 14 may be inserted into the through-hole of the decorative plate 40. The silencing device 14 is adapted in the example shown in FIG. 71 so that the end face of the silencing device 14 facing the decorative plate 40 and the surface of the decorative plate 40 opposite to the wall 16 are disposed so as to be flush with each other, but is not limited thereto. A part of the silencing device 14 may be present on a plane where the decorative plate 40 is positioned.

In a case where the silencing device 14 is adapted to be inserted into the through-hole of the decorative plate 40, the installation, replacement, and the like of the silencing device are easy.

The silencing performance of the silencer 22 is higher as the size of the silencer 22 of the silencing device 14 is larger.

Figure 72:
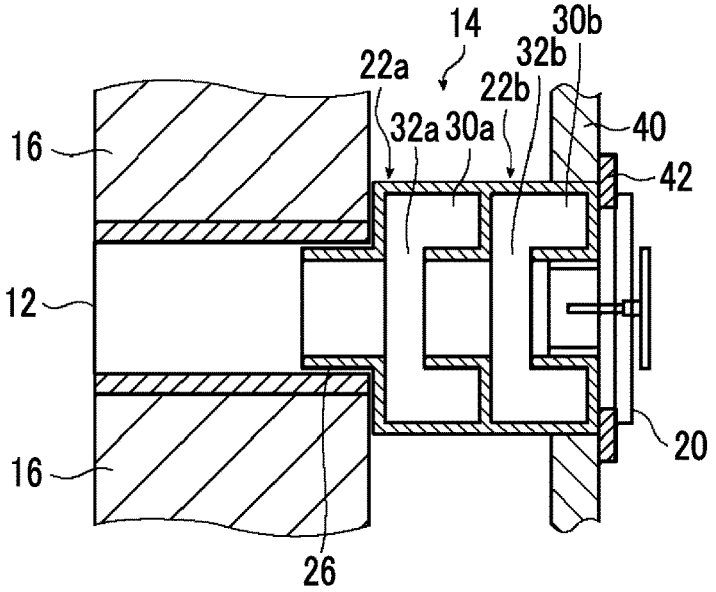
FIG. 72 is a cross-sectional view conceptually showing another example of the silencing system according to the embodiment of the invention.
Figure 73:
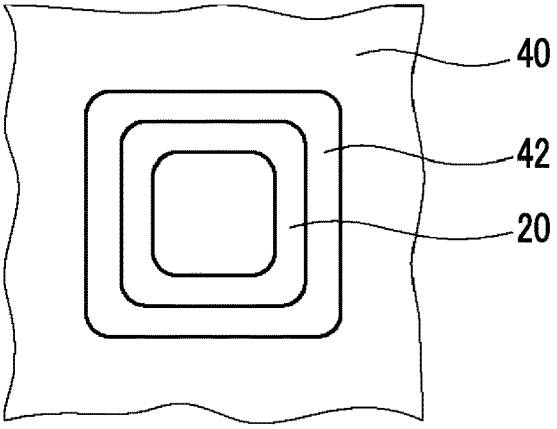
FIG. 73 is a front view of FIG. 72 seen from an air volume-adjusting member side.

Here, in a case where the silencing device 14 is adapted so that the end face of the silencing device 14 facing the decorative plate 40 is disposed so as to be flush with the surface of the decorative plate 40 opposite to the wall 16 as shown in FIG. 71, there is a concern that the through-hole (a boundary between the silencing device 14 and the decorative plate 40) formed in the decorative plate 40 may be visually recognized from the interior even though the air volume-adjusting member 20, such as a register, is installed on the decorative plate 40 side in a case where the size of the silencer 22 is large. Therefore, it is preferable that a boundary cover 42 is installed between the air volume-adjusting member 20 and the decorative plate 40 and the silencing device 14 as shown in FIG. 72. Accordingly, since the through-hole of the decorative plate 40 is hidden by the boundary cover 42 as shown in FIG. 73 as seen from the indoor side (the air volume-adjusting member 20 side), design can be enhanced.

The silencing device 14 and the boundary cover 42 are formed of separate members in the example shown in FIG. 72, but the silencing device 14 and the boundary cover 42 may be integrally formed. That is, the silencing device 14 may be provided with a flange.

Figure 74:
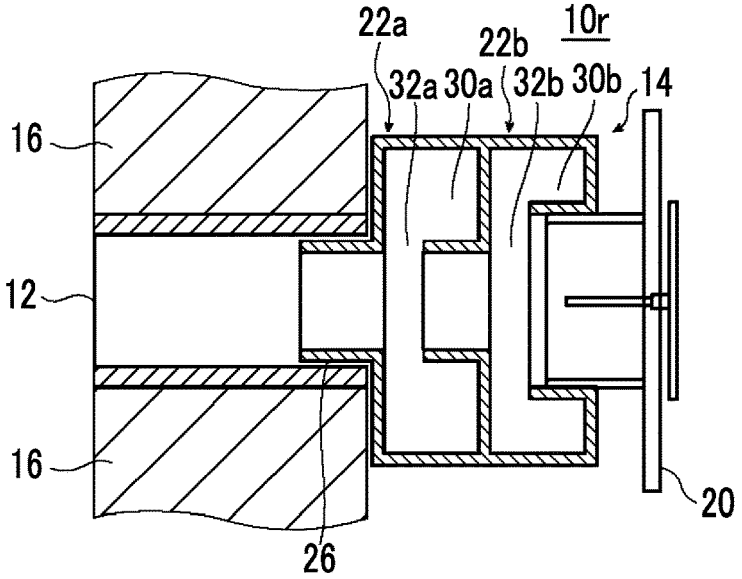
FIG. 74 is a cross-sectional view conceptually showing another example of the silencing system according to the embodiment of the invention.

Further, the inner diameter of the silencing device 14 is constant at a diameter substantially equal to the diameter of the tubular member 12 in the examples shown in FIG. 70 and the like, but is not limited thereto. As in a silencing system **10*r* shown in FIG. 74, the inner diameter of a silencer 22 may be set to be larger than the inner diameter of an insertion part 26, that is, larger than the inner diameter of a tubular member 12**.

In a case where the inner diameter of the silencer 22 is set to be larger than the inner diameter of the tubular member 12, a large air volume-adjusting member 20 for a tubular member having a diameter larger than the diameter of the tubular member 12 can be used. In a case where the large air volume-adjusting member 20 is used, the through-hole of the decorative plate 40 is hidden by the air volume-adjusting member 20. Accordingly, design can be enhanced.

Figure 75:
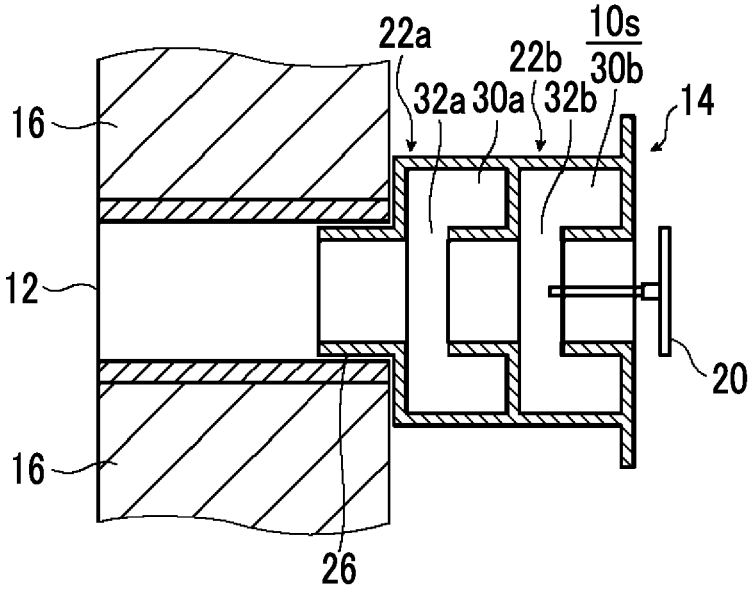
FIG. 75 is a cross-sectional view conceptually showing another example of the silencing system according to the embodiment of the invention.

Furthermore, a silencing device 14 and an air volume-adjusting member 20 may be integrated with each other as in a silencing system **10*s* shown in FIG. 75**.

As shown in FIG. 71 and the like, the air volume-adjusting member 20, such as a commercially available register, includes an insertion portion and is installed through the insertion of the insertion portion into the silencing device 14. However, since the length of the insertion portion of the commercially available register is set to about 5 cm for the ensurence of stiffness and sealability at the time of connection, there is a concern that the design of the silencing device 14 may be limited. In contrast, in terms of an increase in the degree of freedom in the design of the silencing device 14 and the simplification of construction, it is preferable that the silencing device 14 and the air volume-adjusting member 20 are integrated with each other as shown in FIG. 75.

In a case where the silencing system includes the cover member and the air volume-adjusting member, first resonance occurring in the tubular member is the first resonance of the tubular member of the silencing system that includes the cover member, the air volume-adjusting member, and the silencing device. Accordingly, the depth $L_d$ of the cavity portion of the silencer is shorter than ¼ of the wavelength λ of an acoustic wave at the resonant frequency of the first resonance of the tubular member of the silencing system that includes the cover member, the air volume-adjusting member, and the silencing device.

Further, in the examples shown in FIG. 70 and the like, the silencing device 14 is disposed so that the central axis of the silencing device 14 coincides with the central axis of the tubular member 12, that is, the silencing device 14 is formed in a shape rotationally symmetric with respect to the central axis of the tubular member 12. However, the silencing device 14 is not limited thereto.

Figure 105:
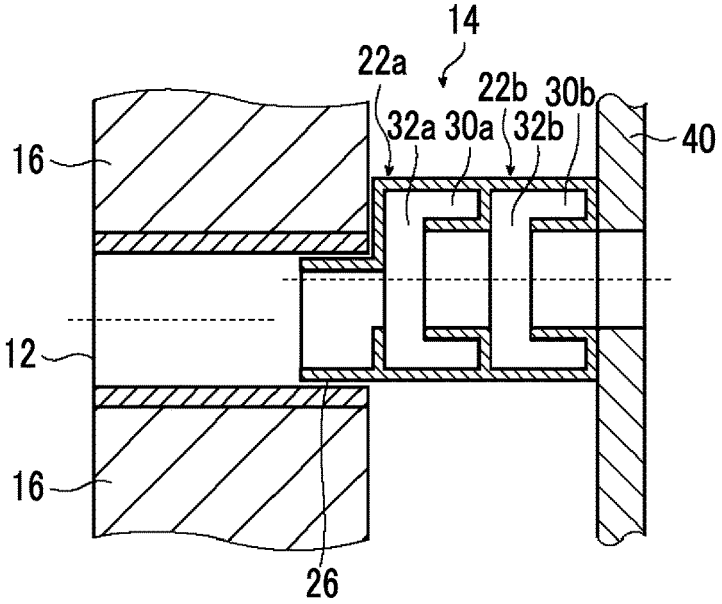
FIG. 105 is a cross-sectional view conceptually showing another example of the silencing system according to the embodiment of the invention.
Figure 106:
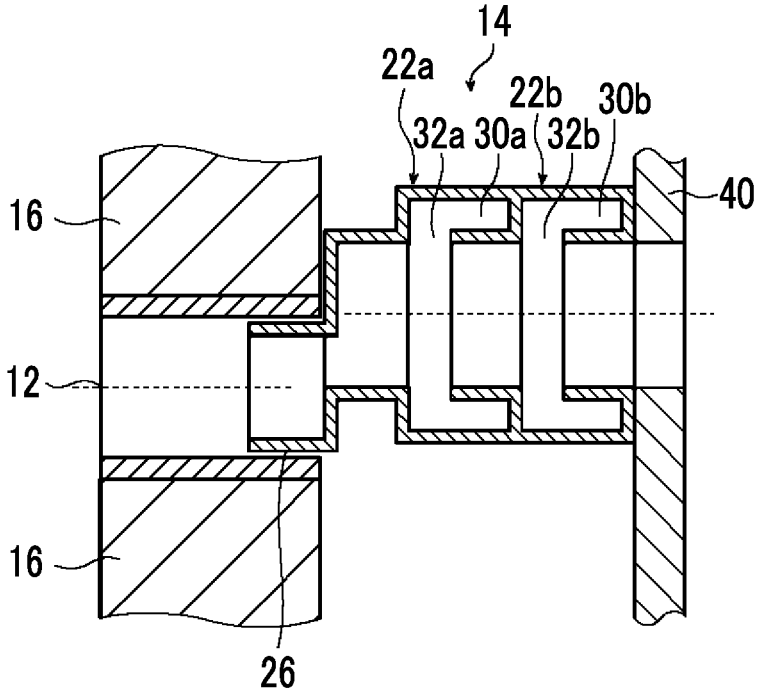
FIG. 106 is a cross-sectional view conceptually showing another example of the silencing system according to the embodiment of the invention.

As in a silencing system shown in FIG. 105 and a silencing system shown in FIG. 106, a silencing device 14 may be disposed so that the central axis of the silencing device 14 is shifted from the central axis of a tubular member 12 in a direction perpendicular to the central axis.

Configuration where the central axis of the silencing device 14 and the central axis of the tubular member 12 coincide with each other is preferable in terms of ventilation performance. On the other hand, in a case where the central axis of the silencing device 14 and the central axis of the tubular member 12 are shifted from each other, the reflection of sound is increased. For this reason, in terms of the improvement of soundproof performance, it is preferable that the central axis of the silencing device 14 and the central axis of the tubular member 12 are shifted from each other. Particularly, this is effective in a frequency region where straightness is high.

Here, the thickness of a wall for a house, that is, the total thickness of a concrete wall and a decorative plate including a space between the concrete wall and the decorative plate (hereinafter, referred to as the total thickness of the wall and the decorative plate) is in the range of about 175 mm to 400 mm. Accordingly, the length of a ventilation sleeve (annular shape member) to be used for a house is in the range of 175 mm to 400 mm. The first resonant frequency of resonance occurring in a ventilation sleeve having a length in this range is in the range of about 355 Hz to 710 Hz.

Considering the soundproofing of a ventilation sleeve to be used for a wall for a house, the total thickness of the concrete wall and the decorative plate, that is, the length of the ventilation sleeve is in the range of 175 mm to 400 mm. Accordingly, considering a case where the wavelength of the first resonance of the ventilation sleeve is shortest (k is 497 mm in a case where the length of the ventilation sleeve is 175 mm), in terms of obtaining sufficient soundproof performance, the width $L_w$ of the cavity portion is preferably 5.5 mm or more, more preferably 15 mm or more, and still more preferably 25 mm or more.

The total thickness of the wall for a house (the total thickness of a concrete wall and a decorative plate) is up to 400 mm and the thickness of the concrete wall is at least 100 mm. Accordingly, in terms of the fact that the cavity portion can be disposed in a space between the concrete wall and the decorative plate of a house, the width $L_w$ of the cavity portion is preferably 300 mm or less. In terms of general-purpose properties in addition to this, the width $L_w$ of the cavity portion is more preferably 200 mm or less and still more preferably 150 mm or less.

Likewise, considering a case where the wavelength of the first resonance of the ventilation sleeve is shortest (k is 497 mm in a case where the length of the ventilation sleeve is 175 mm), in terms of obtaining sufficient soundproof performance, the depth $L_d$ of the cavity portion is preferably 25.3 mm or more, more preferably 27.8 mm or more, and still more preferably 30.3 mm or more.

Meanwhile, the silencer is disposed between the columns of a house in a radial direction. A distance between the columns of a house is up to about 450 mm, and the length of the ventilation sleeve is at least about 100 mm. Accordingly, in terms of the fact that the cavity portion can be disposed in a space between the columns of a house, the depth $L_d$ of the cavity portion is preferably 175 mm or less (=(450 mm-100 mm)/2), more preferably 130 mm or less, and still more preferably 100 mm or less.

Further, in a case where a sound-absorbing material is to be disposed in a part of the cavity portion 30 of the silencer 22, it is preferable that the sound-absorbing material is disposed so as to cover the opening portion 32 or so as to narrow the opening portion 32. That is, it is preferable that the sound-absorbing material is disposed in the cavity portion 30 at a position close to the opening portion 32. Further, it is preferable that the sound-absorbing material is disposed at a position away from the end face of the cavity portion 30 far from the opening portion 32 in a depth direction.

A difference in soundproof performance, which is caused by a difference in the position of the sound-absorbing material in the cavity portion 30, is examined through the following simulation.

Figure 91:
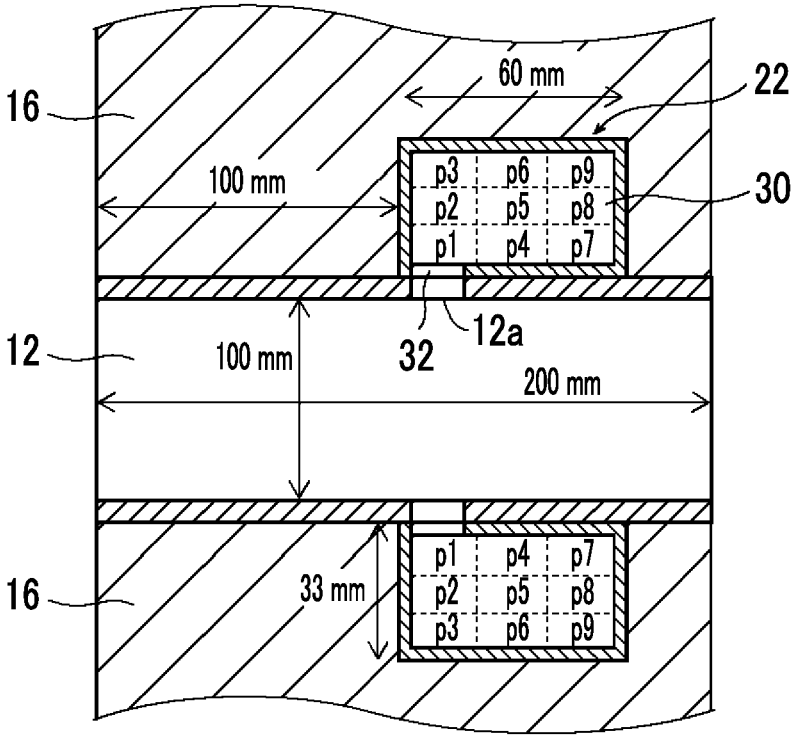
FIG. 91 is a schematic diagram illustrating a simulation model.

FIG. 91 is a schematic diagram illustrating a simulation model.

As shown in FIG. 91, the length of a tubular member is set to 200 mm and the diameter of the tubular member is set to 100 mm in a simulation. A silencer 22 is installed in a tubular shape on the outer periphery of the tubular member 12. A distance between the silencer 22 and the end face of the tubular member 12 on which acoustic waves are to be incident in an axial direction is set to 100 mm. An opening portion 32 of the silencer 22 is disposed in the shape of a slit on the peripheral direction of the tubular member. The width of the opening portion 32 is set to 15 mm. The length of a cavity portion 30 in the axial direction is set to 60 mm, and the width of the cavity portion 30 in a direction perpendicular to the axial direction is set to 33 mm.

A simulation is performed using a model where the inner region of the cavity portion 30 is divided into nine regions as seen in a certain cross section parallel to the axial direction and a sound-absorbing material 24 having a flow resistance of 13000 [Pa·s/m$^2$] is disposed in each of the nine divided regions p1 to p9 as shown in FIG. 91. p1 denotes a region closest to the opening portion 32, p2 and p3 denote regions farther from the opening portion 32 than the region p1 in the radial direction. Further, p4 and p7 denote regions farther from the opening portion 32 than the region p1 in the axial direction. p5 and p8 denote regions farther from the opening portion 32 than the region p2 in the axial direction. p6 and p9 denote regions farther from the opening portion 32 than the region p3 in the axial direction.

Figure 92:
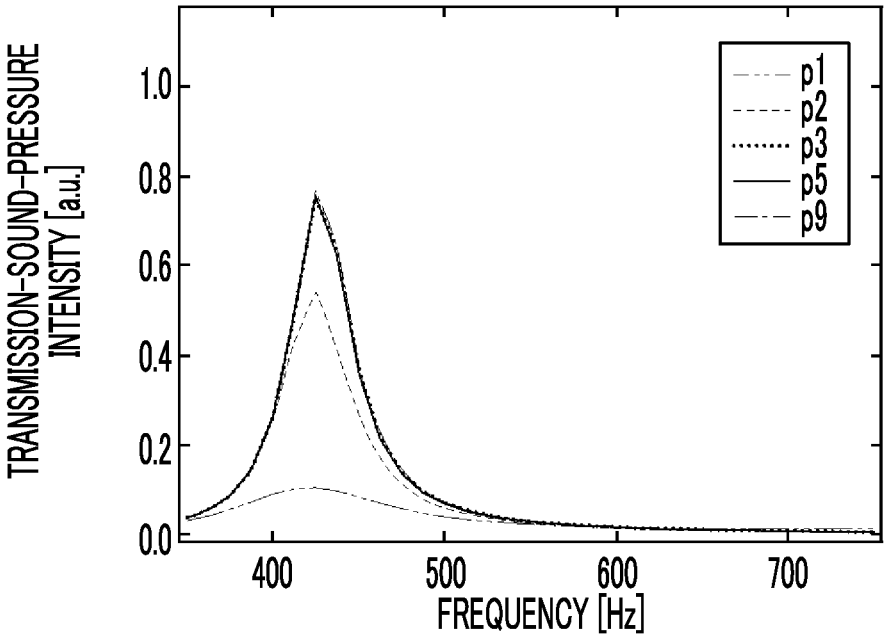
FIG. 92 is a graph showing a relationship between transmission-sound-pressure intensity and a frequency.

FIG. 92 is a graph showing a relationship between transmission-sound-pressure intensity and a frequency in a case where a sound-absorbing material is disposed in each of the regions p1, p2, p3, p5, and p9. With regard to transmission-sound-pressure intensity, the peak of transmitted sound pressure, which is obtained in a case where the silencer is not installed, (transmitted sound pressure at the first resonant frequency) is standardized as 1. Since the first resonant frequency in a tubular member on which a silencer is not installed is 630 Hz, transmitted sound pressure at 630 Hz is peak sound pressure.

Figure 93:
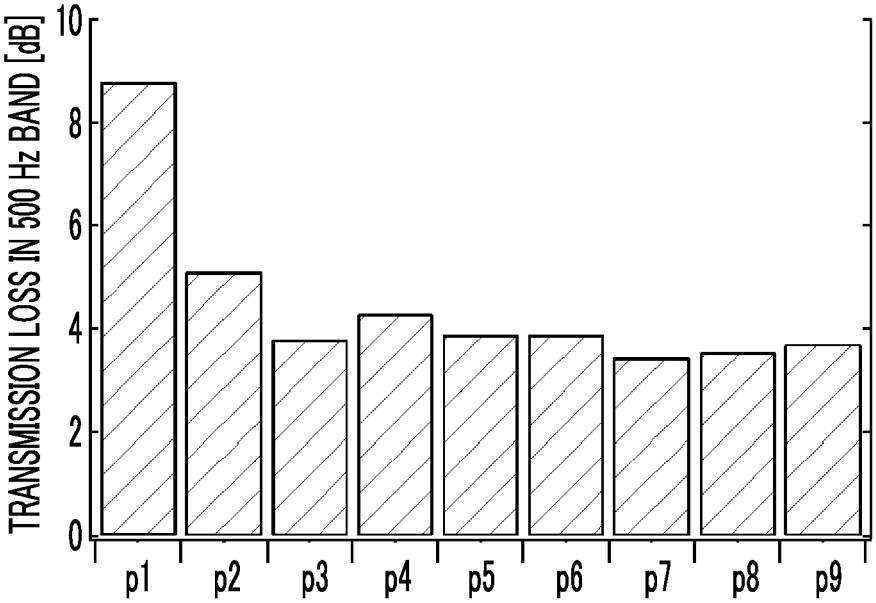
FIG. 93 is a graph showing a transmission loss in a 500 Hz band.

Further, FIG. 93 is a graph showing a transmission loss in a 500 Hz band in a case where a sound-absorbing material is disposed in each of the regions p1 to p9. A transmission loss in a 500 Hz band is an average value of transmission losses obtained at a frequency in the range of 354 Hz to 707 Hz.

As shown in FIGS. 92 and 93, it is found that transmission-sound-pressure intensity is lowest, a transmission loss in a 500 Hz band is highest, and soundproof performance is highest in the case of configuration where a sound-absorbing material is disposed in the region p1 closest to the opening portion 32, that is, configuration where the opening portion 32 is covered. Further, it is found that transmission-sound-pressure intensity is low, a transmission loss in a 500 Hz band is high, and soundproof performance is high as compared to the case of configuration where a sound-absorbing material is disposed in each of the other regions except for the region p1 in the case of configuration where a sound-absorbing material is disposed in each of the regions p2 and p4 close to the opening portion 32.

Figure 94:
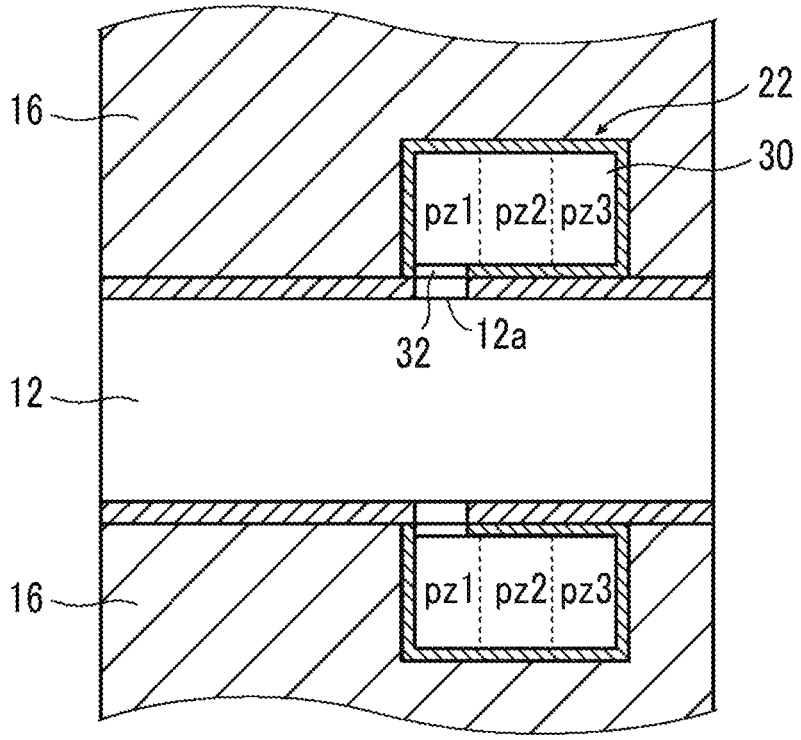
FIG. 94 is a schematic diagram illustrating a simulation model.

Next, a simulation is performed using a model where the inner region of the cavity portion 30 is divided into three regions in the axial direction as seen in a certain cross section parallel to the axial direction and a sound-absorbing material 24 having a flow resistance of 13000 [Pa·s/m$^2$] is disposed in each of the three divided regions pz1 to pz3 as shown in FIG. 94. pz1 denotes a region closest to the opening portion 32, and pz2 and pz3 denote regions farther from the opening portion 32 than the region pz1 in the axial direction.

Figure 95:
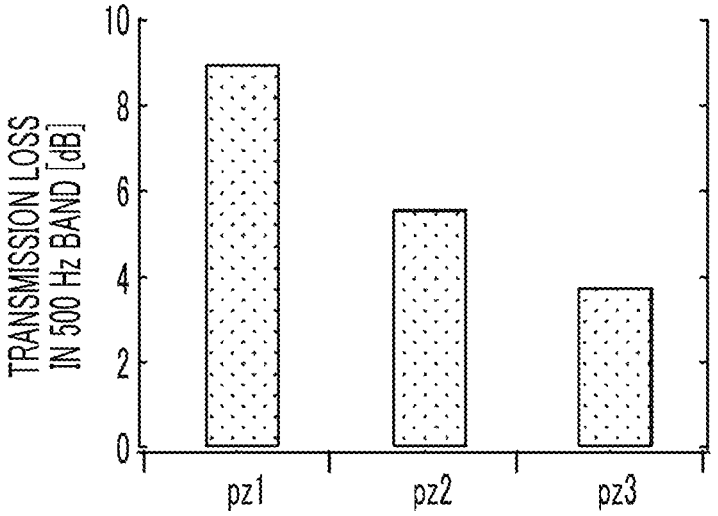
FIG. 95 is a graph showing a transmission loss in a 500 Hz band.

FIG. 95 is a graph showing a transmission loss in a 500 Hz band in a case where the sound-absorbing material is disposed in each of the regions pz1 to pz3.

Figure 96:
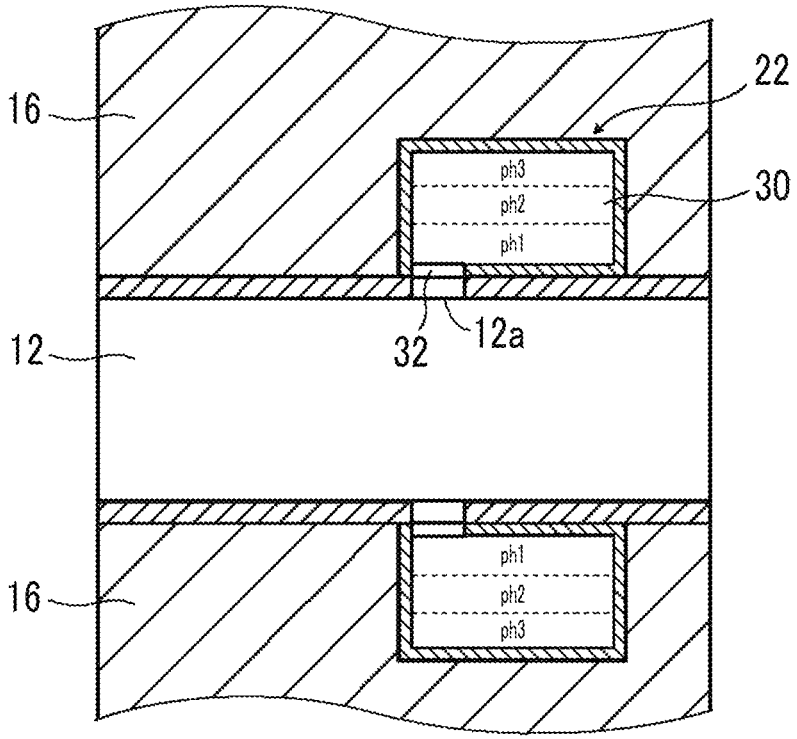
FIG. 96 is a schematic diagram illustrating a simulation model.

Further, a simulation is performed using a model where the inner region of the cavity portion 30 is divided into three regions in the radial direction as seen in a certain cross section parallel to the axial direction and a sound-absorbing material 24 having a flow resistance of 13000 [Pa·s/m$^2$] is disposed in each of the three divided regions ph1 to ph3 as shown in FIG. 96. ph1 denotes a region closest to the opening portion 32, and ph2 and ph3 denote regions farther from the opening portion 32 than the region ph1 in the radial direction.

Figure 97:
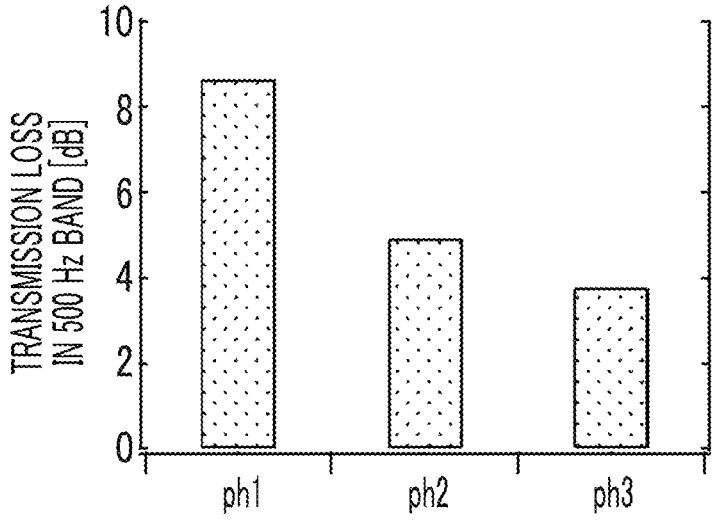
FIG. 97 is a graph showing a transmission loss in a 500 Hz band.

FIG. 97 is a graph showing a transmission loss in a 500 Hz band in a case where the sound-absorbing material is disposed in each of the regions ph1 to ph3.

As shown in FIGS. 95 and 97, it is found that a transmission loss in a 500 Hz band is higher and soundproof performance is higher as a region in which the sound-absorbing material is disposed is closer to the opening portion 32.

Furthermore, the silencer 22 may include a second opening portion 38 that is formed at a position not connected to the sound field space of first resonance occurring in the tubular member 12 and communicates with the cavity portion 30.

Figure 98:
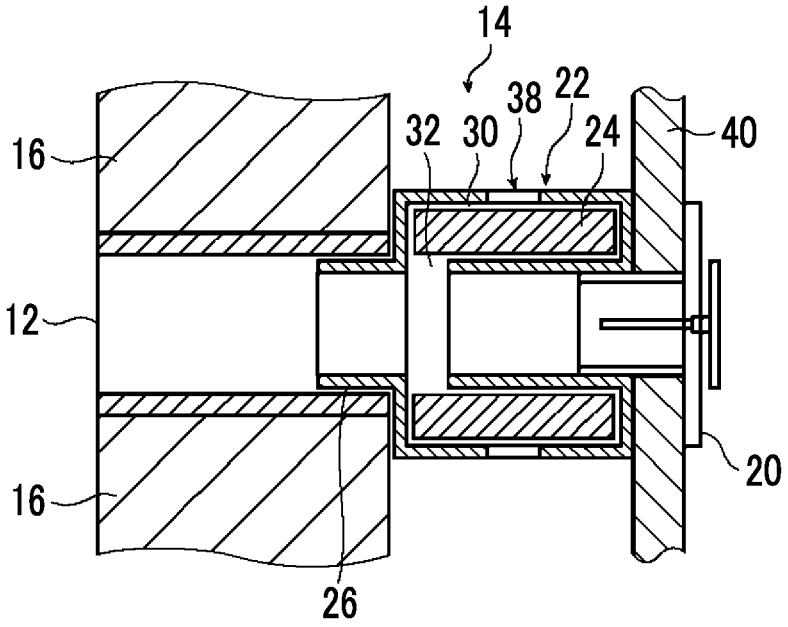
FIG. 98 is a cross-sectional view conceptually showing another example of the silencing system according to the embodiment of the invention.

FIG. 98 is a cross-sectional view conceptually showing another example of the silencing system according to the embodiment of the invention.

In the silencing system shown in FIG. 98, a surface facing the surface including the opening portion 32 among wall surfaces, which form the cavity portion 30 of the silencer 22, includes the second opening portion 38. Since acoustic impedance in the cavity portion 30 is lowered in a case where the silencer 22 includes the second opening portion 38 that is formed at a position not connected to the sound field space of first resonance occurring in the tubular member 12 and communicates with the cavity portion 30, acoustic waves easily enter the cavity portion 30. Accordingly, sound energy is easily converted into thermal energy in the cavity portion 30, so that soundproof performance can be further improved. Further, since acoustic impedance in the cavity portion 30 can be lowered without an increase in the volume of the cavity portion 30, the silencer can be reduced in size.

A position where the second opening portion 38 is formed is not limited as long as the position of the second opening portion 38 is not connected to the sound field space of first resonance occurring in the tubular member 12. Furthermore, the size of the second opening portion 38 is not limited, but it is preferable that the size of the second opening portion 38 is large.

Figure 99:
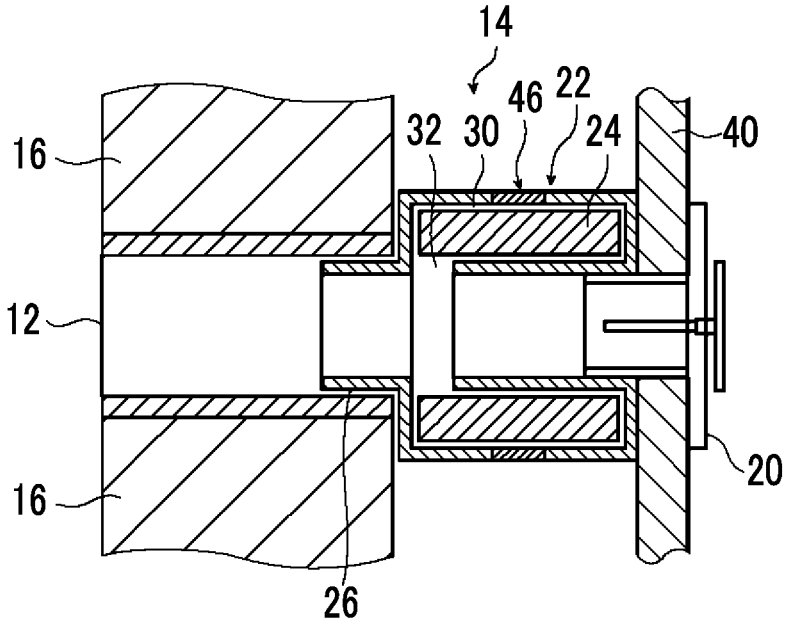
FIG. 99 is a cross-sectional view conceptually showing another example of the silencing system according to the embodiment of the invention.

Here, there is a concern that water or moisture may penetrate a wall or water or moisture may enter the cavity portion from the wall in the case of configuration where the second opening portion 38 is formed at a position not connected to the sound field space of first resonance occurring in the tubular member 12. Accordingly, the second opening portion of the silencing system shown in FIG. 98 may be covered with a membrane member 46 as in an example shown in FIG. 99. The membrane member 46 is a membrane member that allows acoustic waves to easily pass and does not allow water to pass; and a thin resin film, such as Saran Wrap (registered trademark), nonwoven fabric subjected to water-repellent treatment, and the like can be used as the membrane member 46. Accordingly, it is possible to prevent water or moisture from entering while maintaining low acoustic impedance in the cavity portion 30. The same material as the material of a windproof film 44 to be described later can be used as the material of the membrane member 46.

Figure 100:
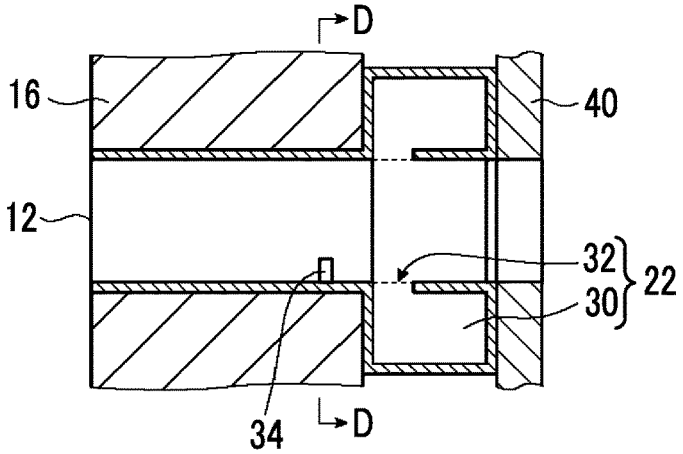
FIG. 100 is a cross-sectional view conceptually showing another example of the silencing system according to the embodiment of the invention.
Figure 101:
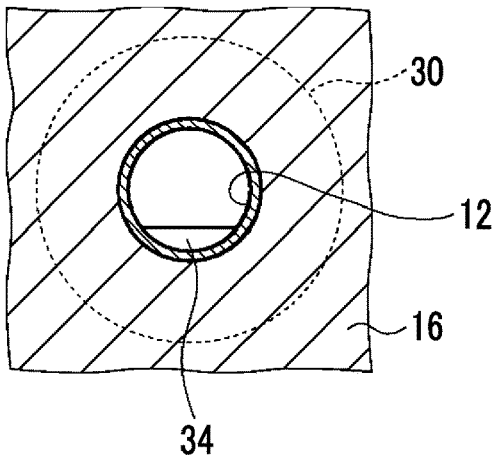
FIG. 101 is a cross-sectional view taken along line D-D of FIG. 100.

Further, an entering prevention plate 34 may be provided in the tubular member 12 as in an example shown in FIGS. 100 and 101.

FIG. 100 is a schematic cross-sectional view showing another example of the silencing system according to the embodiment of the invention. Further, FIG. 101 is a cross-sectional view taken along line D-D of FIG. 100.

As shown in FIGS. 100 and 101, the entering prevention plate 34 is a plate-like member that is provided at a lower portion in the tubular member 12 in a vertical direction so as to stand in the radial direction of the tubular member 12.

Since a ventilation sleeve (tubular member) installed in a wall of a house communicates with the outside, there is a case where rainwater enters the ventilation sleeve through an external louver, an external hood, or the like at the time of strong wind, such as a typhoon. Since the silencer including the cavity portion is connected to the ventilation sleeve in the silencing system according to the embodiment of the invention, there is a concern that rainwater having entered the ventilation sleeve may enter the cavity portion and may be accumulated.

In contrast, since the entering prevention plate 34 is provided in the tubular member 12 as shown in FIGS. 100 and 101, it is possible to prevent rainwater, which has entered the tubular member 12 from the outside, from entering the cavity portion 30 of the silencer 22.

It is preferable that the height of the entering prevention plate 34 in the vertical direction is in the range of 5 mm to 40 mm.

Figure 102:
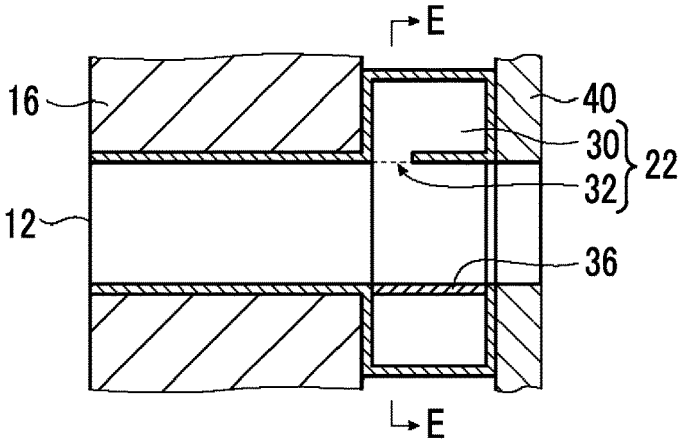
FIG. 102 is a cross-sectional view conceptually showing another example of the silencing system according to the embodiment of the invention.
Figure 103:
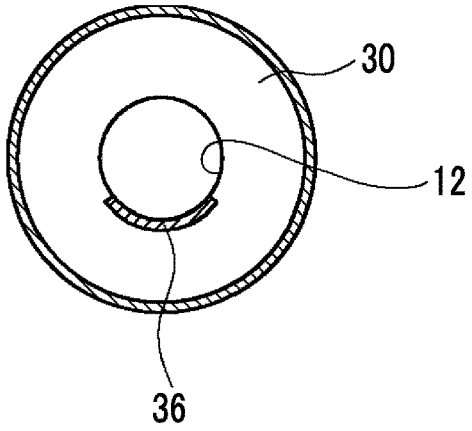
FIG. 103 is a cross-sectional view taken along line E-E of FIG. 102.

Further, configuration where a region below the opening portion 32 of the silencer 22 in the vertical direction is closed by a lid portion 36 as shown in FIGS. 102 and 103 may be used as configuration that prevents rainwater from entering the cavity portion 30 of the silencer 22.

FIG. 102 is a schematic cross-sectional view showing another example of the silencing system according to the embodiment of the invention. FIG. 103 is a cross-sectional view taken along line E-E of FIG. 102.

Since the region below the opening portion 32 of the silencer 22 in the vertical direction is closed by the lid portion 36 as shown in FIGS. 102 and 103, it is possible to prevent rainwater, which has entered the tubular member 12 from the outside, from entering the cavity portion 30 of the silencer 22.

Figure 109:
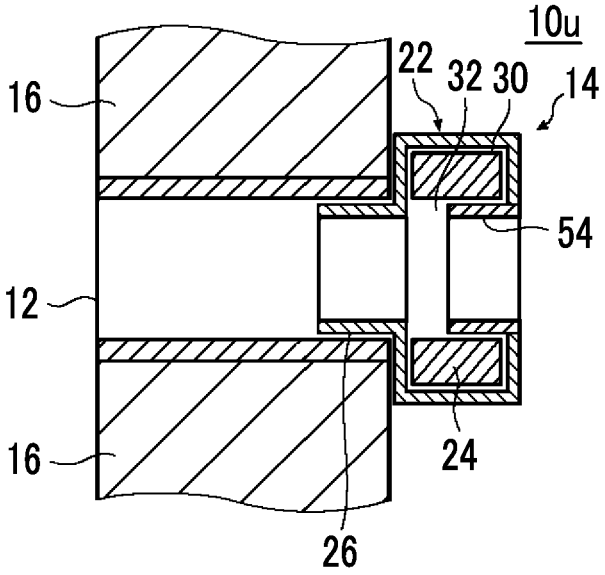
FIG. 109 is a cross-sectional view conceptually showing another example of the silencing system according to the embodiment of the invention.

Furthermore, as shown in FIG. 109, a member forming the surface of the silencer 22 where the opening portion 32 is formed may be formed of a separate member (partition member 54) and the partition member 54 may be adapted to be replacable. Since the size of the opening portion 32 can be easily changed in a case where the partition member 54 is adapted to be replacable, the resonant frequency of the silencer 22 can be appropriately set. Further, the sound-absorbing material 24 installed in the cavity portion 30 can be easily replaced.

Examples of the materials of the silencer 22 and the silencing device 14 can include a metal material, a resin material, a reinforced plastic material, carbon fiber, and the like. Examples of the metal material can include metal materials, such as aluminum, titanium, magnesium, tungsten, iron, steel, chromium, chromium molybdenum, nichrome molybdenum, and alloys thereof. Further, examples of the resin material can include resin materials, such as an acrylic resin, poly(methyl methacrylate), polycarbonate, polyamide-imide, polyarylate, polyetherimide, polyacetal, polyetheretherketone, polyphenylene sulfide, polysulfone, polyethylene terephthalate, polybutylene terephthalate, polyimide, and triacetyl cellulose. Furthermore, examples of the reinforced plastic material can include carbon fiber reinforced plastics (CFRP) and glass fiber reinforced plastics (GFRP).

Here, in terms of the fact that the silencer 22 and the silencing device 14 can be used for an exhaust port and the like, it is preferable that the silencer 22 and the silencing device 14 are made of a material having heat resistance higher than the heat resistance of a flame retardant material. For example, heat resistance can be defined by time that satisfies the items of Article 108(2) of the Order for Enforcement of the Building Standards Act. A case where the time satisfying the items of Article 108(2) of the Order for Enforcement of the Building Standards Act is equal to or longer than 5 minutes and shorter than 10 minutes corresponds to a flame retardant material, a case where the time satisfying the items of Article 108(2) of the Order for Enforcement of the Building Standards Act is equal to or longer than 10 minutes and shorter than 20 minutes corresponds to a quasi-noncombustible material, and a case where the time satisfying the items of Article 108(2) of the Order for Enforcement of the Building Standards Act is equal to or longer than 20 minutes corresponds to a noncombustible material. However, there are many definitions of heat resistance in the respective fields. For this reason, depending on a field where the silencing system is used, the silencer 22 and the silencing device 14 may be made of a material having heat resistance that is equal to or higher than flame retardance defined in the field.

Figure 76:
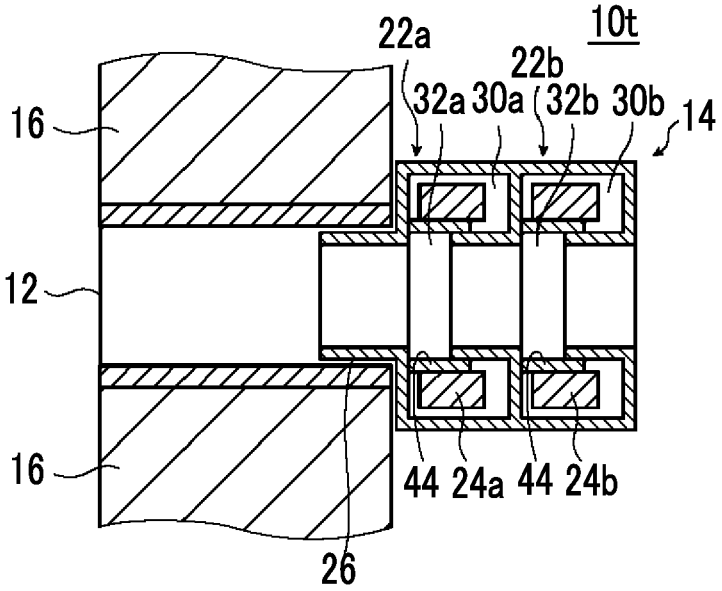
FIG. 76 is a cross-sectional view conceptually showing another example of the silencing system according to the embodiment of the invention.

Further, it is preferable that an opening portion 32 of each silencer 22 is covered with a windproof film 44 transmitting acoustic waves and blocking air (wind) as in a silencing system 10*t* shown in FIG. 76.

A pressure loss of the entire silencing system in the case of configuration where air can flow into the cavity portion 30 of the silencer 22 is larger than that in the case of a straight tube. For this reason, there is a concern that the amount of ventilation air may be reduced. In contrast, in a case where the opening portion 32 of each silencer 22 is covered with the windproof film 44, the effect of silencing performed by the silencer 22 is obtained since the windproof film 44 transmits acoustic waves. Further, since the windproof film 44 blocks air, the flow of air into the cavity portion 30 is suppressed, so that a pressure loss can be reduced.

The windproof film 44 may be a non-ventilation film or may be a film of which the ventilation performance is low.

Resin materials, such as an acrylic resin, such as poly (methyl methacrylate) (PMMA), polyethylene terephthalate (PET), polycarbonate, polyamide-imide, polyarylate, polyetherimide, polyacetal, polyetheretherketone, polyphenylene sulfide, polysulfone, polybutylene terephthalate, polyimide, and triacetyl cellulose, can be used as the material of the non-ventilation windproof film 44.

A porous film made of the resin, porous metal foil (porous aluminum foil, and the like), nonwoven fabric (resin-bonded nonwoven fabric, thermal bonded nonwoven fabric, spunbond nonwoven fabric, spunlace nonwoven fabric, and nanofiber nonwoven fabric), woven fabric, paper, and the like can be used as the material of the windproof film 44 of which the ventilation performance is low.

In a case where a porous film, porous metal foil, nonwoven fabric, and woven fabric are used, a sound-absorbing effect can be obtained from through-hole portions of these. That is, these also function as a conversion mechanism for converting sound energy into thermal energy.

The thickness of the windproof film 44 also depends on a material, but is preferably in the range of 1 μm to 500 μm, more preferably in the range of 3 μm to 300 μm, and still more preferably in the range of 5 μm to 100 μm.

Further, the silencing system according to the embodiment of the invention may include another commercially available soundproof member.

Figure 77:
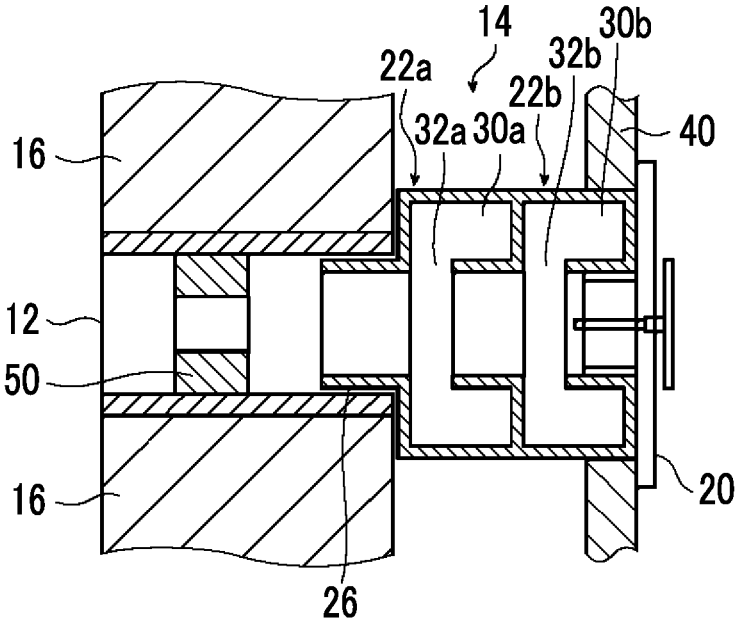
FIG. 77 is a cross-sectional view conceptually showing another example of the silencing system according to the embodiment of the invention.

For example, as shown in FIG. 77, a silencing device 14 of the invention may be disposed at one end portion of a tubular member 12 and an insertion type silencer 50 may be disposed in the tubular member 12.

Figure 78:
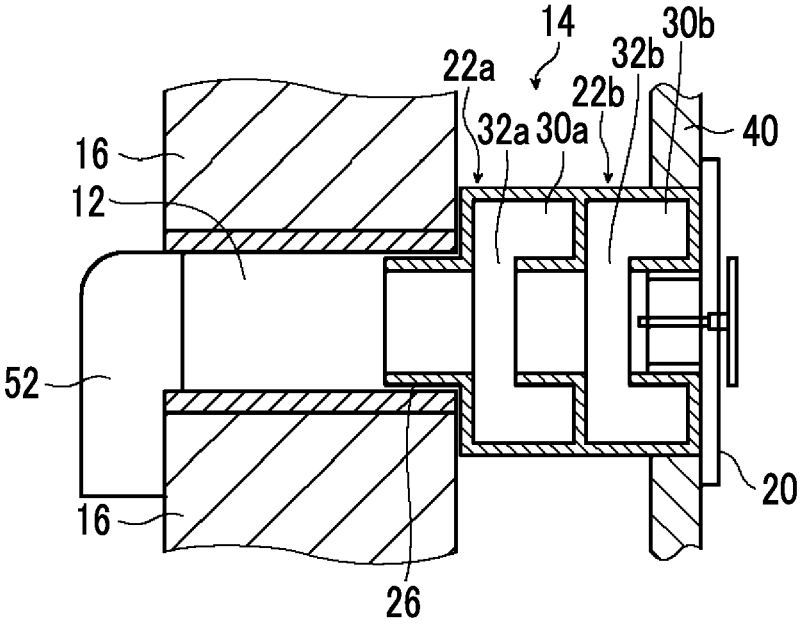
FIG. 78 is a cross-sectional view conceptually showing another example of the silencing system according to the embodiment of the invention.

Furthermore, as shown in FIG. 78, the silencing device 14 of the invention is disposed at one end portion of a tubular member 12 and an outdoor installation type soundproof hood 52 may be disposed at the other end portion of the tubular member 12.

Alternatively, the silencing device 14 of the invention is disposed at one end portion of a tubular member 12, the insertion type silencer 50 is disposed in the tubular member 12, and the outdoor installation type soundproof hood 52 is disposed at the other end portion of the tubular member 12.

In this way, high soundproof performance is obtained in a wider band through a combination of other soundproof members.

Various publicly known insertion type silencers can be used as the insertion type silencer 50. For example, a soundproof sleeve (SK-BO100 and the like) manufactured by Shinkyowa Co., Ltd., a soundproof sleeve (100NS2 and the like) manufactured by Daiken Plastics Corporation, a silencer for natural ventilation (SEIHO NPJ100 and the like) manufactured by Seiho Kogyo Co., Ltd., a silencer (UPS100SA and the like) manufactured by UNIX Co., Ltd., a silent sleeve P (HMS-K and the like) manufactured by Kenyu Co., Ltd., and the like can be used.

Various publicly known soundproof sleeves can be used as the outdoor installation type soundproof hood 52. For example, a soundproof hood (SSFW-A10M and the like) manufactured by UNIX Co., Ltd., a soundproof hood (BON-TS and the like) manufactured by SYLPHA Corporation, and the like can be used.

Here, the tubular member 12 is not limited to a straight tubular member, and may be a member having bending structure. In a case where the tubular member 12 has bending structure, not only wind (the flow of air) but also acoustic waves are also reflected to the upstream side. For this reason, it is difficult for not only wind but also acoustic waves to pass through the tubular member 12. A case where a bent portion is formed of a curved surface and makes a change in the angle of a wall be moderate to ensure ventilation performance or a case where a distributing plate is provided at a bent portion and changes the traveling direction of wind to ensure ventilation performance is considered.

However, in a case where a bent portion is formed of a curved surface or the distributing plate is provided at a bent portion, ventilation performance is improved but acoustic wave transmittance is also increased.

Figure 89:
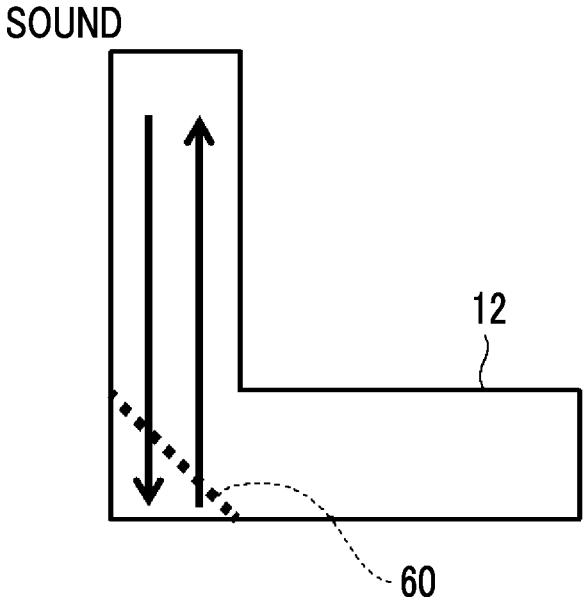
FIG. 89 is a cross-sectional view schematically showing a bent portion of a tubular member in which a sound transmission wall is disposed.
Figure 90:
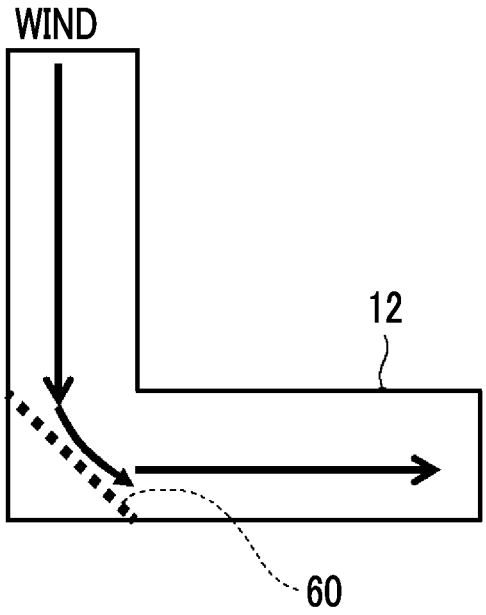
FIG. 90 is a cross-sectional view schematically showing the bent portion of the tubular member in which the sound transmission wall is disposed.

Accordingly, as shown in FIG. 89, a sound transmission wall 60, which does not allow wind to pass (makes it difficult for wind to pass) and transmits acoustic waves, is disposed at a bent portion of the tubular member 12. In FIG. 89, the tubular member 12 includes a bent portion that is bent at an angle of about 90°. The sound transmission wall 60 is disposed at the bent portion of the tubular member 12 so that the surface of the sound transmission wall 60 is inclined with respect to each of the longitudinal direction of the tubular member 12 on an incident side and the longitudinal direction of the tubular member 12 on an emission side by an angle of about 45°. In FIGS. 89 and 90, an upper side is the incident side and a right side is the emission side.

Since the sound transmission wall 60 transmits acoustic waves, acoustic waves incident from the upstream side are transmitted through the sound transmission wall 60 at the bent portion and are reflected to the upstream side by the wall of the tubular member 12 as shown in FIG. 89. That is, the characteristics of the original tubular member 12 are maintained. On the other hand, since the sound transmission wall 60 does not allow wind to pass, the traveling direction of wind entering from the upstream side is bent at the bent portion by the sound transmission wall 60 and the wind flows to the downstream side as shown in FIG. 90. In a case where the sound transmission wall 60 is disposed at the bent portion in this way, ventilation performance can be improved while low sound transmittance is maintained.

Nonwoven fabric having low density and a film having a small thickness and low density can be used as the sound transmission wall 60.

Examples of the nonwoven fabric having low density include a stainless steel fiber sheet (Tommyfilec SS) manufactured by Tomoegawa Paper Co., Ltd., usual tissue paper, and the like. Examples of the film having a small thickness and low density include various commercially available wrap films, a silicone rubber film, metal foil, and the like.

EXAMPLES

The invention will be described in more detail below on the basis of Examples. Materials, the amounts of used materials, ratios of the materials, the contents of treatment, the procedure of treatment, and the like described in the following examples can be appropriately changed without departing from the scope of the invention. Accordingly, the scope of the invention should not be interpreted in a limited way by examples to be described below.

[Simulation]

First, the results of a simulation performed about the silencing system according to the embodiment of the invention will be described.

The simulation is performed using n acoustic module of finite element method-calculation software COMSOL ver5.3 (manufactured by COMSOL Inc.).

Reference Example

First, a simulation is performed about acoustic waves that are transmitted through a tubular member on which a silencer is not installed. The thickness of a wall is set to 300 mm and the diameter of a tubular member is set to 100 mm. A relationship between the sound pressure of acoustic waves, which are transmitted through the tubular member and are propagated from one space to the other space, (transmitted sound pressure) and a frequency is calculated through the simulation. Results are shown in FIG. 41.

Figure 41:
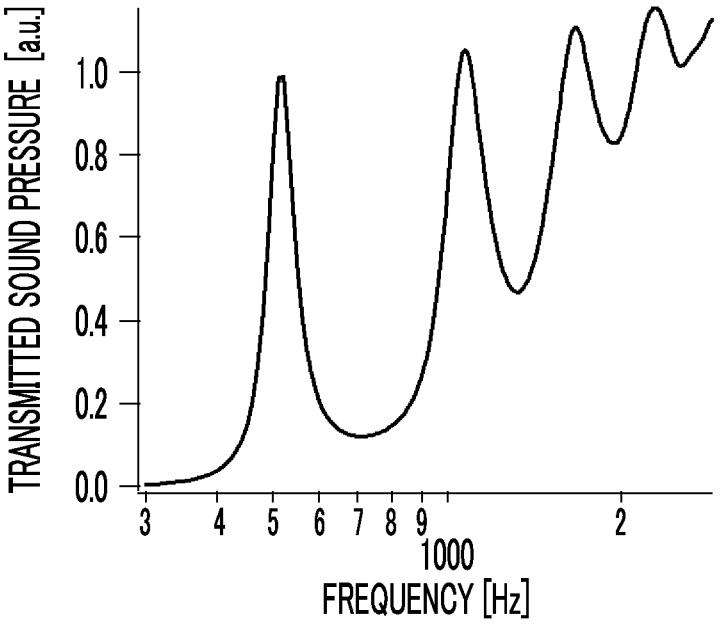
FIG. 41 is a graph showing a relationship between transmitted sound pressure and a frequency.

As shown in FIG. 41, transmitted sound pressure is increased at the resonant frequencies of resonance occurring in the tubular member in a case where a silencer is not installed. A first resonant frequency is 460 Hz, a second resonant frequency is 950 Hz, a third resonant frequency is 1470 Hz, and a fourth resonant frequency is 2000 Hz.

Example 1

Figure 42:
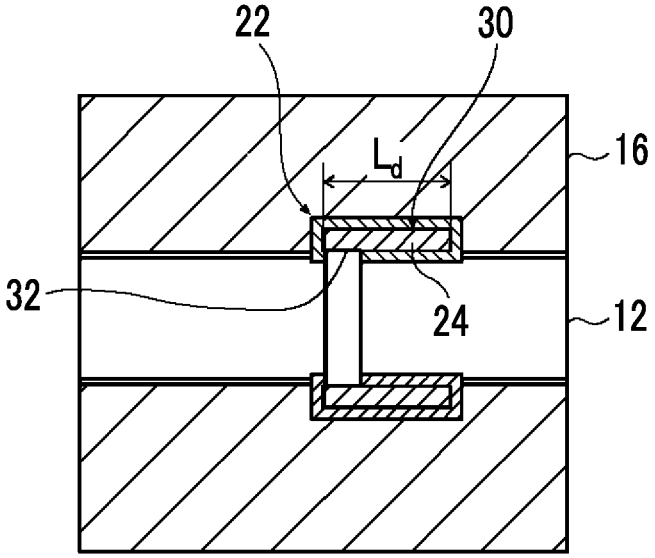
FIG. 42 is a cross-sectional view schematically showing a model of a silencing system of Example used in a simulation.

Next, a simulation is performed about configuration where a silencer 22 is disposed on the outer peripheral surface of a tubular member 12 as shown in FIG. 42 as Example 1.

The silencer 22 is an L-shaped silencer, has an annular shape along the entire outer peripheral surface of the tubular member 12 in a peripheral direction, and has a shape where an opening portion 32 is formed in the shape of a slit extending in the peripheral direction (see FIG. 24). Further, a sound-absorbing material 24 is disposed in a cavity portion 30 of the silencer 22.

The depth $L_d$ of the cavity portion 30 is set to 60 mm, the width $L_w$ of the cavity portion 30 is set to 10 mm, the width of the opening portion 32 in an axial direction is set to 10 mm, the wall thickness of the tubular member 12 is set to 3 mm, a ratio $S_1/S_d$ of the area $S_1$ of the opening portion 32 to the surface area $S_d$ of the inner wall of the cavity portion 30 is set to 7.4%, and the center position of the opening portion 32 in the axial direction is set to a position away from the end face of the silencer, which faces a sound source side, by 150 mm.

Further, the entire cavity portion 30 is filled with the sound-absorbing material 24. The flow resistance of the sound-absorbing material 24 is set to 13000 [Pa·s/m$^2$]. As long as not particularly described even in the following examples, a simulation is performed in a state where the entire cavity portion 30 is filled with the sound-absorbing material 24 and the flow resistance of the sound-absorbing material 24 is set to 13000 [Pa·s/m2].

Figure 43:
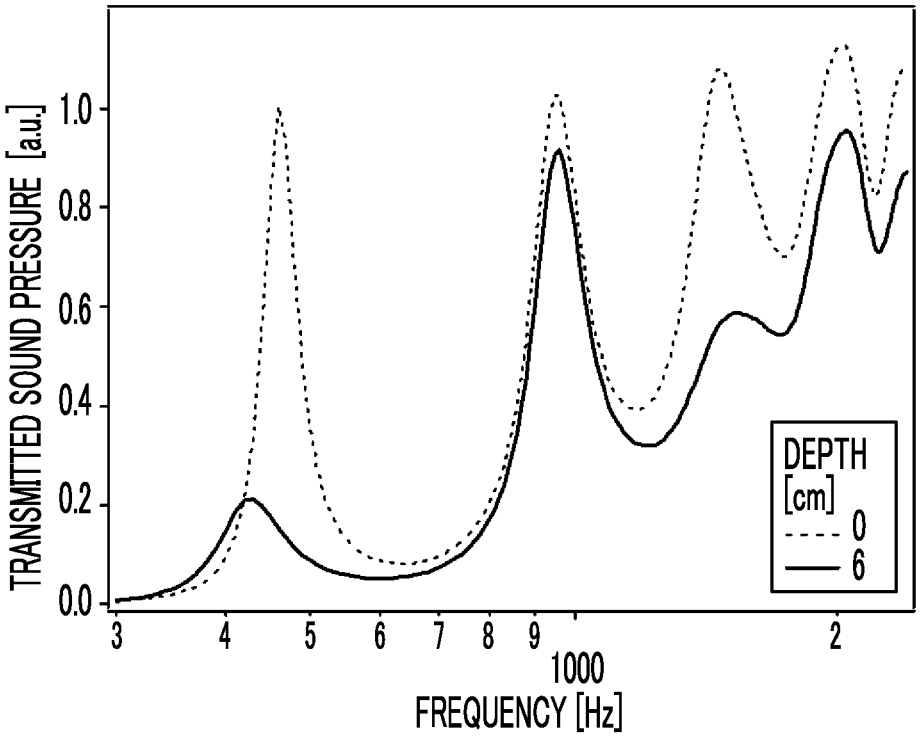
FIG. 43 is a graph showing a relationship between transmitted sound pressure and a frequency.

Results are shown in FIG. 43. Results obtained in a case where the depth $L_d$ is set to 0 mm, that is, a case where the silencer 22 is not disposed as Reference Example are also shown in FIG. 43. Transmitted sound pressure is a value that is obtained in a case where transmitted sound pressure at the first resonant frequency is standardized as 1.

Particularly, transmitted sound pressures at frequencies near the first resonant frequency and the third resonant frequency in Example 1 are selectively lower than those in Reference Example as shown in FIG. 43. Accordingly, it is found that soundproof performance in these frequency bands in Example 1 is higher than that in Reference Example. The reason for this is that the silencing effect of the silencing system according to the embodiment of the invention is increased as sound pressure in the tubular member is increased by the resonance phenomenon of the tubular member.

Comparative Example 1

Figure 44:
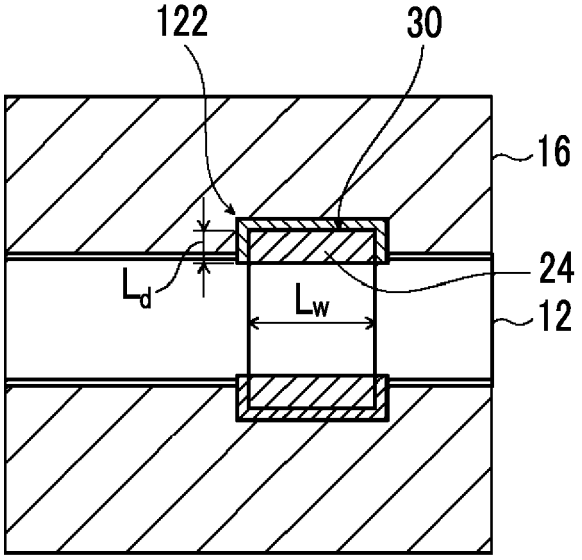
FIG. 44 is a cross-sectional view schematically showing a model of a silencing system of Comparative example used in a simulation.

Next, a simulation is performed about configuration where a silencer 122 is disposed on the outer peripheral surface of a tubular member 12 as shown in FIG. 44 as Comparative Example 1. The silencer 122 has the same configuration as the silencer of Example 1 except that the depth $L_d$ of a cavity portion 130 is set to 10 mm, the width Lv, of the cavity portion 130 is set to 60 mm, the width of an opening portion is set to 60 mm, and an area ratio $S_1/S_d$ is set to 76.3%. This configuration is an example where a sound-absorbing effect varies since the area of the opening portion is different from that in Example 1 even though the volume of the cavity portion is equal to that in Example 1.

Figure 45:
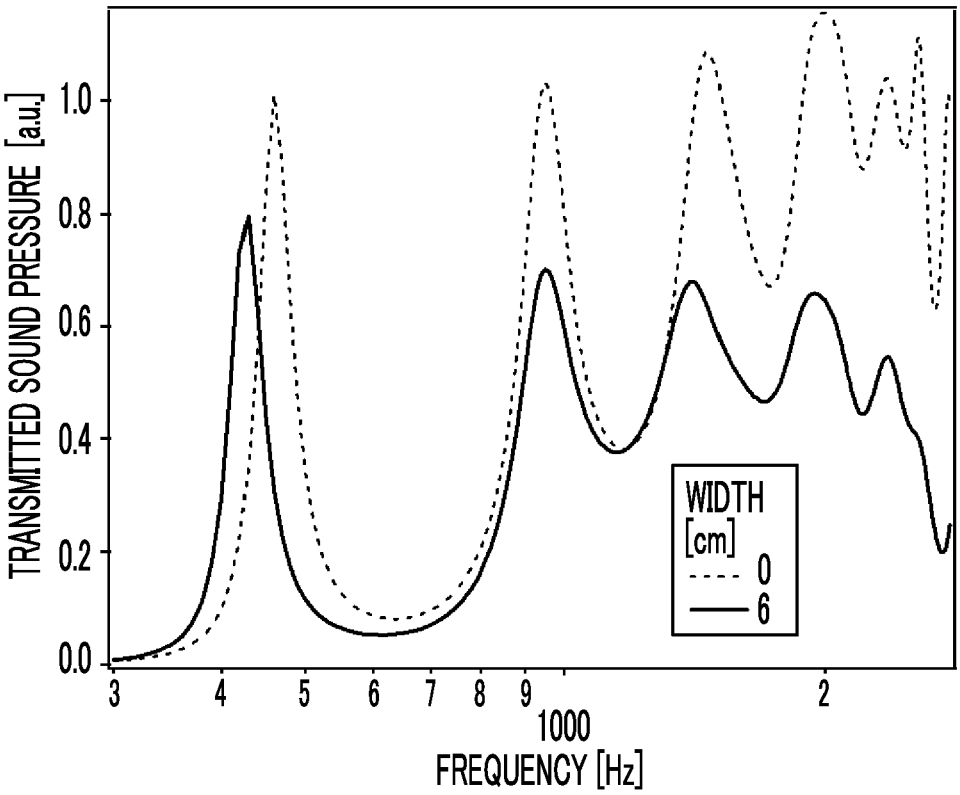
FIG. 45 is a graph showing a relationship between transmitted sound pressure and a frequency.

Results are shown in FIG. 45. Results obtained in a case where the width of the opening portion is set to 0 mm, that is, a case where the silencer 122 is not disposed as Reference Example are also shown in FIG. 45.

In a case where Comparative Example 1 is compared with Reference Example, transmitted sound pressure in a wide frequency band, particularly, a frequency band of 800 Hz or more in Comparative Example 1 is lower than that in Reference Example as shown in FIG. 45. However, it is found that soundproof performance on the low frequency side near the first resonant frequency is not sufficient since the transmitted sound pressure of resonant sound in Comparative Example 1 is not selectively lower than that in Reference Example.

Figure 46:
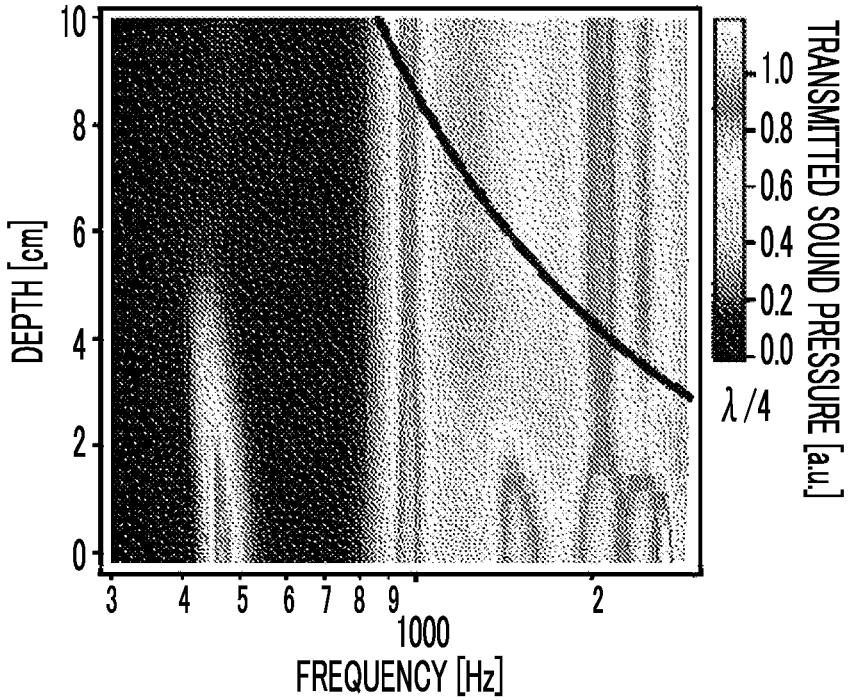
FIG. 46 is a graph showing a relationship among transmitted sound pressure, a frequency, and a depth.

Next, the results of a simulation performed while the depth $L_d$ of the cavity portion 30 is changed to various values in Example 1 are shown in FIG. 46. The width of the opening portion 32 is set to 10 mm.

Figure 47:
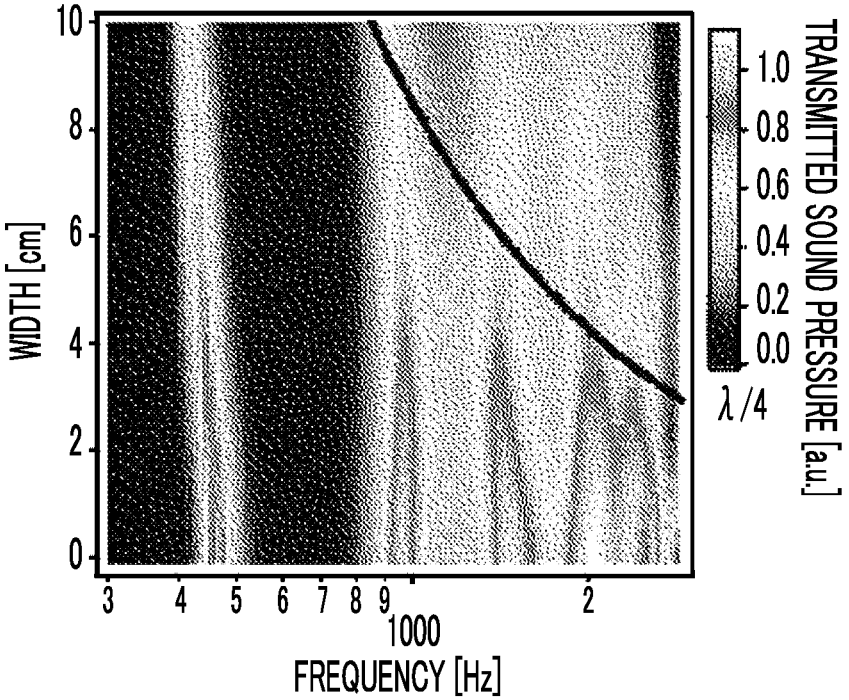
FIG. 47 is a graph showing a relationship among transmitted sound pressure, a frequency, and a depth.

Likewise, the results of a simulation performed while the width of the opening portion is changed to various values in Comparative Example 1 are shown in FIG. 47.

Figure 48:
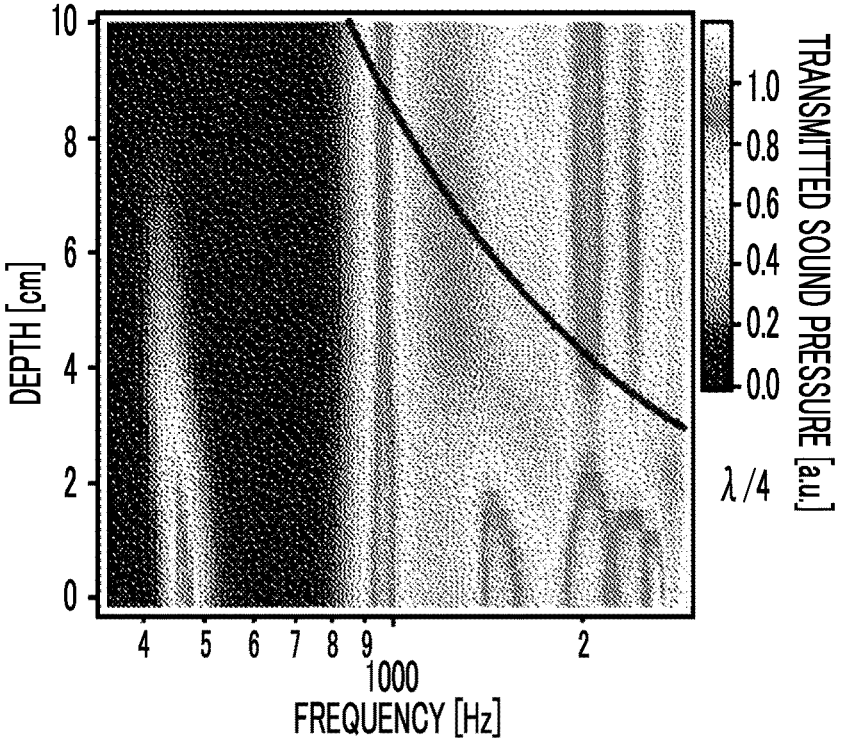
FIG. 48 is a graph showing a relationship among transmitted sound pressure, a frequency, and a depth.

In addition, the results of a simulation, which is performed while the depth $L_d$ of the cavity portion 30 is changed to various values in the same way as Example 1 except that a vertical cylinder type silencer is used, are shown in FIG. 48. The width $L_w$ of the cavity portion 30 (the width of the opening portion 32) is set to 10 mm.

A sound-absorbing material is changed according to the size of the cavity portion. Further, the center position of the opening portion is fixed in the middle of the tubular member. Furthermore, the value of λ/4 with respect to each frequency is also shown for comparison in FIGS. 46 to 48 by a thick line.

It is found from FIG. 46 that a high silencing effect is obtained even on the low frequency side since a silencing effect varies depending on the depth $L_d$ of the cavity portion. Since the opening portion is disposed in the middle, first resonant sound and third resonant sound having high sound pressure are significantly absorbed at the middle portion. Further, a required length is shorter than 214 and the peculiarity thereof is clear. Furthermore, it is found from FIG. 48 that a high silencing effect is obtained even on the low frequency side since a silencing effect varies depending on the depth $L_d$ of the cavity portion likewise even in the case of the vertical cylinder type silencer. Since the opening portion is disposed in the middle, first resonant sound and third resonant sound having high sound pressure are significantly absorbed at the middle portion. Further, a required length is shorter than 214 and the peculiarity thereof is clear.

It is found from FIG. 47 that a length of about 214 is required for the absorption of resonant sound in the configuration where a sound-absorbing material is merely disposed. Accordingly, in this case, it is found that it is difficult to raise soundproof performance on the low frequency side.

Further, a transmission loss at the first resonant frequency in a case where the depth of the cavity portion is changed to various values in Example 1 and a transmission loss at the first resonant frequency in a case where the width of the opening portion is changed to various values in Comparative Example 1 are calculated. It is shown that performance is higher as a transmission loss is larger.

Figure 49:
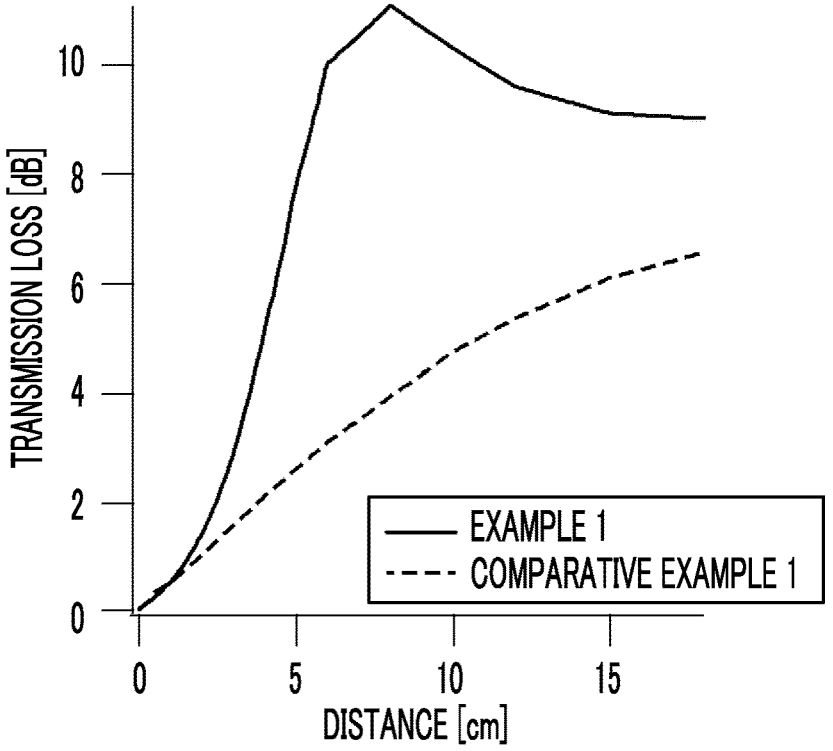
FIG. 49 is a graph showing a relationship between a transmission loss and a distance.

Results are shown in FIG. 49. ¼ of the wavelength λ at the first resonant frequency is about 170 mm.

As found from FIG. 49, a transmission loss becomes a peak at a depth shorter than 214 in Example 1 of the invention. On the other hand, in Comparative Example 1, a transmission loss is increased as the width of the opening portion is increased. This is characteristics depending on the area of the surface of the sound-absorbing material coming into contact with acoustic waves and the volume of the sound-absorbing material. In a case where a sound-absorbing material is used in a general usage method of increasing the area of the surface of the sound-absorbing material coming into contact with acoustic waves, these characteristics are obtained.

Examples 2 and 3

Next, the results of a simulation performed about the position of the opening portion 32 of the silencer 22 will be described.

Figure 50:
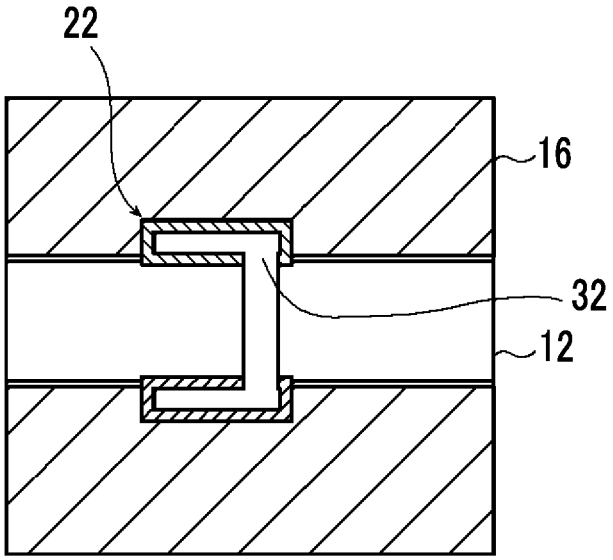
FIG. 50 is a cross-sectional view schematically showing another model of the silencing system of Example used in a simulation.
Figure 51:
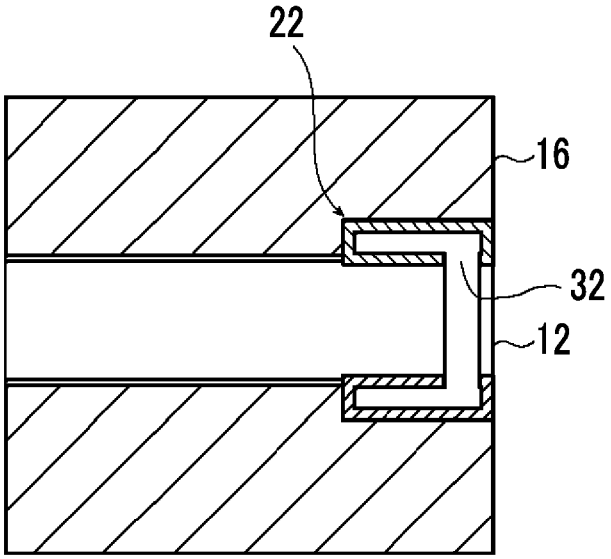
FIG. 51 is a cross-sectional view schematically showing another model of the silencing system of Example used in a simulation.

As shown in FIGS. 50 and 51, transmitted sound pressure is calculated while the position of the opening portion 32 of the silencer 22 is changed to various positions in the axial direction of the tubular member. As shown in FIG. 50, a case where the center of the opening portion 32 is present at the center position of the tubular member in the axial direction is used as a reference (a position of 0 mm). Examples 2 and 3 are the same as Example 1 except for the position of the opening portion 32. Configuration where the opening portion 32 is disposed in the middle of the tubular member as shown in FIG. 50 is set as Example 2, and configuration where the opening portion 32 is disposed near one end face of the tubular member as shown in FIG. 51 (a position of 140 mm) is set as Example 3.

Figure 52:
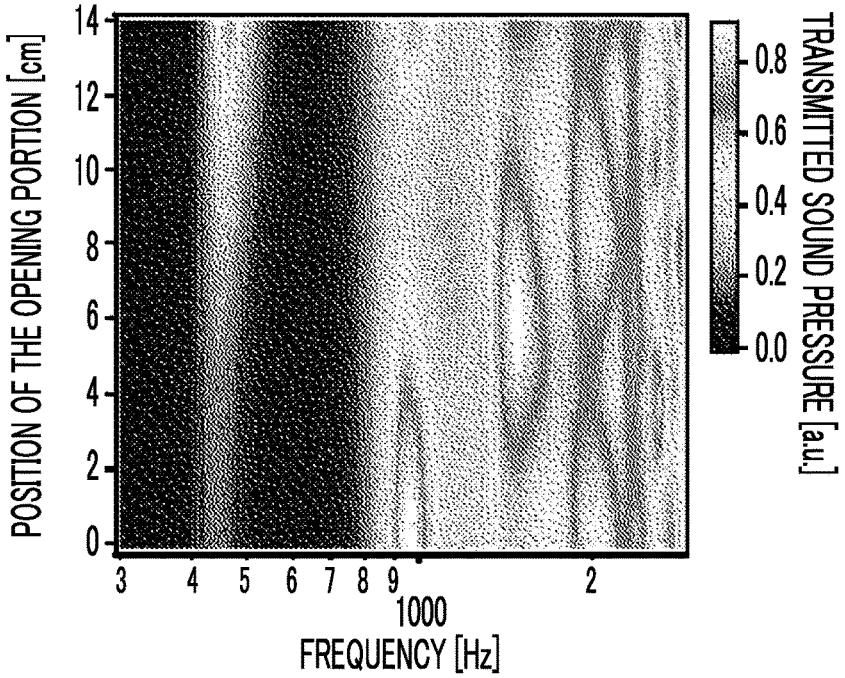
FIG. 52 is a graph showing a relationship among transmitted sound pressure, a frequency, and a position.
Figure 53:
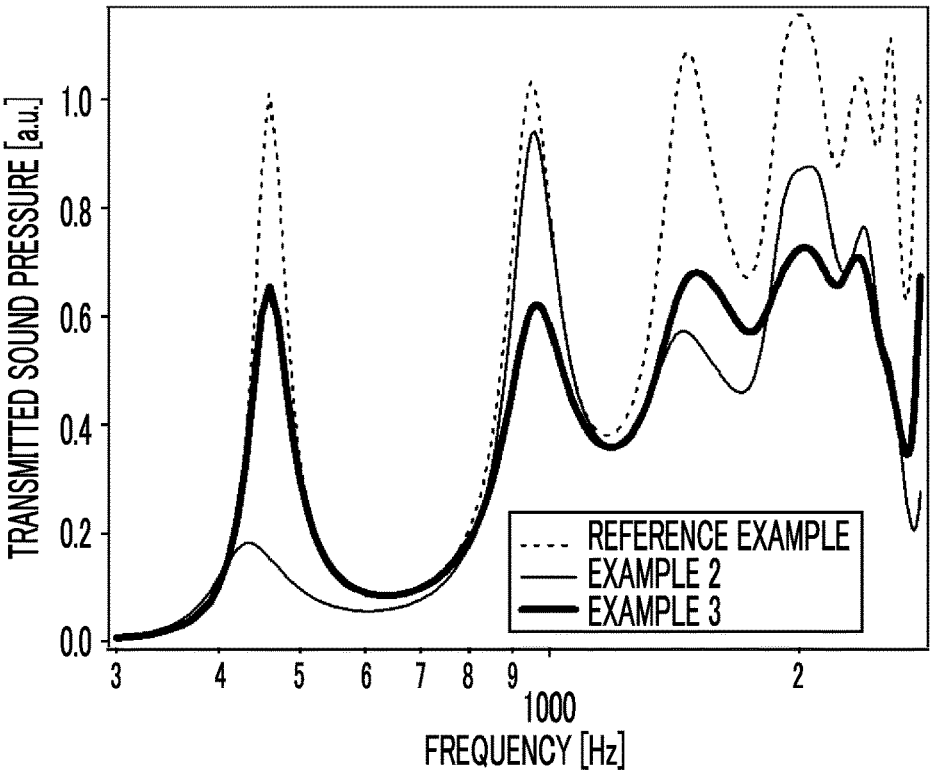
FIG. 53 is a graph showing a relationship between transmitted sound pressure and a frequency.

FIG. 52 is a graph showing a relationship among the position of the opening portion, a frequency, and transmitted sound pressure, and FIG. 53 is a graph showing a relationship between a frequency and transmitted sound pressure in Examples 2 and 3. Further, a case where a silencer is not disposed is shown in FIG. 53 as Reference Example.

As shown in FIGS. 52 and 53, it is found that acoustic waves having frequencies where sound pressure is high in the middle of the tubular member in the axial direction, such as a first resonant frequency and a third resonant frequency, can be more preferably silenced in a case where the opening portion 32 of the silencer 22 is disposed at a position near the middle of the tubular member in the axial direction. Further, it is found that a silencing effect at each resonant frequency is changed in a case where a position where the opening portion 32 is disposed us changed. For example, in a case where the opening portion 32 is disposed at a position away from the middle of the silencer by 90 mm, it is found that a silencing effect at a second resonant frequency where sound pressure is high at this position can be further increased.

In this way, a mode where sound is silenced can be controlled according to the position of the opening portion 32 of the silencer 22.

Next, the results of a simulation performed about the flow resistance of the sound-absorbing material 24 disposed in the cavity portion 30 of the silencer 22 will be described.

Figure 54:
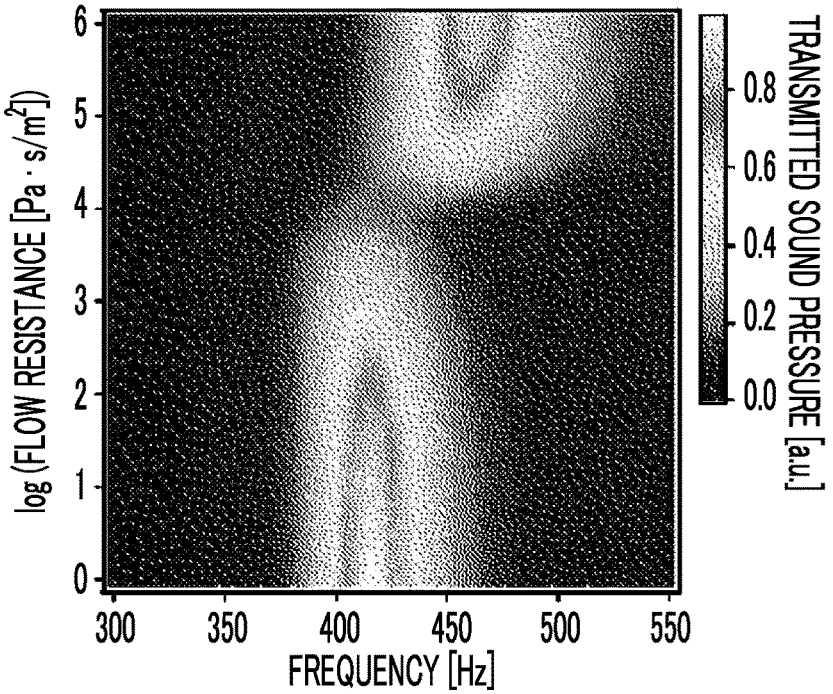
FIG. 54 is a graph showing a relationship among transmitted sound pressure, a frequency, and flow resistance.

The results of a simulation performed while the flow resistance of the sound-absorbing material 24 is changed to various values in a model of Example 1 are shown in FIG. 54. The depth $L_d$ of the cavity portion is set to 80 mm, the width $L_w$ of the cavity portion is set to 10 mm, the width $L_o$ of the opening portion is set to 10 mm, an area ratio $S_1/S_d$ is set to 5.5%, and the position of the opening portion in the axial direction is the middle.

It is found from FIG. 54 that the flow resistance has an optimum range. The reason for this is that the efficiency of the conversion of sound energy into thermal energy performed by the sound-absorbing material 24 is lowered since it is difficult for acoustic waves to pass through the sound-absorbing material 24 in a case where the flow resistance is too high.

Figure 55:
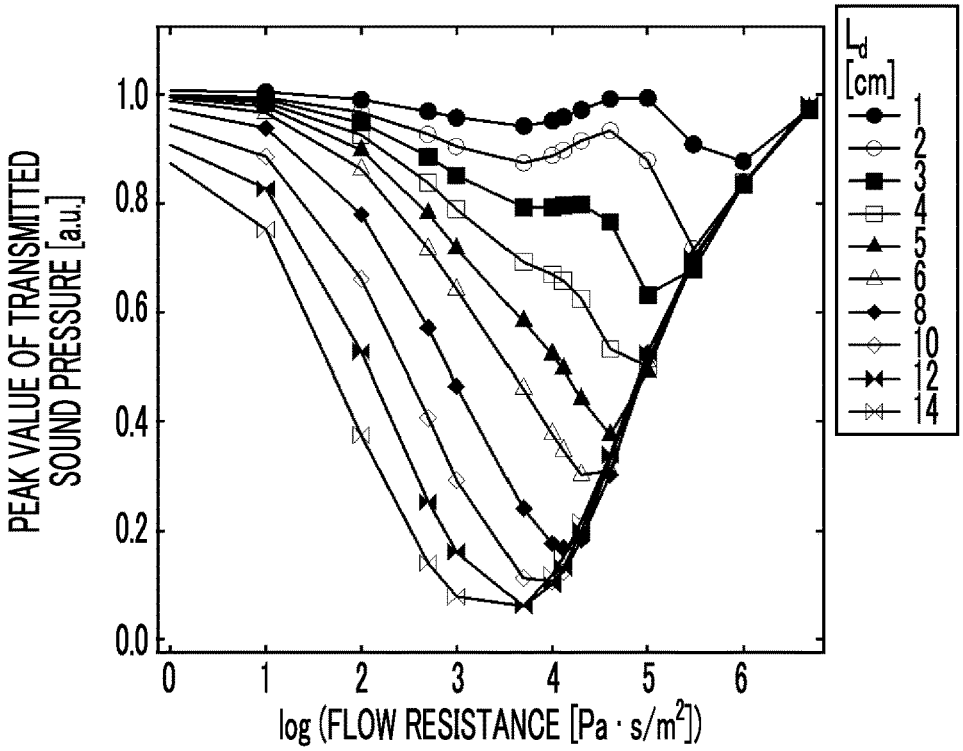
FIG. 55 is a graph showing a relationship between flow resistance and the peak value of transmitted sound pressure.
Figure 56:
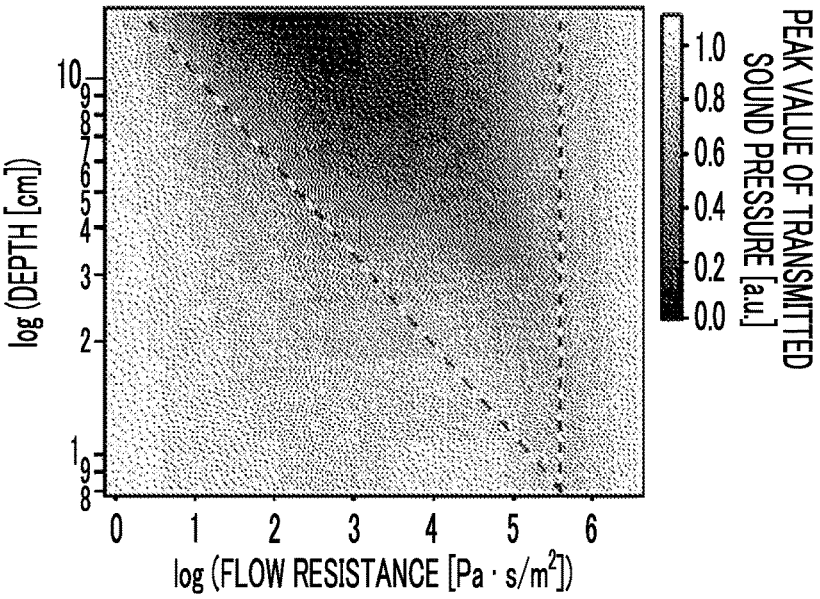
FIG. 56 is a graph showing a relationship among a depth, flow resistance, and the peak value of transmitted sound pressure.

Further, results, which are obtained in a case where transmitted sound pressure is measured about a combination of the depth $L_d$ of the cavity portion 30 and the flow resistance of the sound-absorbing material on the basis of the results of the simulation, are shown in FIGS. 55 and 56. FIG. 55 is a graph showing a relationship between the flow resistance of the sound-absorbing material 24 and the peak value of transmitted sound pressure in cases where the depth $L_d$ of the cavity portion 30 is set to values in the range of 10 mm (1 cm) to 140 mm (14 cm). FIG. 56 is a graph showing the peak value of transmitted sound pressure with respect to the depth $L_d$ of the cavity portion 30 and the flow resistance of the sound-absorbing material 24.

As shown in FIGS. 55 and 56, it is found that the flow resistance of the sound-absorbing material 24 has a preferred range depending on the depth $L_d$ of the cavity portion 30. From the results, the range of flow resistance where an effect of selectively absorbing resonant sound in the invention is shown preferably satisfies "$(1.25-\log(0.1\times L_d))/0.24<\log(\sigma_1)<5.6$", more preferably satisfies "$(1.32-\log(0.1\times L_d))/0.24<\log(\sigma_1)<5.2$", and still more preferably satisfies "$(1.39-\log(0.1\times L_d))/0.24<\log(\sigma_1)<4.7$". In the expressions, the unit of $L_d$ is [mm] and log is common logarithm.

Example 4

Next, the results of a simulation performed in a case where a plurality of silencers 22 are disposed in the axial direction will be described.

As shown in FIG. 27, the silencing system includes a silencer 22*a* that includes an opening portion 32*a* at a middle position of the tubular member 12 in the axial direction (a position away from an end face of the tubular member 12 by 150 mm) and a silencer 22*b* that includes an opening portion 32*b* near an end portion (a position away from the end face by 25 mm).

The thickness of a wall is set to 300 mm and the diameter of the tubular member is set to 100 mm.

Each of the silencers 22*a* and 22*b* is an L-shaped silencer, has an annular shape along the entire outer peripheral surface of the tubular member 12 in a peripheral direction, and has a shape where each of the opening portions 32*a* and 32*b* is formed in the shape of a slit extending in the peripheral direction. The depth $L_d$ of the cavity portion 30*a* of the silencer 22*a* is set to 80 mm, the width $L_w$ of the cavity portion 30*a* is set to 10 mm, the width $L_o$ of the opening portion 32*a* is set to 10 mm, and an area ratio $S_1/S_d$ is set to 5.5%. The depth $L_d$ of the cavity portion 30*b* of the silencer 22*b* is set to 50 mm, the width $L_w$ of the cavity portion 30*b* is set to 10 mm, the width $L_o$ of the opening portion 32*b* is set to 10 mm, and an area ratio $S_1/S_d$ is set to 8.9%.

Further, a sound-absorbing material 24 is disposed in each of the cavity portions 30*a* and 30*b* of the silencers 22*a* and 22*b*. The flow resistance of the sound-absorbing material 24 is set to 13000 [Pa·s/m$^2$].

Figure 57:
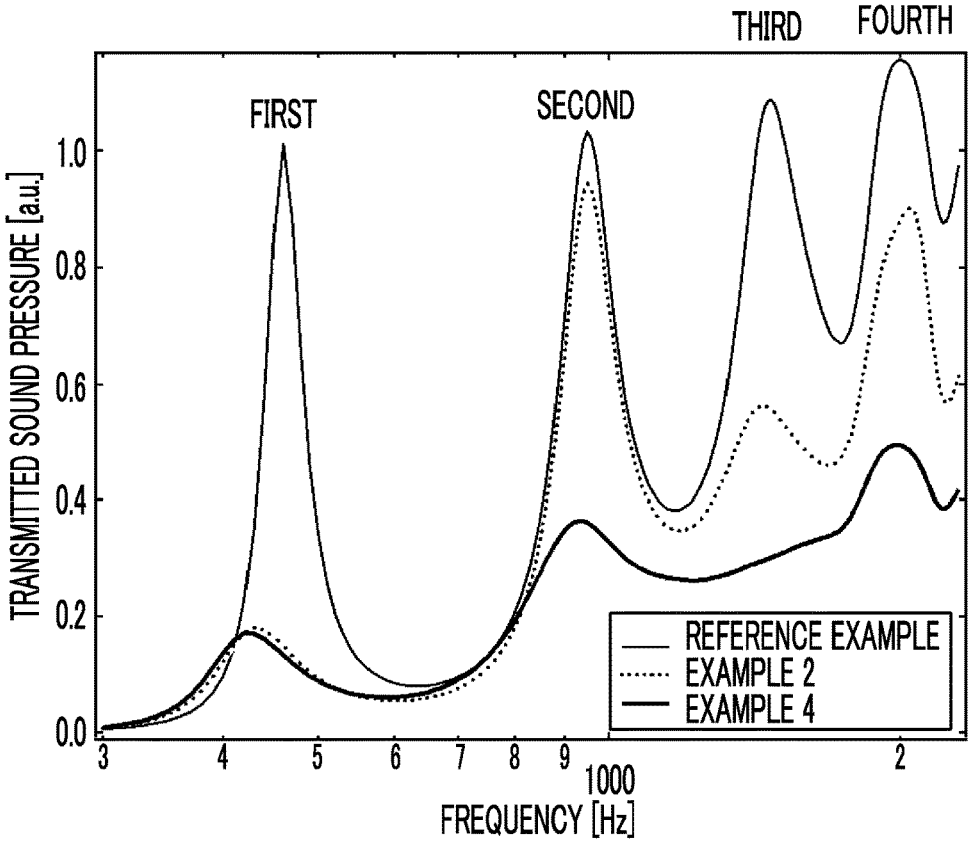
FIG. 57 is a graph showing a relationship between a frequency and transmitted sound pressure.

A relationship between a frequency and transmitted sound pressure is calculated using a model of this silencing system. Results are shown in FIG. 57. Results obtained in a case where there is no silencer as Reference Example and results of Example 2 having configuration where one silencer is provided in the axial direction are also shown in FIG. 57.

As shown in FIG. 57, in Example 2 having configuration where one silencer is provided, transmitted sound pressures at the first resonant frequency and the third resonant frequency can be reduced but transmitted sound pressures at the second resonant frequency and the fourth resonant frequency are relatively high. In contrast, since the silencer 22*b* disposed at a position (a position away from the end face by 25 mm) where sound pressure at the second resonance is high is provided in Example 4 in addition to the silencer 22*a* disposed at a position (middle) where sound pressure at the first resonance is high, transmitted sound pressure at the second resonance can also be reduced. Accordingly, a soundproof effect is obtained in a wider band. Further, since not only sound pressure at the third resonance but also sound pressure at the fourth resonance is also not 0 at a position where the silencer 22*b* is disposed, a soundproof effect is obtained even at the resonant frequencies of the third resonance and the fourth resonance.

[Actual Measurement Results]

Next, results, which are obtained in a case where a silencing system is produced and soundproof performance is evaluated, will be described.

Figure 58:
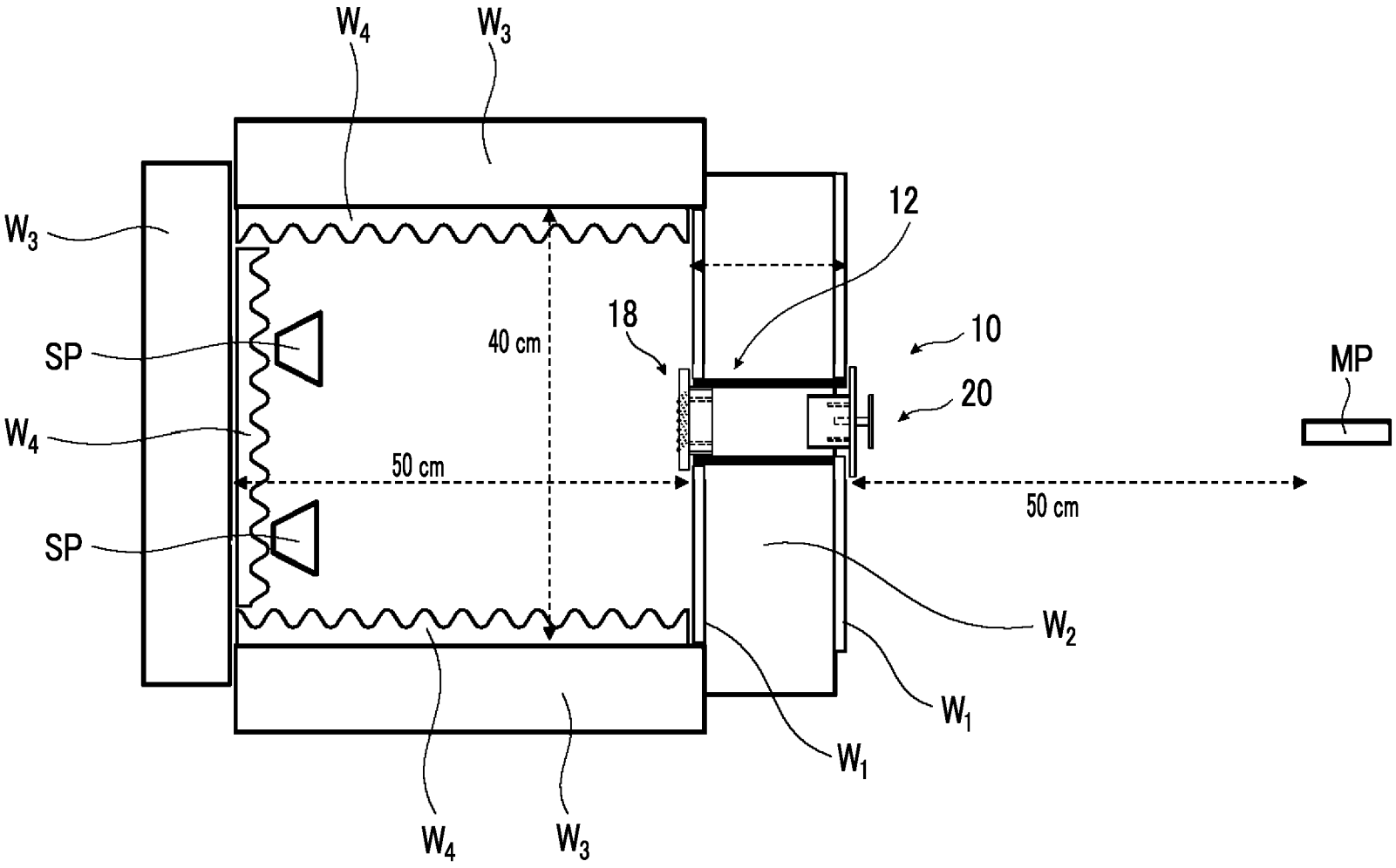
FIG. 58 is a diagram illustrating a measuring method for a reference.

Further, transmitted sound pressure in a case where a silencer is not disposed is measured as a reference using a simple and small soundproof room shown in FIG. 58.

Five surfaces of the simple and small soundproof room shown in FIG. 58 are surrounded by sound-absorbing urethane foam $W_3$ (having a thickness of 100 mm, U00F2 manufactured by Fuji Rubber Co. Ltd.), and the other one thereof is surrounded by a wall member where acrylic plates $W_1$ having a thickness of 5 mm are disposed on both surface of sound-absorbing urethane foam $W_2$ (formed of two pieces of sound-absorbing urethane foam $W_3$ (U00F2 manufactured by Fuji Rubber Co. Ltd.) and having a total thickness of 205 mm). Further, corrugated sound-absorbing urethane foam $W_4$ (having a maximum thickness of 35 mm, U00F6 manufactured by Fuji Rubber Co. Ltd.) is disposed on each of the inner surfaces of three surfaces, which are disposed on the left and right sides and lower side in the figure, among the pieces of the sound-absorbing urethane foam $W_3$ surrounding the five surfaces. The size of the interior space of the soundproof room is set to 400 mm×500 mm×500 mm.

A ventilation sleeve (tubular member) 12, which has an inner diameter of 10 cm and is made of vinyl chloride, is installed in the wall member, which includes the sound-absorbing urethane foam $W_2$ and the two acrylic plate $W_1$, so as to penetrate the wall member.

A horizontal louver (SG-CB manufactured by UNIX Co., Ltd.) is mounted on the end face of the ventilation sleeve 12, which is positioned in the soundproof room, as a cover member 18, and a register (KRP-BWF manufactured by UNIX Co., Ltd.) is mounted on the outer end face of the ventilation sleeve 12 as an air volume-adjusting member 20.

Two speakers SP (Kansupi set KANSPI-8 manufactured by FOSTEX Company) for generating white noise are disposed in the soundproof room. Further, a measurement microphone MP (TYPE4152N manufactured by ACO Co., Ltd.) for detecting acoustic waves is disposed at a position away from the register 20, which is positioned outside the soundproof room, by 50 cm.

First, the register 20 is closed, white noise is generated from the two speakers SP, and sound pressure is measured for 10 seconds at a sampling rate of 25000 Hz by the measurement microphone MP. Fourier transform is performed on data of the measured sound pressure to calculate a frequency spectrum. The data having been subjected to Fourier transform is averaged at an interval of 10 Hz. This data is used as background data.

Then, the register 20 is fully opened to measure sound pressure in the same way as described above, Fourier transform is performed on data of the sound pressure to calculate a frequency spectrum, and a difference between the background data and the data is obtained and is used as reference data.

Example 5

Figure 59:
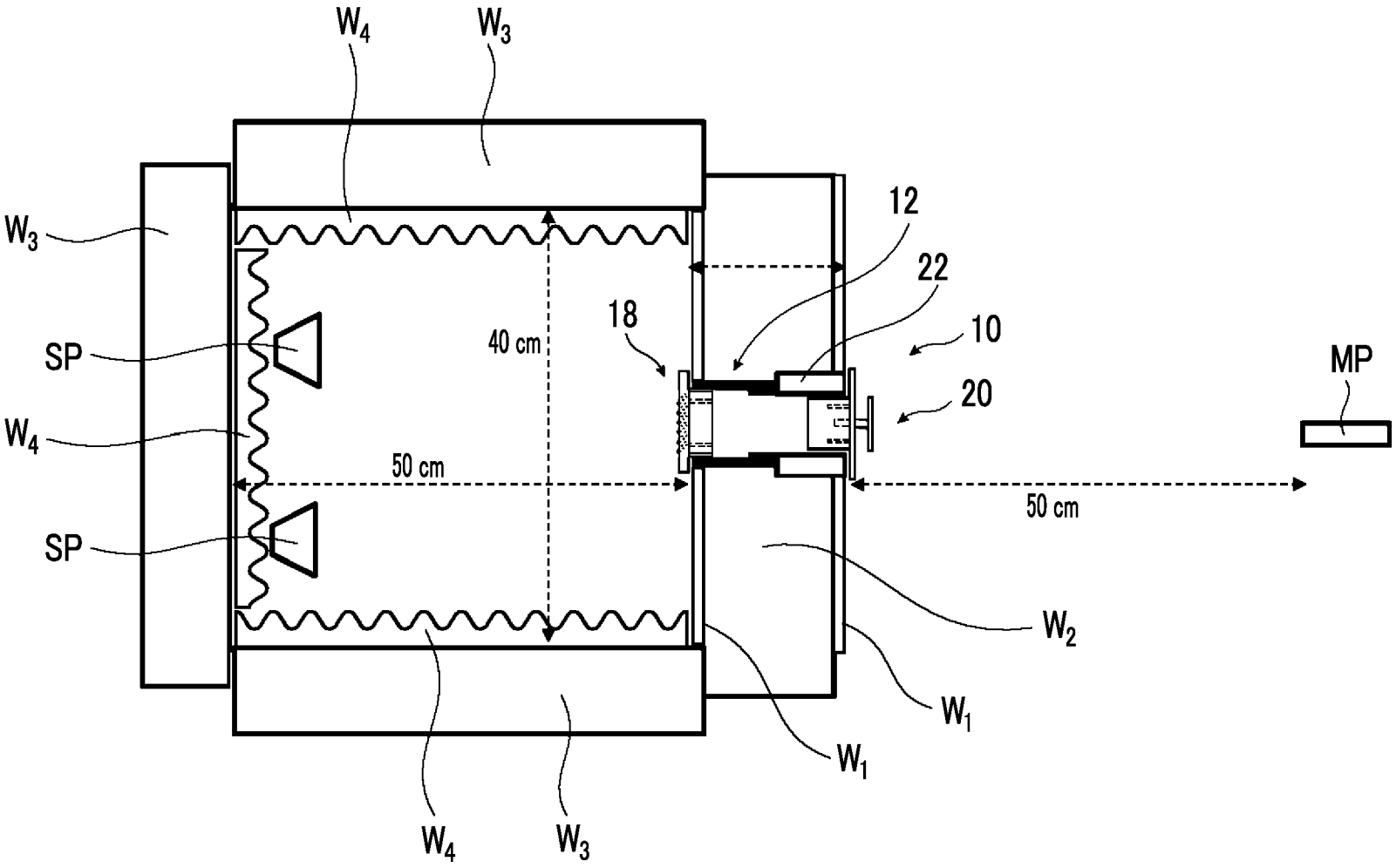
FIG. 59 is a diagram illustrating a method of measuring transmitted sound pressure of Example.

Next, as Example 5, a silencer 22 is installed in the ventilation sleeve 12 as shown in FIG. 59, the register 20 is fully opened to measure sound pressure in the same way as described above, Fourier transform is performed on data of the sound pressure to calculate a frequency spectrum, and a difference between the background data and the data is obtained and is used as the data of transmitted sound pressure.

Figure 60:
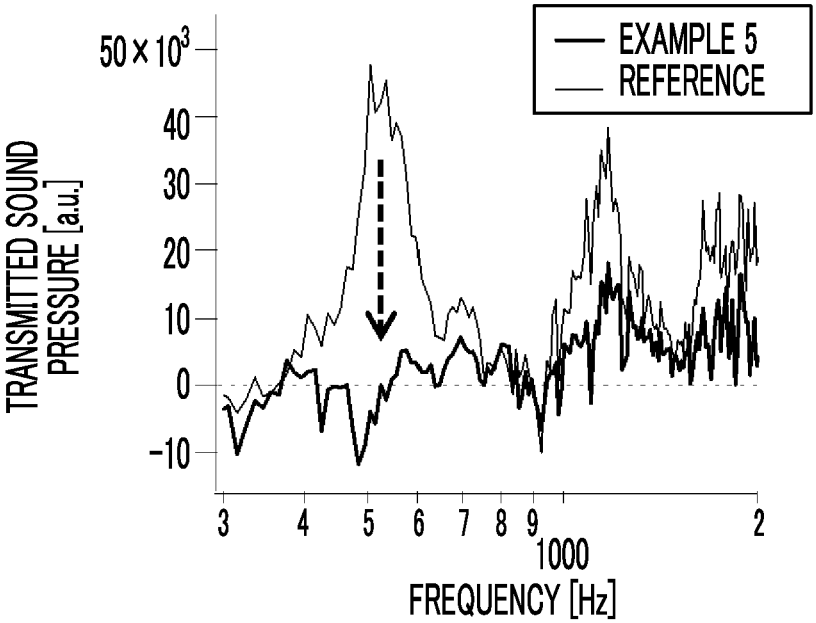
FIG. 60 is a graph showing a relationship between transmitted sound pressure and a frequency.

Results are shown in FIG. 60.

The silencer 22 of Example 5 has an annular shape along the entire outer peripheral surface of the tubular member 12 in a peripheral direction, and has a shape where an opening portion 32 is formed in the shape of a slit extending in the peripheral direction (see FIG. 24). Further, a sound-absorbing material 24 is disposed in a cavity portion 30 of the silencer 22.

The depth $L_d$ of the cavity portion 30 is set to 80 mm, the width $L_w$ of the cavity portion 30 is set to 14 mm, the width of the opening portion 32 in the axial direction is set to 15 mm, an area ratio $S_1/S_d$ is set to 8.3%, and the center portion of the opening portion 32 in the axial direction is set to a position away from the end face of the silencer, which faces a sound source, by 113 mm. Further, rock wool (manufactured by Mitsuuroko Co., Ltd.) for the replacement of a briquette foot warmer is used as the sound-absorbing material 24. The flow resistance of the sound-absorbing material 24 is set to 40000 [Pa·s/m$^2$] and the entire cavity portion 30 is filled with the sound-absorbing material 24.

Comparative Example 2

As Comparative Example 2, transmitted sound pressure is obtained in the same way as Example 4 except that a soundproof sleeve (SK-B075 manufactured by Shinkyowa Co., Ltd.) made of polyethylene is disposed in the ventilation sleeve 12 instead of the silencer 22.

Figure 61:
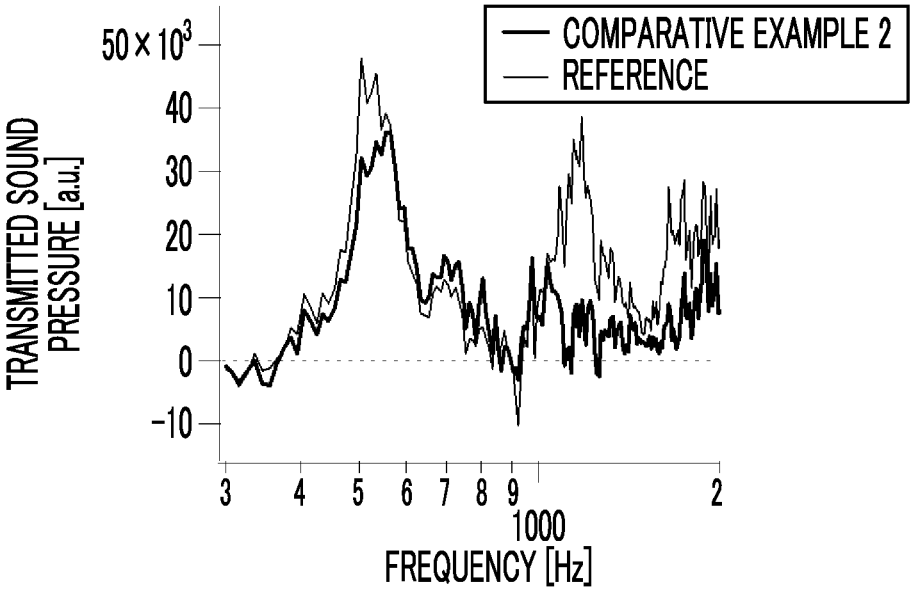
FIG. 61 is a graph showing a relationship between transmitted sound pressure and a frequency.

Results are shown in FIG. 61.

Comparative Example 3

As Comparative Example 3, transmitted sound pressure is obtained in the same way as Example 4 except that a silent sleeve P (HMS100K manufactured by Kenyu Co., Ltd.), which is a resonance type silencer, is disposed in the ventilation sleeve 12 instead of the silencer 22.

Figure 62:
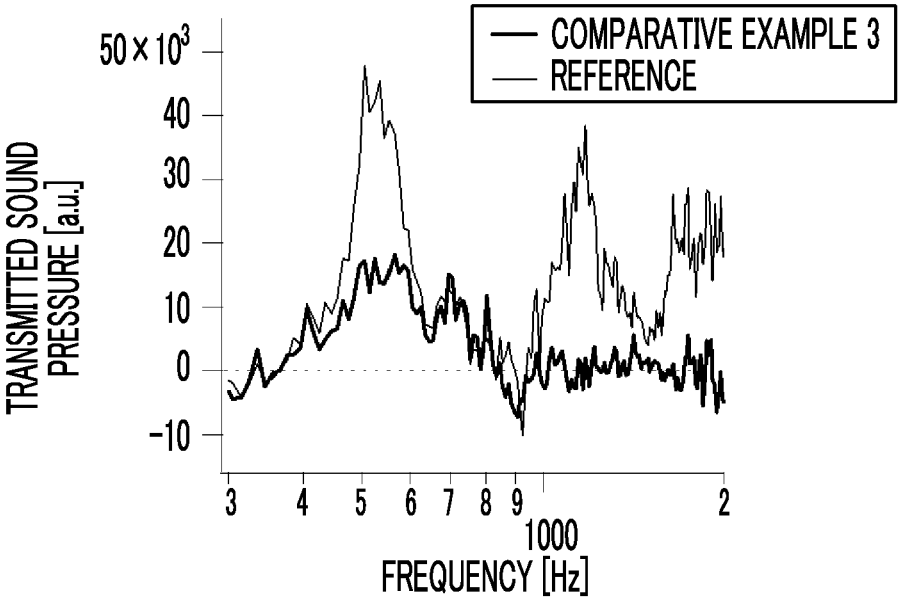
FIG. 62 is a graph showing a relationship between transmitted sound pressure and a frequency.

Results are shown in FIG. 62.

It is found from the comparison between Example 5 and Comparative Examples 2 and 3 that transmitted sound pressure at a first resonant frequency on the low frequency side can be more significantly reduced in Example of the invention than in Comparative Examples.

Example 6

As Example 6, transmitted sound pressure is obtained in the same way as Example 5 except that the thickness of the sound-absorbing urethane foam $W_2$ in which the ventilation sleeve 12 is installed is set to 265 mm and the length of the ventilation sleeve 12 is changed.

Figure 63:
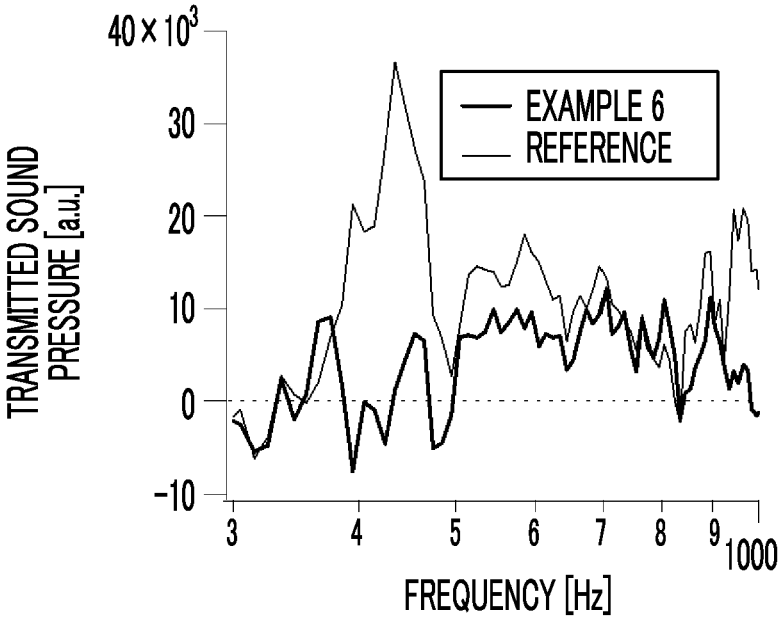
FIG. 63 is a graph showing a relationship between transmitted sound pressure and a frequency.

Results are shown in FIG. 63.

Comparative Example 4

Transmitted sound pressure is obtained in the same way as Example 6 except that a silent sleeve P (HMS100K manufactured by Kenyu Co., Ltd.), which is a resonance type silencer, is disposed in the ventilation sleeve 12 instead of the silencer 22.

Figure 64:
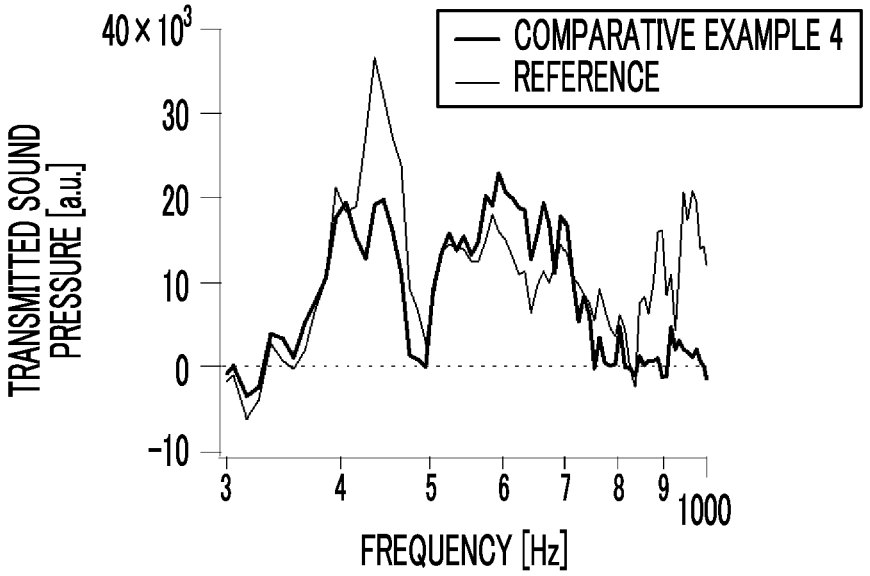
FIG. 64 is a graph showing a relationship between transmitted sound pressure and a frequency.

Results are shown in FIG. 64.

It is found from the comparison between FIGS. 60 and 63 that general-purpose properties are high since high soundproof performance is obtained in Example of the invention using the same silencer 22 as that of Example 5 even though the length of the ventilation sleeve is changed, that is, even though a ventilation sleeve having a different first resonant frequency is used.

On the other hand, it is found from the comparison between FIGS. 62 and 64 that general-purpose properties are low since soundproof performance is lowered in a resonance type silencer in a case where the first resonant frequency of the ventilation sleeve is changed.

Example 7

As Example 7, a silencer **22*a* and a silencer 22*b* are installed on the ventilation sleeve 12 so as to be arranged in the axial direction, the register 20** is fully opened to measure sound pressure in the same way as described above, Fourier transform is performed on data of the sound pressure to calculate a frequency spectrum, and a difference between the background data and the data is obtained and is used as the data of transmitted sound pressure.

Figure 65:
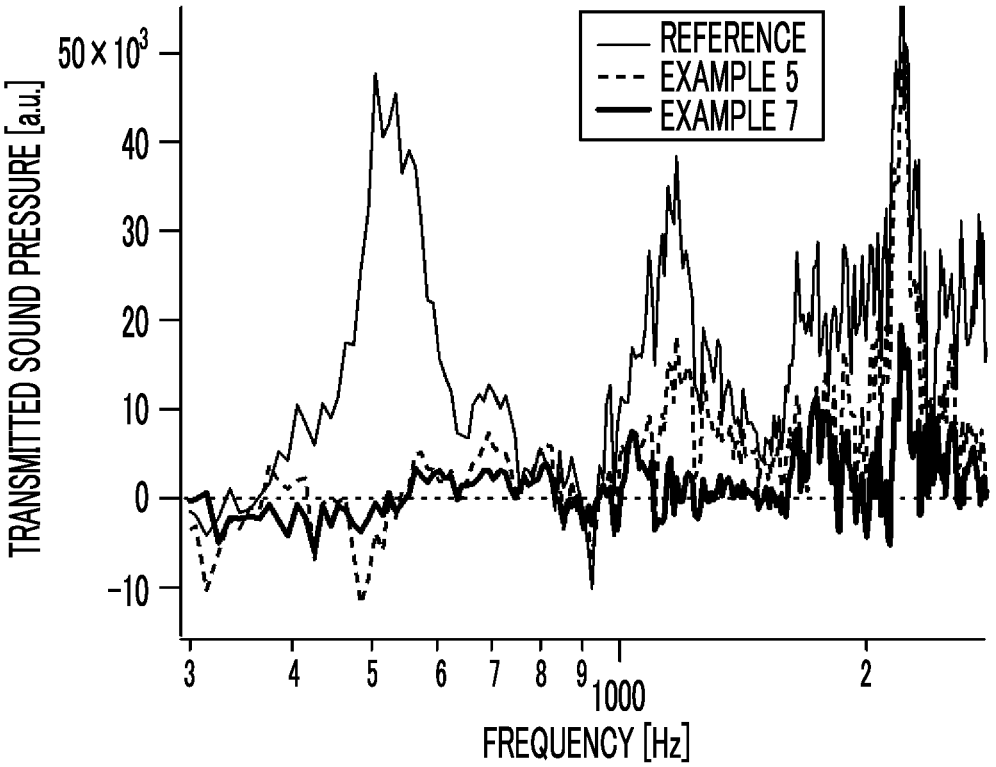
FIG. 65 is a graph showing a relationship between transmitted sound pressure and a frequency.
Figure 66:
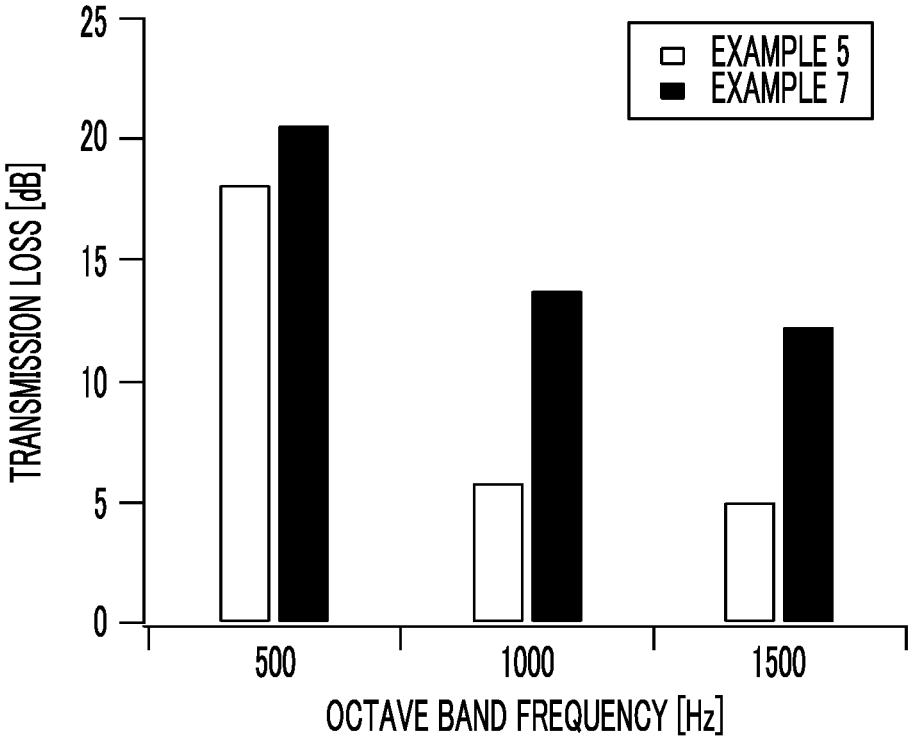
FIG. 66 is a graph showing a relationship between a frequency and a transmission loss.

Results are shown in FIGS. 65 and 66. FIG. 66 is a graph showing average values of transmission losses obtained in the respective frequency bands (octave band frequencies). An average value obtained at an octave band frequency of 500 Hz is an average value of transmission losses obtained at a frequency equal to or higher than 354 Hz and lower than 707 Hz, an average value obtained at an octave band frequency of 1000 Hz is an average value of transmission losses obtained at a frequency equal to or higher than 707 Hz and lower than 1414 Hz, and an average value obtained at an octave band frequency of 2000 Hz is an average value of transmission losses obtained at a frequency equal to or higher than 1414 Hz and lower than 2829 Hz. The results of Example 5 are also shown in FIGS. 65 and 66.

Each of the silencers 22*a* and 22*b* of Example 7 has an annular shape along the entire outer peripheral surface of the tubular member 12 in a peripheral direction, and has a shape where each of opening portions 32*a* and 32*b* is formed in the shape of a slit extending in the peripheral direction (see FIG. 24). Further, a sound-absorbing material 24 is disposed in each of the cavity portions 30*a* and 30*b* of the silencers 22*a* and 22*b*.

The depth $L_d$ of the cavity portion 30*a* of the silencer 22*a* is set to 40 mm, the width $L_w$ of the cavity portion 30*a* is set to 14 mm, the width $L_o$ of the opening portion 32*a* in the axial direction is set to 14 mm, an area ratio $S_1/S_d$ is set to 15.7%, and the center position of the opening portion 32*a* in the axial direction is set to a position away from the end face of the silencer, which faces a sound source side, by 113 mm. The depth $L_d$ of the cavity portion 30*b* of the silencer 22*b* is set to 60 mm, the width $L_w$ of the cavity portion 30*b* is set to 14 mm, the width $L_o$ of the opening portion 32*b* in the axial direction is set to 15 mm, an area ratio $S_1/S_d$ is set to 11.4%, and the center position of the opening portion 32*b* in the axial direction is set to a position away from the end face of the silencer, which faces the sound source side, by 156 mm.

Further, rock wool (manufactured by Mitsuuroko Co., Ltd.) for the replacement of a briquette foot warmer is used as the sound-absorbing material 24. The flow resistance of the sound-absorbing material 24 is set to 40000 [Pa·s/m$^2$] and each of the entire cavity portions 30*a* and 30*b* is filled with the sound-absorbing material 24.

It is found from FIGS. 65 and 66 that a high soundproof effect is obtained in a wider band in a case where two silencers are disposed in the axial direction.

Example 8

Next, results, which are obtained in a case where a silencing system combined with a commercially available soundproof member is produced and soundproof performance is evaluated, will be described.

Figure 79:
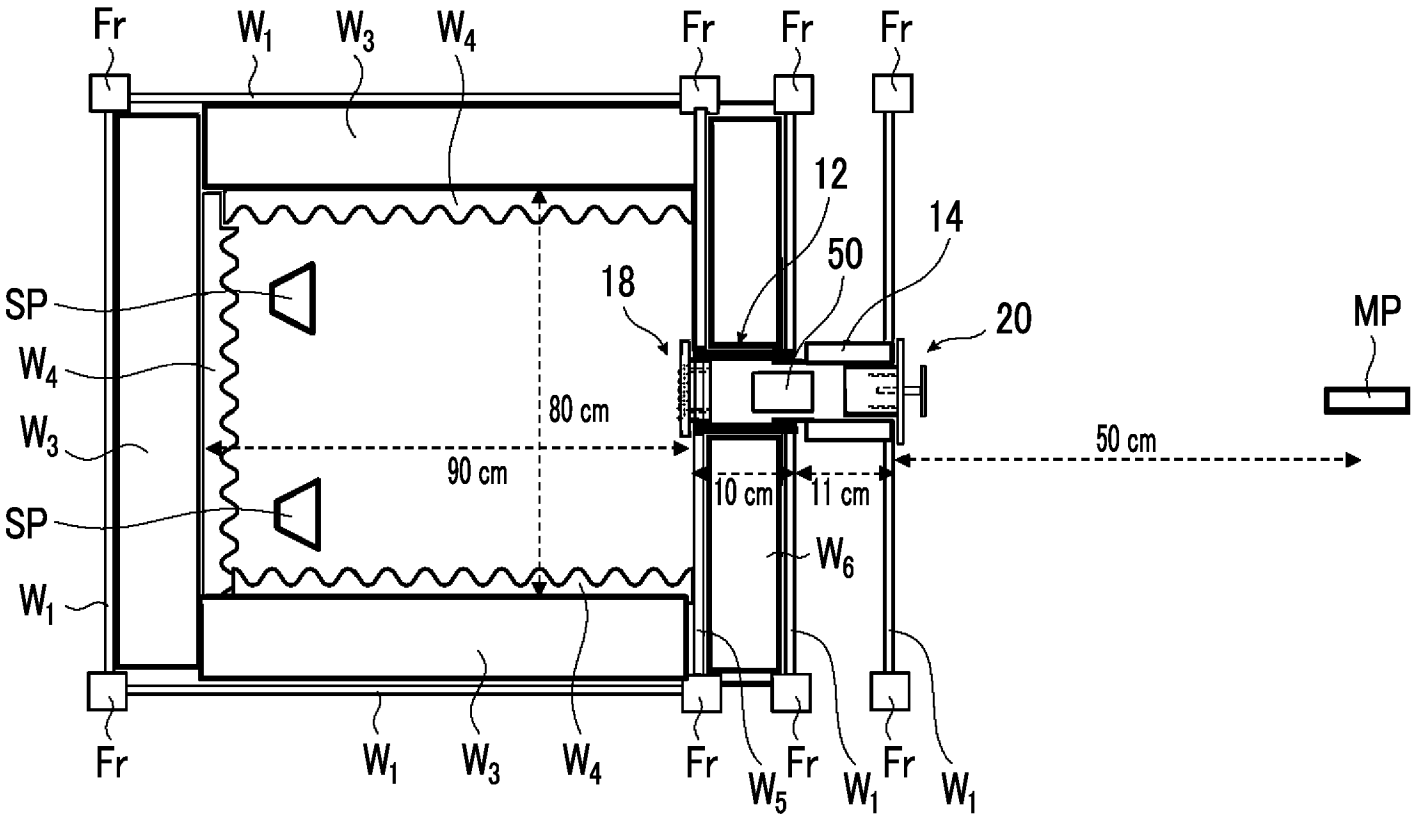
FIG. 79 is a diagram illustrating a method of measuring transmitted sound pressure of Example.

The simple and small soundproof room shown in FIG. 79 is used for performance evaluation.

Five surfaces of the simple soundproof room shown in FIG. 79 are surrounded by sound-absorbing urethane foam $W_3$ (having a thickness of 100 mm, U00F2 manufactured by Fuji Rubber Co. Ltd.) and acrylic plates $W_1$ that are disposed on the outside of the sound-absorbing urethane foam $W_3$ and have a thickness of 5 mm; and the other one thereof is closed by a wall member (corresponding to the wall 16 of the invention) that includes an aluminum plate $W_5$ (having a thickness of 3 mm), glass wool $W_6$ (32501211 manufactured by MASAKI-TRADE CO., LTD., having a density of 32 kg/m$^3$, non-formaldehyde), and an acrylic plate $W_1$ arranged in this order from the inside of the soundproof room. The total thickness of the wall member is set to 100 mm. In addition, an acrylic plate $W_1$ (corresponding to the decorative plate of the invention) is disposed in parallel to the wall member so as to be away from the wall member by 110 mm.

Further, corrugated sound-absorbing urethane foam $W_4$ (having a maximum thickness of 35 mm, U00F6 manufactured by Fuji Rubber Co. Ltd.) is disposed on each of the inner surfaces of three surfaces, which are disposed on the left and right sides and lower side in the figure, among the pieces of the sound-absorbing urethane foam $W_3$ surrounding the five surfaces. The size of the interior space of the soundproof room is set to 800 mm×800 mm×900 mm.

A ventilation sleeve (tubular member) 12, which has an inner diameter of 100 mm and a length of 100 mm and is made of vinyl chloride, is installed in the wall member, which includes the aluminum plate $W_5$, the glass wool $W_6$, and the acrylic plate $W_1$, so as to penetrate the wall member. Further, an opening having a diameter of 100 mm is provided in the decorative plate (acrylic plate $W_1$) at the same position as the ventilation sleeve as seen in the axial direction of the ventilation sleeve.

End portions of the acrylic plate $W_1$ and the aluminum plate $W_5$ are fixed to and supported by frames Fr that are made of aluminum and have a square cross section of which one side has a length of 30 mm.

A horizontal louver (SG-CB manufactured by UNIX Co., Ltd.) is mounted on the end face of the ventilation sleeve 12, which is positioned in the soundproof room, as a cover member 18, and a register (KRP-BWF manufactured by UNIX Co., Ltd.) is mounted on the outer end face of the ventilation sleeve 12 as an air volume-adjusting member 20.

Two speakers SP (Kansupi set KANSPI-8 manufactured by FOSTEX Company) for generating pink noises are disposed in the soundproof room. Further, a measurement microphone MP (TYPE4152N manufactured by ACO Co., Ltd.) for detecting acoustic waves is disposed at a position away from the register 20, which is positioned outside the soundproof room, by 50 cm.

First, ten circular acrylic plates (having a thickness of 5 mm), which has a size (a diameter of about 100 mm) equal to the inner diameter of the ventilation sleeve 12, are stacked and disposed in the ventilation sleeve 12 as a sound-insulation member for a reference. Accordingly, sound passing through the ventilation sleeve 12 is almost completely blocked. Noise is generated from the two speakers SP in this state, and sound pressure is measured for 10 seconds at a sampling rate of 25000 Hz by the measurement microphone MP. Fourier transform is performed on data of the measured sound pressure to calculate a frequency spectrum. The data having been subjected to Fourier transform is averaged at an interval of 10 Hz. This data is used as background data.

Then, the register 20 is fully opened to measure sound pressure in the same way as described above, Fourier transform is performed on data of the sound pressure to calculate a frequency spectrum, and a difference between the background data and the data is obtained and is used as reference data.

Next, as Example 8, the sound-insulation member for a reference and the register 20 are removed, a silencing device 14 is installed on the outer end face of the ventilation sleeve 12 (between the wall member and the decorative plate), and the register 20 is mounted on the end face of the silencing device 14 facing the decorative plate.

The silencing device 14 includes an insertion part 26 that has an outer diameter of 100 mm and an inner diameter of 94 mm and L-shaped silencers 22*a* and 22*b* that are connected to one end face of the insertion part 26. The two silencers 22*a* and 22*b* are arranged in an axial direction. Each of the silencers 22*a* and 22*b* has an annular shape along the peripheral surface of the insertion part 26, and has a shape where each of opening portions 32*a* and 32*b* is formed in the shape of a slit extending in a peripheral direction (see FIG. 24). Further, a sound-absorbing material 24 is disposed in each of the cavity portions 30*a* and 30*b* of the silencers 22*a* and 22*b*.

The depth $L_d$ of the cavity portion 30*a* of the silencer 22*a* is set to 41 mm, the width $L_w$ of the cavity portion 30*a* is set to 16 mm, the width of the opening portion 32*a* in the axial direction is set to 12 mm, and an area ratio $S_1/S_d$ is set to 11.6%. The depth $L_d$ of the cavity portion 30*b* of the silencer 22*b* is set to 60 mm, the width $L_w$ of the cavity portion 30*b* is set to 15 mm, the width of the opening portion 32*b* in the axial direction is set to 12.5 mm, and an area ratio $S_1/S_d$ is set to 8.6%.

Furthermore, Thinsulate (manufactured by 3M Company) is used as the sound-absorbing material 24. The flow resistance of the sound-absorbing material 24 is set to 27000 [Pa·s/m$^2$] and each of the entire cavity portions 30*a* and 30*b* is filled with the sound-absorbing material 24.

The register 20 is fully opened to measure sound pressure in the same way as described above, Fourier transform is performed on data of the sound pressure to calculate a frequency spectrum, and a difference between the background data and the data is obtained and is used as the data of transmitted sound pressure.

Figure 80:
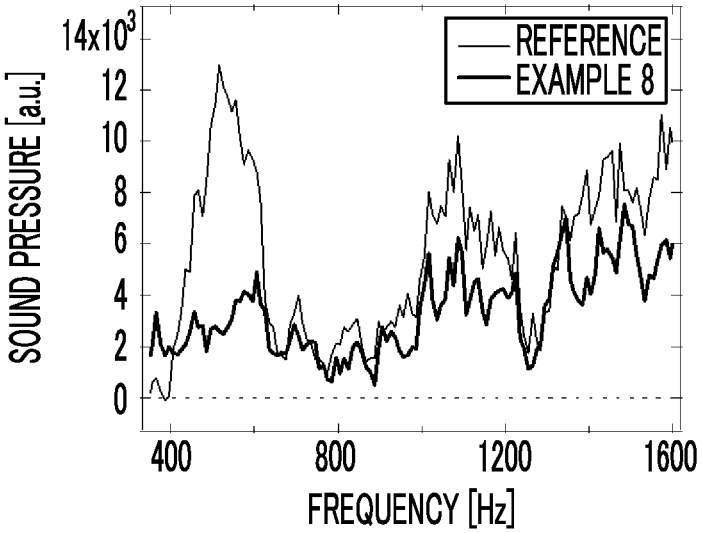
FIG. 80 is a graph showing a relationship between transmitted sound pressure and a frequency.

Results are shown in FIG. 80.

Further, the opening ratio of the silencing device 14 is 88% with respect to the inner diameter of the ventilation sleeve 12.

Comparative Example 5

As Comparative Example 5, transmitted sound pressure is obtained in the same way as Example 8 except that a soundproof sleeve (SK-BO100 manufactured by Shinkyowa Co., Ltd.) made of polyethylene is disposed in a ventilation sleeve 12 as an insertion type silencer instead of the silencing device 14.

Figure 81:
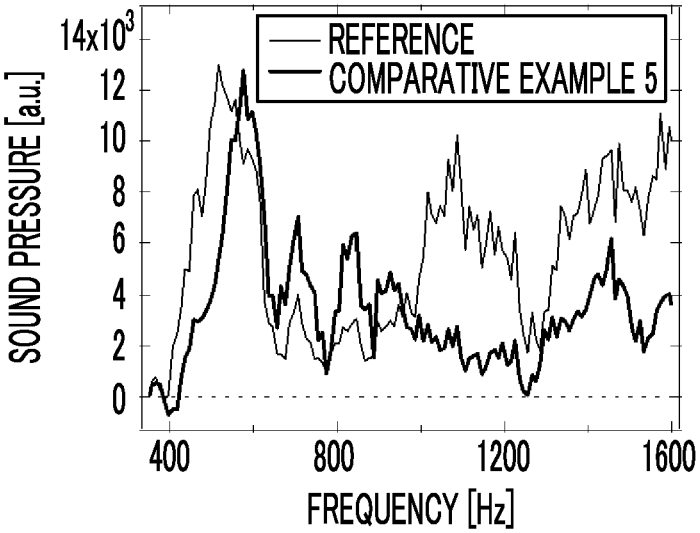
FIG. 81 is a graph showing a relationship between transmitted sound pressure and a frequency.

Results are shown in FIG. 81.

Further, the opening ratio of the soundproof sleeve is 35.7% with respect to the inner diameter of the ventilation sleeve 12.

Example 9

As Example 9, transmitted sound pressure is obtained in the same way as Example 8 except that a soundproof sleeve (SK-B0100 manufactured by Shinkyowa Co., Ltd.) made of polyethylene is further disposed in the ventilation sleeve 12.

Figure 82:
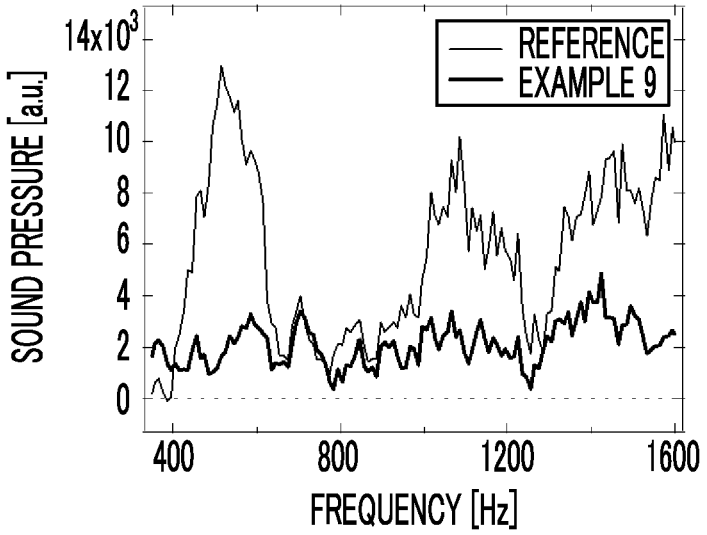
FIG. 82 is a graph showing a relationship between transmitted sound pressure and a frequency.

Results are shown in FIG. 82.

Figure 83:
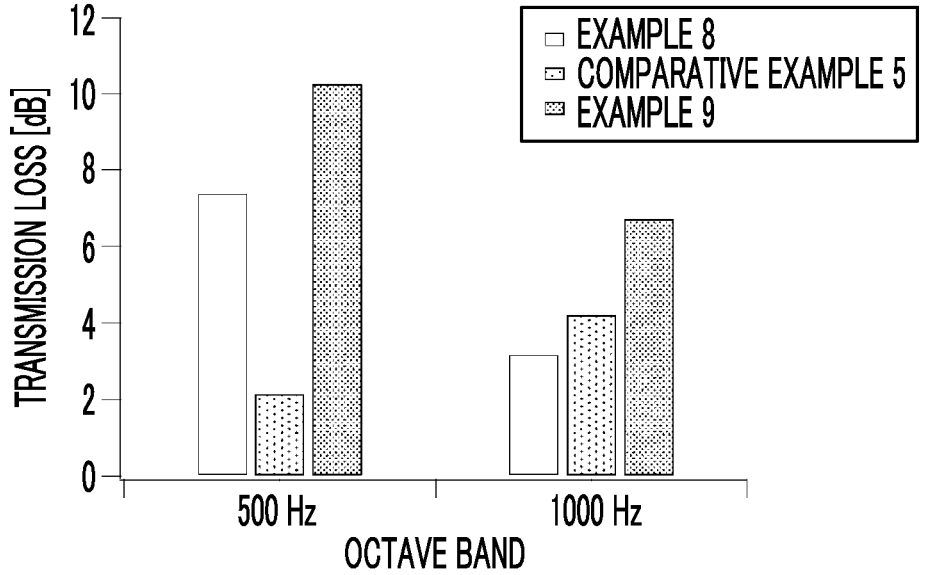
FIG. 83 is a graph showing a relationship between a transmission loss and an octave band.

Further, the results of average values of transmission losses of Examples 8 and 9 and Comparative Example 5 obtained in the respective frequency bands (octave band frequencies) are shown in FIG. 83. An average value obtained at an octave band frequency of 500 Hz is an average value of transmission losses obtained at a frequency equal to or higher than 354 Hz and lower than 707 Hz, and an average value obtained at an octave band frequency of 1000 Hz is an average value of transmission losses obtained at a frequency equal to or higher than 707 Hz and lower than 1414 Hz.

It is found from FIGS. 80 to 83 that soundproof performance in a low frequency band (near 500 Hz), which is higher than soundproof performance in a low frequency band obtained in Comparative Example 5, is obtained in Example 8 where the silencing device 14 is disposed. In addition, it is found from Example 9 that soundproof performance not only in a low frequency band but also in a frequency band near 1000 Hz can be raised in a case where the soundproof sleeve is combined.

Comparative Example 6

As Comparative Example 6, transmitted sound pressure is obtained in the same way as Example 8 except that a soundproof hood (SSFW-A10M manufactured by UNIX Co., Ltd.) is disposed at an end portion of the ventilation sleeve 12 positioned in the soundproof room instead of the silencing device 14.

Figure 84:
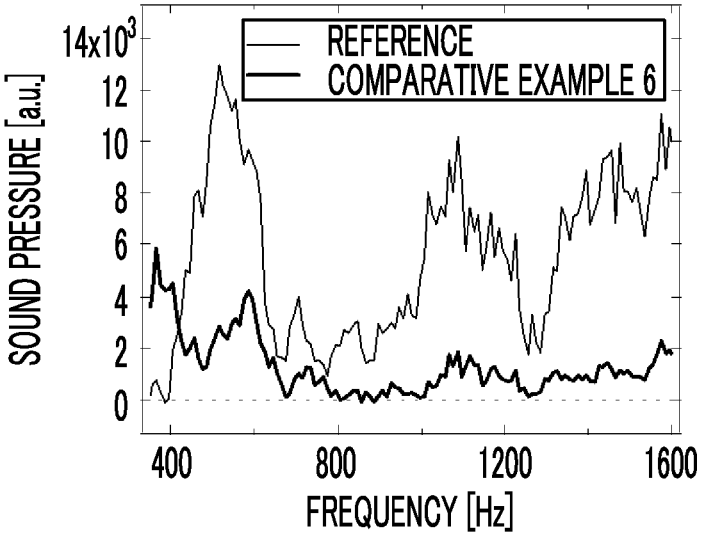
FIG. 84 is a graph showing a relationship between transmitted sound pressure and a frequency.

Results are shown in FIG. 84.

Further, the opening ratio of the soundproof hood is 50.2% with respect to the inner diameter of the ventilation sleeve 12.

Example 10

As Example 10, transmitted sound pressure is obtained in the same way as Example 8 except that a soundproof hood (SSFW-A10M manufactured by UNIX Co., Ltd.) is further disposed at an end portion of the ventilation sleeve 12 positioned in the soundproof room.

Figure 85:
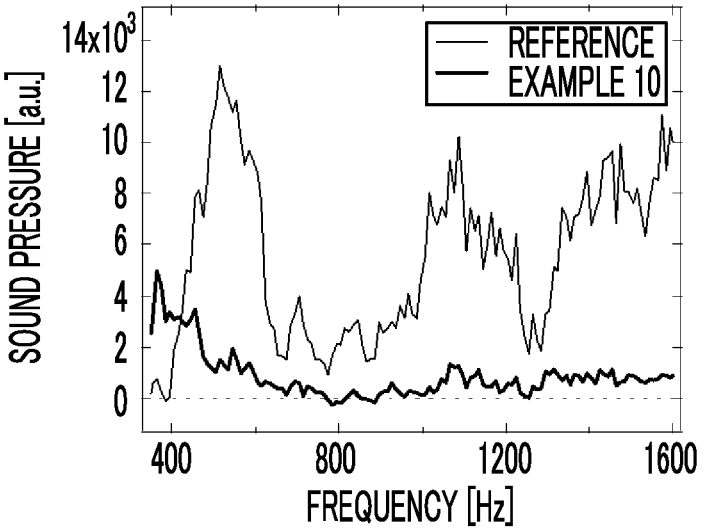
FIG. 85 is a graph showing a relationship between transmitted sound pressure and a frequency.

Results are shown in FIG. 85.

Figure 86:
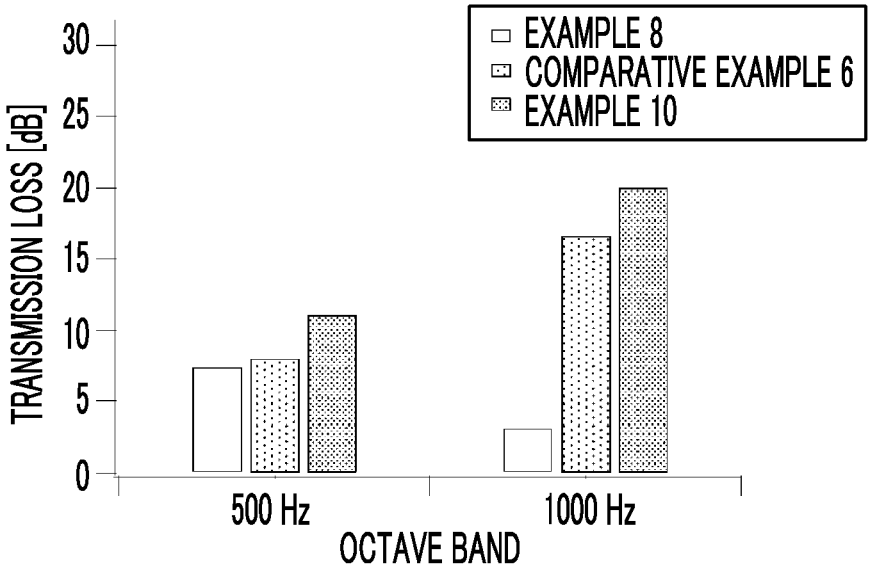
FIG. 86 is a graph showing a relationship between a transmission loss and an octave band.

Further, the results of average values of transmission losses of Examples 8 and 10 and Comparative Example 6 obtained in the respective frequency bands (octave band frequencies) are shown in FIG. 86.

It is found from FIG. 80 and FIGS. 84 to 86 that the same soundproof performance is obtained in a low frequency band (near 500 Hz) in Comparative Example 6 and Example 8 where the silencing device 14 is disposed even though an opening ratio in Example 8 is higher than that in Comparative Example 7. In addition, it is found from Example 10 that soundproof performance not only in a low frequency band but also in a frequency band near 1000 Hz can be raised in a case where the soundproof hood is combined.

Example 11

As Example 11, transmitted sound pressure is obtained in the same way as Example 8 except that a soundproof sleeve (SK-BO100 manufactured by Shinkyowa Co., Ltd.) made of polyethylene is further disposed in the ventilation sleeve 12 and a soundproof hood (SSFW-A10M manufactured by UNIX Co., Ltd.) is further disposed at an end portion of the ventilation sleeve 12 positioned in the soundproof room.

Figure 87:
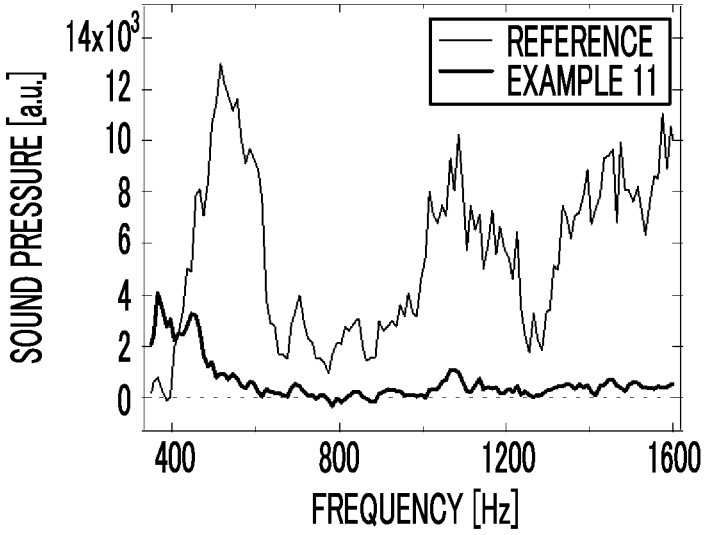
FIG. 87 is a graph showing a relationship between transmitted sound pressure and a frequency.

Results are shown in FIG. 87.

Figure 88:
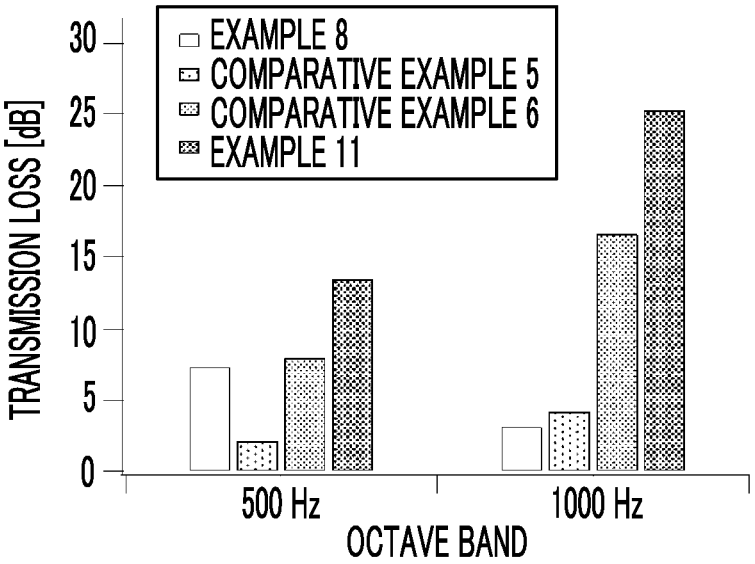
FIG. 88 is a graph showing a relationship between a transmission loss and an octave band.

Further, the results of average values of transmission losses of Examples 8 and 11 and Comparative Examples 5 and 6 obtained in the respective frequency bands (octave band frequencies) are shown in FIG. 88.

It is found from FIGS. 87 to 88 that soundproof performance not only in a low frequency band but also in a frequency band near 1000 Hz can be raised in a case where the soundproof sleeve and the soundproof hood are combined.

The effects of the invention are clear from the above-mentioned results.

EXPLANATION OF REFERENCES

10*a* to 10*t*: silencing system
12: tubular member
14: silencing device
16: wall
18: cover member
20: air volume-adjusting member
21, 22, 22*a*, 22*b*, 23: silencer
24, 24*a* to 24*e*: sound-absorbing material
26: insertion part
30, 30*a*, 30*b*: cavity portion
32, 32*a*, 32*b*: opening portion
34: entering prevention plate

36: lid portion
38: second opening portion
40: decorative plate
42: boundary cover
44: non-ventilation film
46: membrane member
50: insertion type silencer
52: soundproof hood
54: partition member
60: sound transmission wall

What is claimed is:

1. A silencing system comprising:

one or more silencers that are disposed on a tubular member provided to penetrate a wall separating two spaces, wherein the silencer silences sound having a frequency that includes a frequency of first resonance occurring in the tubular member, the silencer includes a cavity portion and an opening portion that allows the cavity portion and the outside to communicate with each other, at least one of the opening portions of the silencers is connected to a sound field space of the first resonance of the tubular member in the silencing system, a conversion mechanism for converting sound energy into thermal energy is disposed in at least a part of the cavity portion of the silencer or at a position where the conversion mechanism covers at least a part of the opening portion of the silencer, a depth $L_d$ of the cavity portion in a traveling direction of an acoustic wave in the silencer is larger than a width $L_o$ of the opening portion in an axial direction of the tubular member, in a case where a wavelength of an acoustic wave at a resonant frequency of the first resonance is denoted by $\lambda$, the depth $L_d$ of the cavity portion in the traveling direction of an acoustic wave in the silencer satisfies "$0.011\times\lambda<L_d<0.25\times\lambda$", and the silencer does not resonate with sound having the frequency of the first resonance occurring in the tubular member, and silences the sound having the frequency of the first resonance by the conversion mechanism without silencing the sound with resonance of the silencer.

2. A silencing system comprising:

one or more silencers that are disposed on a tubular member provided to penetrate a wall separating two spaces, wherein the silencer silences sound having a frequency that includes a frequency of first resonance occurring in the tubular member, the silencer includes a cavity portion and an opening portion that allows the cavity portion and the outside to communicate with each other, at least one of the opening portions of the silencers is connected to a sound field space of the first resonance of the tubular member in the silencing system, a conversion mechanism for converting sound energy into thermal energy is disposed in at least a part of the cavity portion of the silencer or at a position where the conversion mechanism covers at least a part of the opening portion of the silencer, in a case where an area of the opening portion of the silencer is denoted by $S_1$ and a surface area of an inner wall of the cavity portion is denoted by $S_d$, a ratio $S_1/S_d$ of the area S to the area $S_d$ satisfies "$0<S_1/S_d<40\%$", in a case where a wavelength of an acoustic wave at a resonant frequency of the first resonance is denoted by $\lambda$, a depth $L_d$ of the cavity portion in a traveling direction of an acoustic wave in the silencer satisfies "$0.011\times\lambda<L_d<0.25\times\lambda$", and the silencer does not resonate with sound having the frequency of the first resonance occurring in the tubular member, and silences the sound having the frequency of the first resonance by the conversion mechanism without silencing the sound with resonance of the silencer.

3. The silencing system according to claim 1, wherein "$1.15\times F_0<F_1$" is satisfied in a case where the frequency of the first resonance occurring in the tubular member is denoted by $F_0$ and the resonant frequency of the silencer is denoted by $F_1$.

4. The silencing system according to claim 1, wherein a width $L_w$ of the cavity portion in a direction orthogonal to a depth direction of the cavity portion in a cross section parallel to the axial direction of the tubular member satisfies "$0.001\times\lambda<L_w<0.061\times\lambda$".

5. The silencing system according to claim 1, wherein the conversion mechanism is a sound-absorbing material, and flow resistance $\sigma_1$ of the sound-absorbing material satisfies "$(1.25-\log(0.1\times L_d))/0.24<\log(\sigma_1)<5.6$".

6. The silencing system according to claim 1, wherein, in a cross section parallel to the axial direction of the tubular member, the silencer includes the cavity portion that extends in the axial direction of the tubular member and the opening portion that is positioned on one surface of the cavity portion parallel to the axial direction of the tubular member at one end portion of the cavity portion in the axial direction of the tubular member, and a length of the cavity portion in the axial direction of the tubular member is the depth $L_d$ of the cavity portion.

7. The silencing system according to claim 6, wherein an area $S_1$ of the opening portion on a circumferential surface, which has an axis on a central axis of the tubular member, is smaller than an area $S_0$ of the cavity portion.

8. The silencing system according to claim 1, wherein two or more silencers are provided, and the opening portions of the respective silencers are disposed so as to be rotationally symmetric with respect to a central axis of the tubular member.

9. The silencing system according to claim 1, wherein at least some of the silencers are disposed on an outer periphery of the tubular member.

10. The silencing system according to claim 9, wherein, in a cross section perpendicular to the axial direction of the tubular member, an effective outer diameter $D_0$ of the tubular member and an effective outer diameter $D_1$ of the silencer satisfy "$D_1<D_0+2\times(0.045\times\lambda+5\text{ mm})$".

11. The silencing system according to claim 9, wherein the opening portions of the silencers are connected to peripheral surface-opening portions formed on a peripheral surface of the tubular member.

12. The silencing system according to claim 1, wherein the silencers are disposed in the tubular member.

13. The silencing system according to claim 1, wherein a plurality of the silencers are provided, and the opening portions of the plurality of silencers are disposed on at least two or more positions in the axial direction of the tubular member.

14. The silencing system according to claim 13, wherein the depths La of the cavity portions of the silencers are different at the respective positions of the opening portions.

15. The silencing system according to claim 13, wherein sound-absorbing materials having different acoustic characteristics are disposed in the cavity portions of the silencers at the respective positions of the opening portions.

16. The silencing system according to claim 1, further comprising:

a decorative plate that is provided in parallel to the wall, wherein a total thickness of the wall and the decorative plate including a space between the wall and the decorative plate is in a range of 175 mm to 400 mm.

17. The silencing system according to claim 1, wherein a width $L_w$ of the cavity portion of the silencer satisfies "5.5 mm≤$L_w$≤300 mm".

18. The silencing system according to claim 1, wherein the depth $L_d$ of the cavity portion of the silencer satisfies "25.3 mm≤$L_d$≤175 mm".

19. The silencing system according to claim 1, wherein the conversion mechanism is a sound-absorbing material, and a plurality of the sound-absorbing materials are disposed in the cavity portion.

* * * * *